US012152600B2

(12) United States Patent
Teramoto et al.

(10) Patent No.: US 12,152,600 B2
(45) Date of Patent: Nov. 26, 2024

(54) IMPELLER, CENTRIFUGAL FAN, AND AIR-CONDITIONING APPARATUS

(71) Applicant: Mitsubishi Electric Corporation, Tokyo (JP)

(72) Inventors: Takuya Teramoto, Tokyo (JP); Hiroyasu Hayashi, Tokyo (JP); Ryo Horie, Tokyo (JP); Takashi Yamaguchi, Tokyo (JP); Tomohiro Nagano, Tokyo (JP); Kazuya Michikami, Tokyo (JP); Takahiro Yamatani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 17/915,389

(22) PCT Filed: Oct. 22, 2020

(86) PCT No.: PCT/JP2020/039663
§ 371 (c)(1),
(2) Date: Sep. 28, 2022

(87) PCT Pub. No.: WO2021/210201
PCT Pub. Date: Oct. 21, 2021

(65) Prior Publication Data

US 2023/0130474 A1 Apr. 27, 2023

(30) Foreign Application Priority Data

Apr. 16, 2020 (WO) ..... PCT/JP2020/016713

(51) Int. Cl.
*F04D 29/28* (2006.01)
*F04D 17/16* (2006.01)
(Continued)

(52) U.S. Cl.
CPC ..... *F04D 29/281* (2013.01); *F04D 17/16* (2013.01); *F04D 25/06* (2013.01); *F24F 1/0022* (2013.01)

(58) Field of Classification Search
CPC ..... F04D 29/281
See application file for complete search history.

(56) References Cited

U.S. PATENT DOCUMENTS 6,007,300 A 12/1999 Saeki et al.
6,299,409 B1 10/2001 Matsunaga et al.
(Continued)

FOREIGN PATENT DOCUMENTS

CN 101631992 A 1/2010
JP 10-306796 A 11/1998
(Continued)

OTHER PUBLICATIONS

Extended European Search Report dated Sep. 4, 2023 issued in corresponding European Patent Application No. 20931120.8.
(Continued)

*Primary Examiner* — Sabbir Hasan
(74) *Attorney, Agent, or Firm* — Posz Law Group, PLC

(57) ABSTRACT

An impeller includes: a main plate to be rotated; an annular side plate having a suction port for air; and blades in a circumferential direction. Each of the blades has: an inner peripheral end; an outer peripheral end; a sirocco blade portion that includes the outer peripheral end, and forms a forward-swept blade; and a turbo blade portion that includes the inner peripheral end and forms a swept-back blade. The blade has an end portion facing the suction port and a base portion connected to the main plate, and the end portion has a smaller thickness than that of the base portion in the sirocco blade portion. The end portion of the blade has a blade shape, and in the end portion having the blade shape,
(Continued)

a first blade thickness of an inner circumferential side of the impeller is greater than a second blade thickness of the outer circumferential side.

22 Claims, 32 Drawing Sheets

(51) Int. Cl.
*F04D 25/06* (2006.01)
*F24F 1/0022* (2019.01)

(56) References Cited

U.S. PATENT DOCUMENTS

| | | | | |
|---|---|---|---|---|
| 10,808,714 | B2 * | 10/2020 | Ishii | F04D 29/66 |
| 2010/0115983 | A1 | 5/2010 | Ikeda et al. | |

FOREIGN PATENT DOCUMENTS

| | | | | |
|---|---|---|---|---|
| JP | 2000240590 | A | * | 9/2000 |
| JP | 2000-291590 | A | | 10/2000 |
| JP | 2001-082383 | A | | 3/2001 |
| JP | 2002-070793 | A | | 3/2002 |
| JP | 2005-030349 | A | | 2/2005 |
| JP | 2005-155580 | A | | 6/2005 |
| JP | 3948785 | B2 | | 7/2007 |
| JP | 2007-247594 | A | | 9/2007 |
| JP | 2009-203897 | A | | 9/2009 |
| JP | 2012-202368 | A | | 10/2012 |
| JP | 3179754 | U | | 11/2012 |
| WO | 2008/111368 | A1 | | 9/2008 |
| WO | 2019/082378 | A1 | | 5/2019 |

OTHER PUBLICATIONS

Office Action dated Jun. 27, 2023 issued in corresponding JP Patent Application No. 2022-515195 (and English translation).
International Search Report of the International Searching Authority mailed Jun. 16, 2020 in corresponding International Patent Application No. PCT/JP2020/016713 (and English translation mistakenly identified as PCT/JP2020/015940).
International Search Report of the International Searching Authority mailed Dec. 28, 2020 in corresponding International Patent Application No. PCT/JP2020/039663 (and English translation).
Taiwanese Office Action issued on Jan. 3, 2022 in JP Patent Application No. 110112700 (with English machine translation).
Taiwanese Office Action issued on Jul. 6, 2022 in JP Patent Application No. 110112700 (with English machine translation).

* cited by examiner

Comparative Example

IMPELLER, CENTRIFUGAL FAN, AND AIR-CONDITIONING APPARATUS

CROSS REFERENCE TO RELATED APPLICATIONS

This application is a U.S. national stage application of PCT/JP2020/039663 filed on Oct. 22, 2020, which claims priority to PCT international application PCT/JP2020/016713, filed on Apr. 16, 2020, the contents of which are incorporated herein by reference.

TECHNICAL FIELD

The present disclosure relates to an impeller, a centrifugal fan including the impeller, and an air-conditioning apparatus including the centrifugal fan.

BACKGROUND ART

Existing centrifugal fans include a scroll casing having a scroll shape and an impeller that is provided in the scroll casing and is rotatable around a shaft of the impeller (see, for example, Patent Literature 1). An impeller included in a centrifugal fan disclosed in Patent Literature 1 includes a circular main plate, annular side plates, and blades arranged radially. The blades of the impeller include main blades and intermediate blades. The main blades and the intermediate blades are alternately arranged, and the inside diameter of the main blades and the inside diameter of the intermediate blades increase from the main plate toward the side plates. Each of the blades of the impeller includes a sirocco blade (forward-swept blade) portion that has an outlet angle of 100 degrees or more and an inducer portion that is a turbo blade (swept-back blade) portion, on an inner circumferential side of the blade. On a main plate side, the ratio of the inside diameter of the main blades to the outside diameter of the main blades is 0.7 or less.

CITATION LIST

Patent Literature

Patent Literature 1: Japanese Unexamined Patent Application Publication No. 2000-240590

SUMMARY OF INVENTION

Technical Problem

In the centrifugal fan disclosed in Patent Literature 1, in each of the intermediate blades, the ratio of the turbo blade portion located on the inner circumferential side to the intermediate blade is substantially the same as that of the sirocco blade portion located on an outer circumferential side of the blade to the intermediate blade, and it cannot be expected that at the intermediate blade, a sufficient pressure recovery is achieved. In addition, in the centrifugal fan of Patent Literature 1, the sirocco blade portions of the blades included in the impeller are located adjacent to the side plate. Thus, the centrifugal fan of Patent Literature 1 cannot be expected to achieve a sufficient pressure recovery at the blade portions adjacent to the side plate.

The present disclosure is applied to solve the above problems, and relates to an impeller that can achieve a more sufficient pressure recovery, a centrifugal fan including the impeller, and an air-conditioning apparatus including the centrifugal fan.

Solution to Problem

An impeller according to an embodiment of the present disclosure includes: a main plate to be driven to rotate; an annular side plate provided opposite to the main plate and having a suction port for air, and blades connected to the main plate and the side plate and arranged in a circumferential direction around a rotation axis of the main plate. Each of the blades has: an inner peripheral end located adjacent to the rotation axis in a radial direction from the rotation axis; an outer peripheral end located closer to an outer circumferential side of the impeller than the inner peripheral end in the radial direction; a sirocco blade portion that includes the outer peripheral end, has an outlet angle of greater than 90 degrees, and forms a forward-swept blade; and a turbo blade portion that includes the inner peripheral end and forms a swept-back blade. Each of the of blades has an end portion that faces the suction port and a base portion that is connected to the main plate, and the end portion has a smaller thickness than a thickness of the base portion in the sirocco blade portion. The end portion of each of the blades has a blade shape, and in the end portion having the blade shape, a first blade thickness of an inner circumferential side of the impeller is greater than a second blade thickness of the outer circumferential side.

A centrifugal fan according to another embodiment of the present disclosure includes the impeller having configuration and a scroll casing that accommodates the impeller and that includes a scroll circumferential wall and a side wall provided with a bell mouth that defines a casing suction port communicating with a space defined by the main plate and the blades.

An air-conditioning apparatus according to still another embodiment of the present disclosure includes the centrifugal fan having the above configuration.

Advantageous Effects of Invention

According to the present disclosure, at the end portion facing the suction port and having the blade shape, the first blade thickness of the inner circumferential side is greater than the second blade thickness of the outer circumferential side. In the impeller having such a configuration, the inter-blade distance between the blades increases from the inner circumferential side to the outer circumferential side, whereby the blades can achieve a sufficient pressure recovery, and improve a pressure recovery, as compared with an impeller and a centrifugal fan that do not have the above configuration.

DESCRIPTION OF EMBODIMENTS

An impeller 10, a centrifugal fan 100, and an air-conditioning apparatus 140, according to each of embodiments, will be described with reference to the drawings. It should be noted that in each of the following figures including FIG. 1, relationships between relative dimensions, shapes, etc. of components may differ from those of actual ones. Also, in each figure, components that are the same as or equivalent to those in a previous figure or previous figures are denoted by the same reference signs, and the same is true of the entire text of the specification. In descriptions concerning the embodiments, in order that the embodiments be easily understood, terms related to directions, such as "upper", "lower", "right", "left", "forward", and "backward", are used as appropriate. However, these terms are used only as a matter of convenience for explanation, but do not limit the location and orientation of each of devices or components.

Embodiment 1

[Centrifugal Fan 100]

Figure 1:
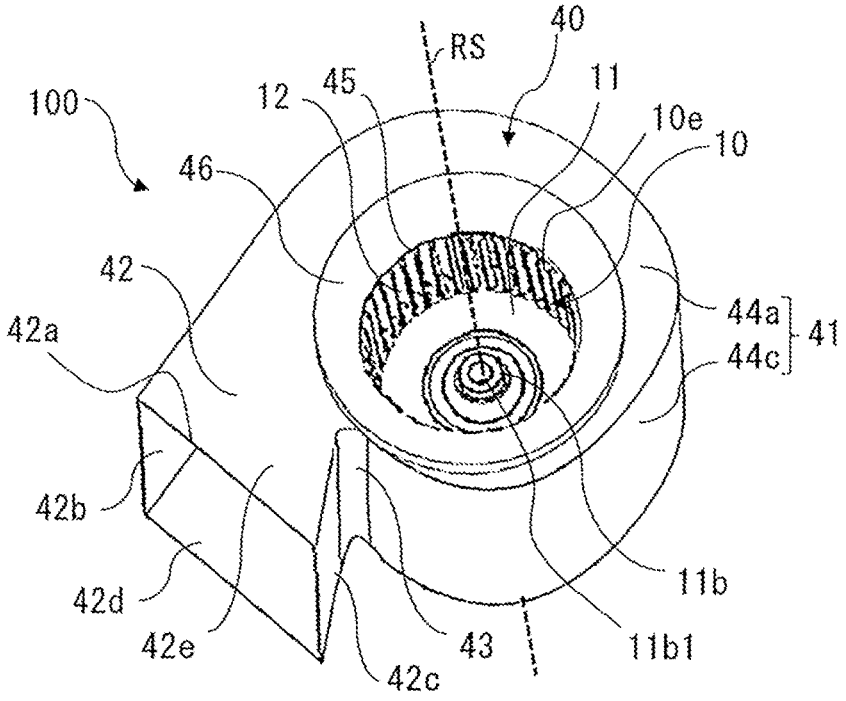
FIG. 1 is a schematic perspective view of a centrifugal fan according to Embodiment 1.
Figure 2:
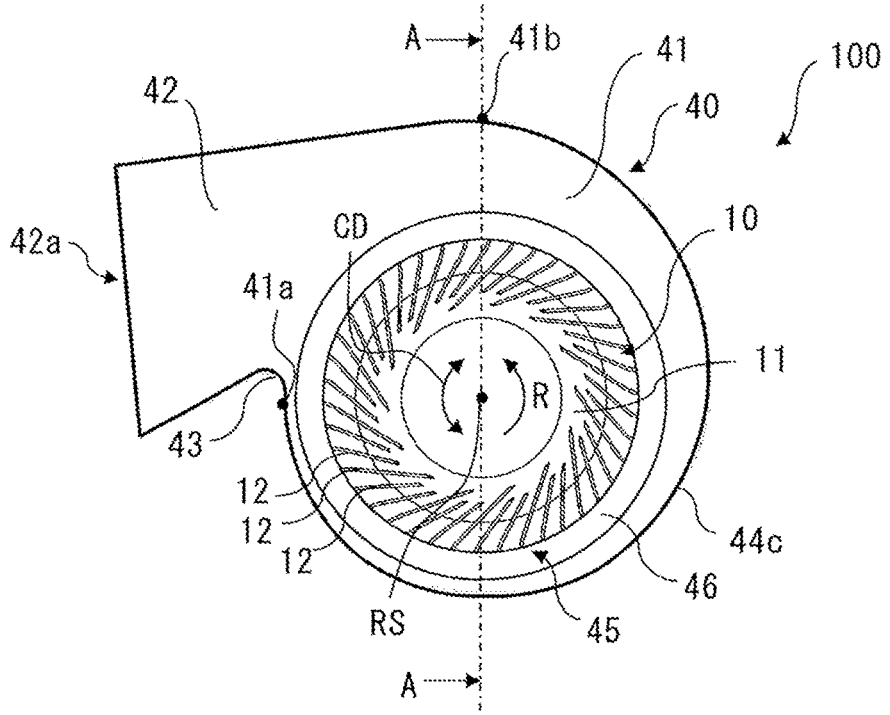
FIG. 2 is a schematic external view of the centrifugal fan according to Embodiment 1 as viewed in a direction parallel to a rotation axis.
Figure 3:
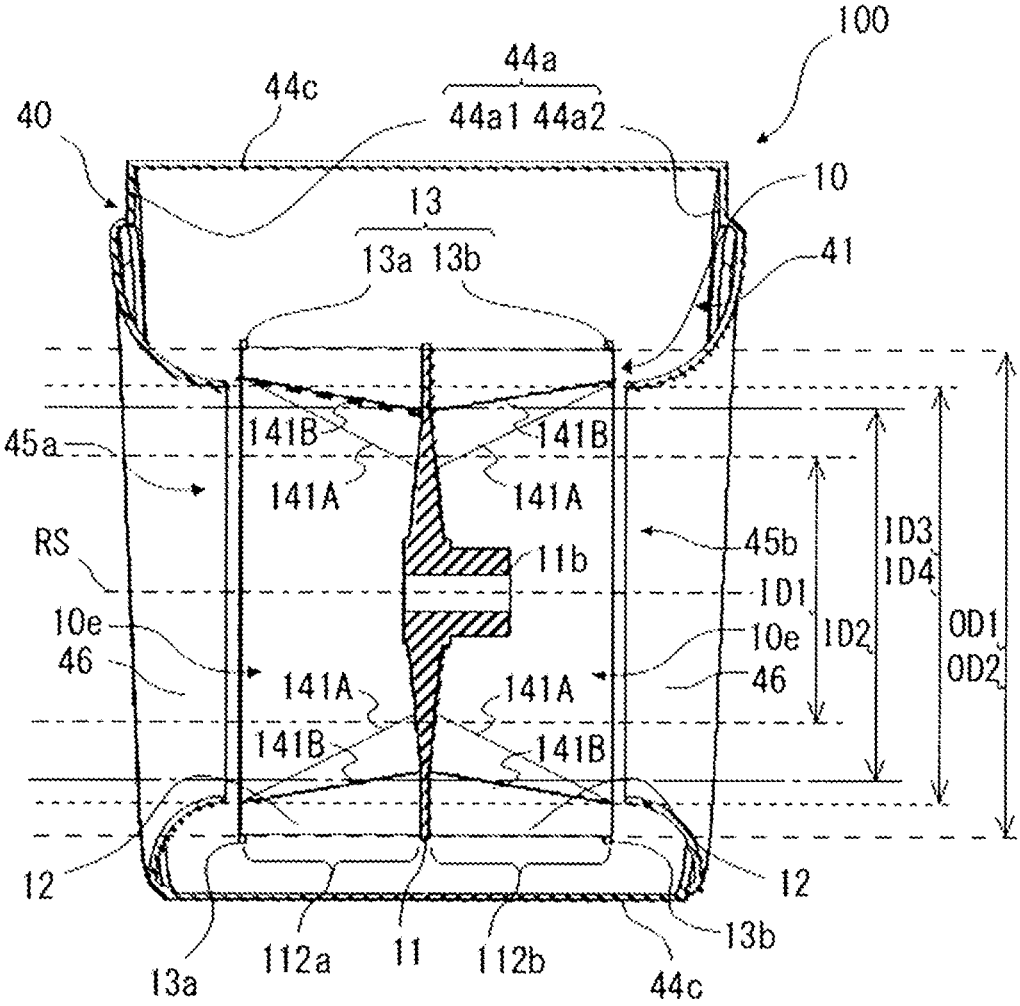
FIG. 3 is a schematic sectional view of the centrifugal fan that is taken along line A-A in FIG. 2.

FIG. 1 is a schematic perspective view of a centrifugal fan 100 according to Embodiment 1. FIG. 2 is an external view schematically illustrating the centrifugal fan 100 according to Embodiment 1 as viewed in a direction parallel to a rotation axis RS. FIG. 3 is a schematic sectional view of the centrifugal fan 100 that is taken along line A-A in FIG. 2. A basic configuration of the centrifugal fan 100 will be described with reference to FIGS. 1 to 3.

The centrifugal fan 100 is a multi-blade centrifugal fan, and includes an impeller 10 that produces an air current and a scroll casing 40 that accommodates the impeller 10. The centrifugal fan 100 is a double suction type centrifugal fan in which air is sucked into the scroll casing 40 from opposite sides thereof in an axial direction along an imaginary rotation axis RS of the impeller 10.

[Scroll Casing 40]

The scroll casing 40 accommodates the impeller 10 for the centrifugal fan 100 and regulates the flow of air blown from the impeller 10. The scroll casing 40 has a scroll portion 41 and a discharge portion 42.

(Scroll Portion 41)

The scroll portion 41 defines an air passage through which a dynamic pressure of the air current generated by the impeller 10 is converted into a static pressure. The scroll portion 41 includes side walls 44*a* and a circumferential wall 44*c*. The side walls 44*a* cover the impeller 10 in the axial direction along the rotation axis RS of a boss 11*b* included in the impeller 10, and each have a casing suction port 45 through which air is taken into the casing. The circumferential wall 44*c*, which is separated from the rotation axis of the boss 11*b* in a radial direction from the rotation axis RS, surrounds the impeller 10.

The scroll portion 41 further has a tongue portion 43 located between the discharge portion 42 and a scroll start portion 41*a* of the circumferential wall 44*c*. The tongue portion 43 forms a curved surface and guides an air current generated by the impeller 10 to a discharge port 42*a* via the scroll portion 41. It should be noted that the radial direction from the rotation axis RS is a direction perpendicular to the axial direction along the rotation axis RS. An internal space in the scroll portion 41 including the circumferential wall 44*c* and the side walls 44*a* is a space in which air blown from the impeller 10 flows along the circumferential wall 44*c*.

(Side Walls 44*a*)

The side walls 44*a* are located on opposite sides of the impeller 10 in the axial direction along the rotation axis RS of the impeller 10. The side walls 44*a* of the scroll casing 40 each have the casing suction port 45, which allows air to flow between the impeller 10 and the outside of the scroll casing 40.

The casing suction port 45 has a circular shape. The impeller 10 is provided such that the center of the casing suction port 45 is substantially coincident with the center of the boss 11*b* of the impeller 10. The shape of the casing suction port 45 is not limited to the circular shape. The casing suction port 45 may have any shape, such as an elliptical shape.

The scroll casing 40 of the centrifugal fan 100 is a double suction type casing, and includes the side walls 44*a* which have the respective casing suction ports 45 and are arranged on opposite sides of a main plate 11 in the axial direction along the rotation axis RS of the boss 11*b*.

The scroll casing 40 of the centrifugal fan 100 includes the two side walls 44*a*. The two side walls 44*a* face each other, with the circumferential wall 44*c* interposed between the side walls 44*a*. More specifically, the scroll casing 40 includes, as the side walls 44*a*, a first side wall 44*a*1 and a second side wall 44*a*2, as illustrated in FIG. 3.

The first side wall 44*a*1 has a first suction port 45*a*. The first suction port 45*a* faces one surface of the main plate 11 that faces a first side plate 13*a*, which will be described later. The second side wall 44*a*2 has a second suction port 45*b*. The second suction port 45*b* faces the other surface of the main plate 11 that faces a second side plate 13*b*, which will be described later. The "casing suction port 45" is a generic term for the first suction port 45*a* and the second suction port 45*b*.

The casing suction port 45 of each side wall 44*a* is defined by a bell mouth 46. Specifically, the bell mouth 46 defines the casing suction port 45, which communicates with a space defined by the main plate 11 and multiple blades 12. The bell mouth 46 regulates the flow of air to be sucked into the impeller 10 and causes the air to enter a suction port 10*e* of the impeller 10.

The bell mouth 46 is formed such that an opening size of the bell mouth 46 gradually decreases in a direction from the outside of the scroll casing 40 toward the inside thereof. Because the side walls 44*a* are configured in the above manner, air that is present in the vicinity of the casing suction ports 45 flows smoothly along the bell mouth 46, and efficiently flows into the impeller 10 through the casing suction ports 45.

(Circumferential Wall 44*c*)

The circumferential wall 44*c* is a wall that guides an air current generated by the impeller 10 along its curved surface to the discharge port 42*a*. The circumferential wall 44*c* is located between the side walls 44*a* located opposite to each other, and forms a curved face that extends in a rotation direction R of the impeller 10. The circumferential wall 44*c* is provided parallel to, for example, the axial direction along the rotation axis RS of the impeller 10, and covers the impeller 10. It should be noted that the circumferential wall 44*c* may be inclined to the axial direction along the rotation axis RS of the impeller 10. The configuration of the circumferential wall 44*c* is not limited to that of the above example in which the circumferential wall 44*c* is provided parallel to the axial direction along the rotation axis RS.

The circumferential wall 44*c*, which is separated from the boss 11*b* in the radial direction, covers the impeller 10, and forms an inner circumferential surface that faces the blades 12. The circumferential wall 44*c* faces an air outlet side of the blades 12 of the impeller 10. As illustrated in FIG. 2, the circumferential wall 44*c* extends in the rotation direction R of the impeller 10 from the scroll start portion 41*a*, which is located at the boundary between the circumferential wall 44*c* and the tongue portion 43, to a scroll end portion 41*b*, which is located at the boundary between the scroll portion 41 and the discharge portion 42 located away from the tongue portion 43.

The scroll start portion 41*a* is an upstream end of the circumferential wall 44*c*, which forms a curved face in a direction in which air flows along the circumferential wall 44*c* in the internal space of the scroll casing 40 because of rotation of the impeller 10. The scroll end portion 41*b* is a downstream end of the circumferential wall 44*c*, which forms a curved face in the direction in which air is moved along the circumferential wall 44*c* in the internal space of the scroll casing 40 because of rotation of the impeller 10.

The circumferential wall 44*c* has a scroll shape. As the scroll shape, for example, a logarithmic spiral, an Archimedean spiral, or a shape based on an involute curve is applied. The inner circumferential surface of the circumferential wall 44*c* forms a curved surface that smoothly curves in a circumferential direction of the impeller 10 from the scroll start portion 41*a* which corresponds to a scroll start point to the scroll end portion 41*b* which corresponds to a scroll end point. Because of such a configuration, air sent from the impeller 10 smoothly flows toward the discharge portion 42 in a space between the impeller 10 and the circumferential wall 44*c*. Thus, in the scroll casing 40, the static pressure of the air from the tongue portion 43 efficiently rises toward the discharge portion 42.

(Discharge Portion 42)

The discharge portion 42 forms the discharge port 42*a* through which an air current generated by the impeller 10 is discharged after passing through the scroll portion 41. The discharge portion 42 is formed by a hollow duct having a rectangular section orthogonal to a direction in which air flows along the circumferential wall 44*c*. The sectional shape of the discharge portion 42 is not limited to a rectangle. The discharge portion 42 forms a flow passage through which air sent from the impeller 10 and flowing through the space between the impeller 10 and the circumferential wall 44*c* is guided and discharged to the outside of the scroll casing 40.

As illustrated in FIG. 1, the discharge portion 42 includes an extension plate 42*b*, a diffuser plate 42*c*, a first side plate 42*d*, a second side plate 42*e*, etc. The extension plate 42*b* is formed integrally with the circumferential wall 44*c* such that the extension plate 42*b* smoothly extends continuous with the scroll end portion 41*b*, which is the downstream end of the circumferential wall 44*c*. The diffuser plate 42*c* is integrally formed with the tongue portion 43 of the scroll casing 40, and faces the extension plate 42*b*. The diffuser plate 42*c* is inclined at a predetermined angle to the extension plate 42*b* such that the sectional area of the passage gradually increases in the flow direction of air in the discharge portion 42.

The first side plate 42*d* is integrally formed with the first side wall 44*a*1 of the scroll casing 40. The second side plate 42*e* is integrally formed with the second side wall 44*a*2 of the scroll casing 40 that is located opposite to the first side wall 44*a*1 thereof. The first side plate 42*d* and the second side plate 42*e* are arranged between the extension plate 42*b* and the diffuser plate 42*c*. As described above, the extension plate 42*b*, the diffuser plate 42*c*, the first side plate 42*d*, and the second side plate 42*e* of the discharge portion 42 define the passage having the rectangular section.

(Tongue Portion 43)

In the scroll casing 40, the tongue portion 43 is formed between the diffuser plate 42*c* of the discharge portion 42 and the scroll start portion 41*a* of the circumferential wall 44*c*. The tongue portion 43 has a radius of curvature that is determined in advance, and the circumferential wall 44*c* is smoothly continuous with the diffuser plate 42*c*, with the tongue portion 43 interposed between the circumferential wall 44*c* and the diffuser plate 42*c*.

The tongue portion 43 restricts the flow of air from the scroll end to the scroll start of the scroll passage. The tongue portion 43 is located at an upstream part of the air passage, and serves to separate an air current that flows in the rotation direction R of the impeller 10 from an air current that flows in a discharge direction from a downstream part of the air passage toward the discharge port 42*a*. The static pressure of an air current that flows into the discharge portion 42 increases while the air current is passing through the scroll casing 40, and becomes higher than that in the scroll casing 40. The tongue portion 43 thus serves to adjust such a pressure difference.

[Impeller 10]

Figure 4:
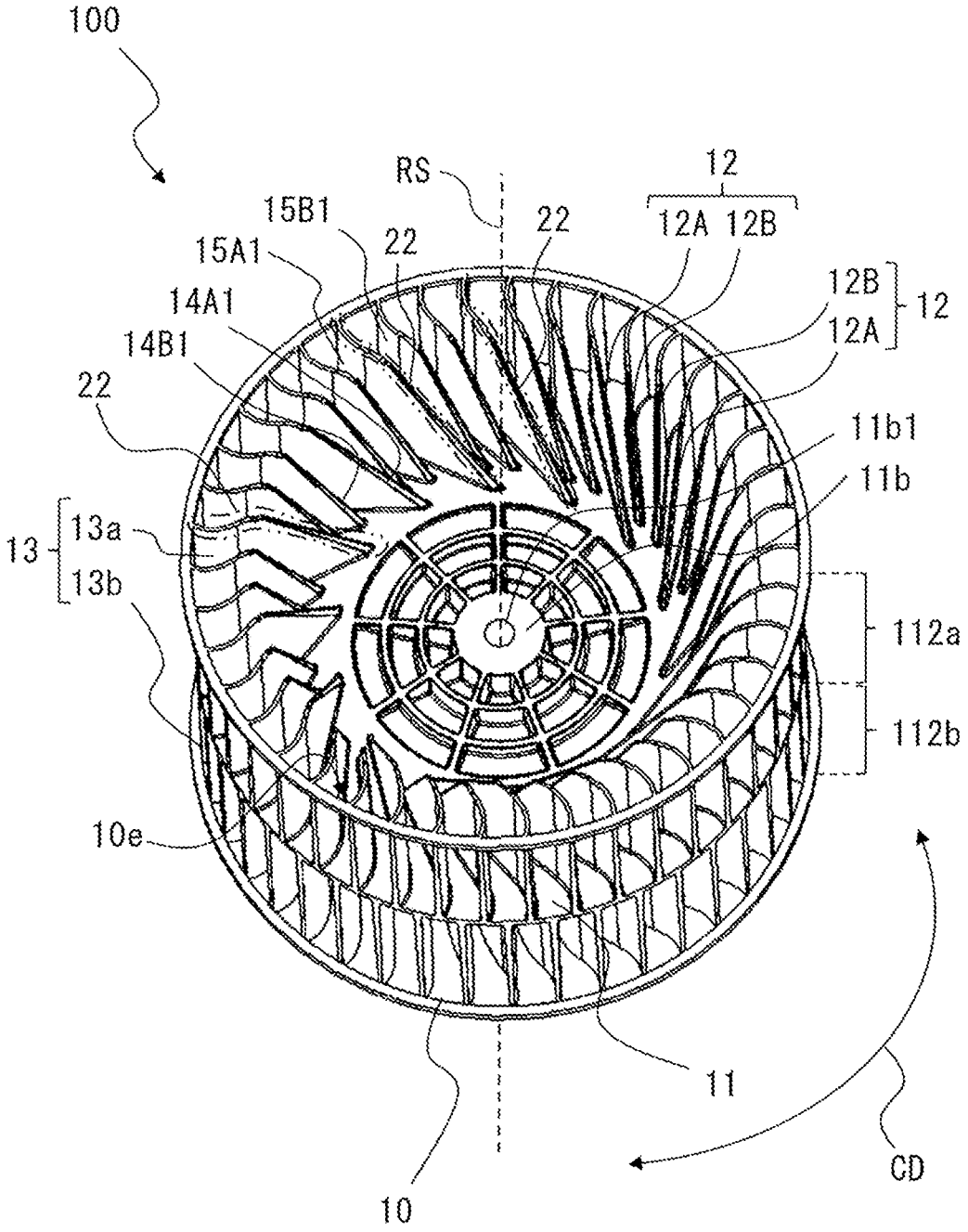
FIG. 4 is a perspective view of an impeller included in the centrifugal fan according to Embodiment 1.
Figure 5:
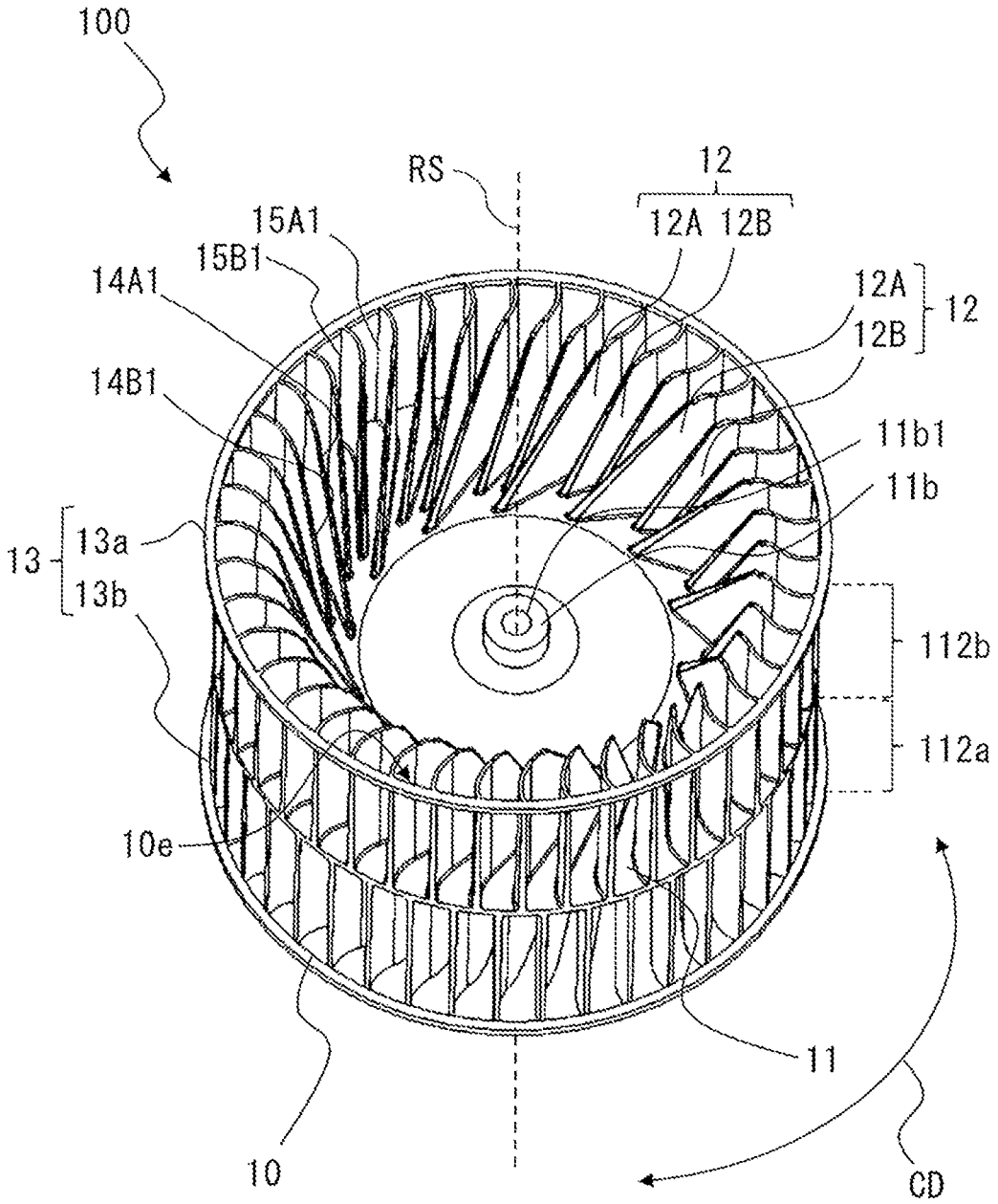
FIG. 5 is a perspective view of the impeller on the opposite side of the side as illustrated in FIG. 4.
Figure 6:
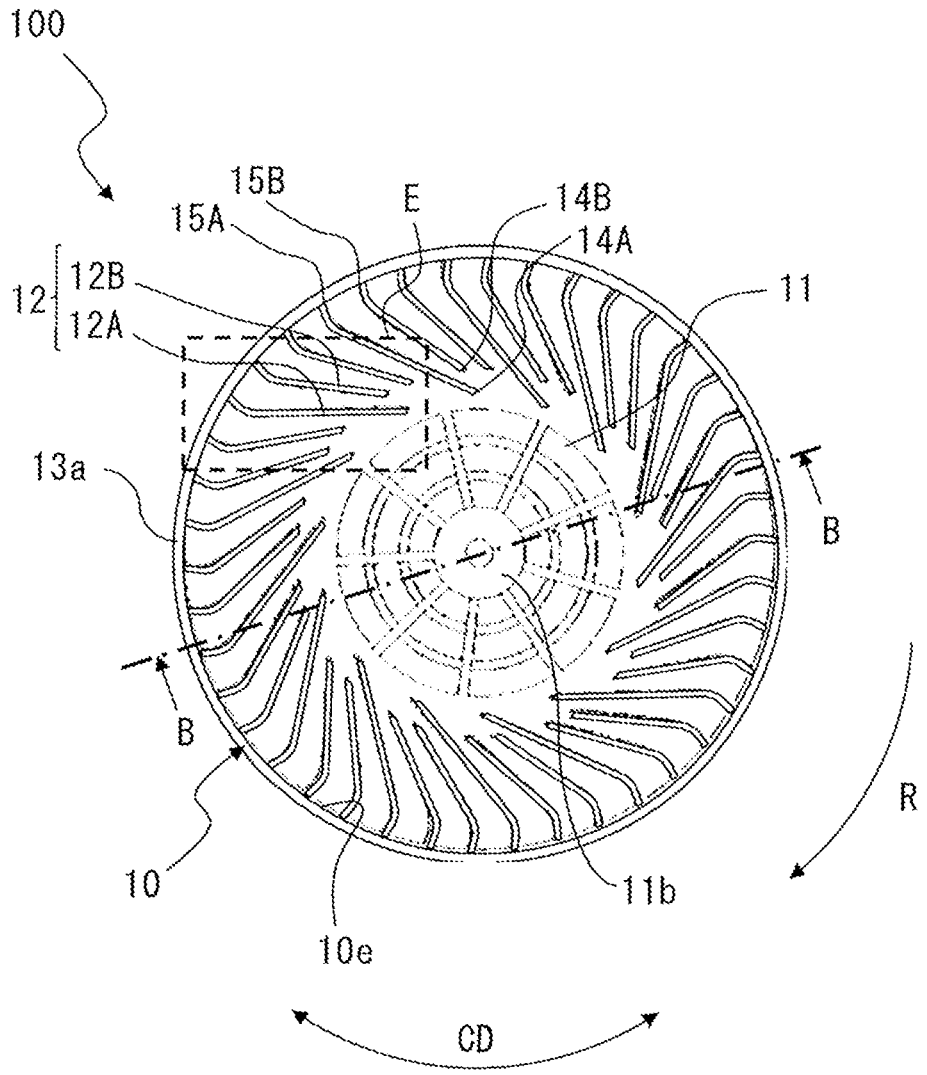
FIG. 6 is a plan view of the impeller at one surface of a main plate.
Figure 7:
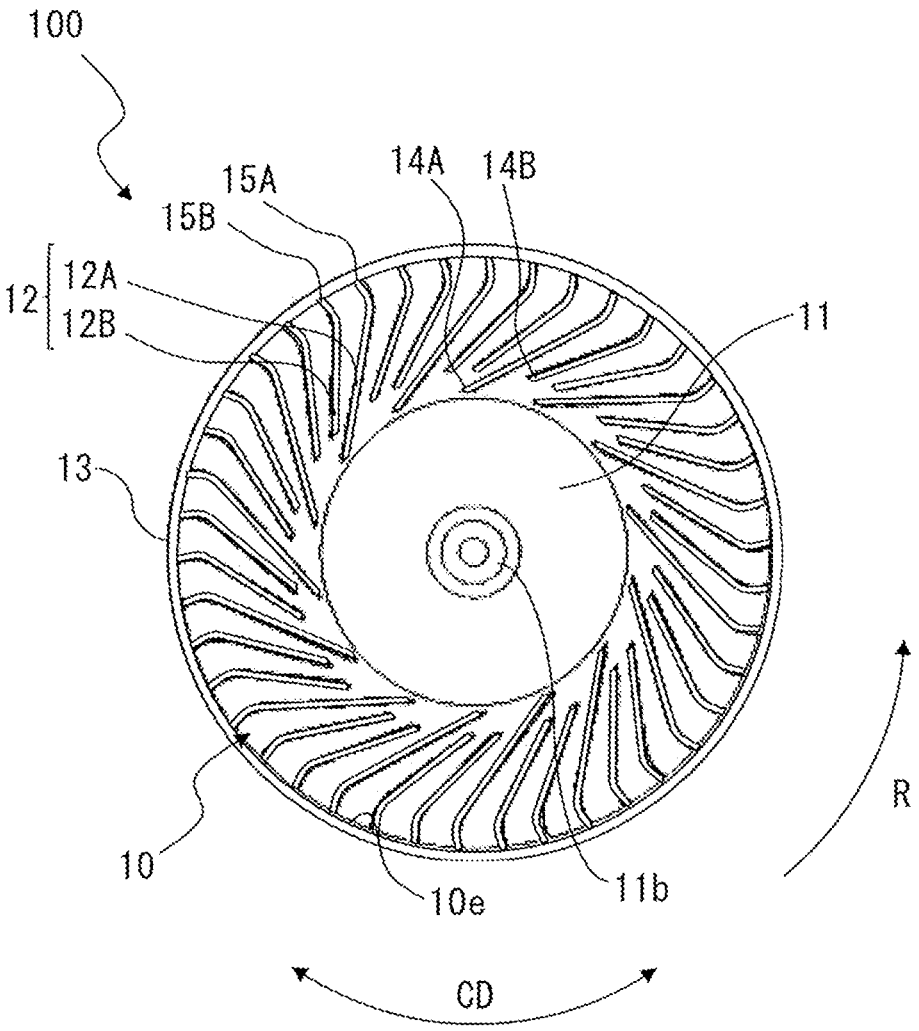
FIG. 7 is a plan view of the impeller at the other surface of the main plate.
Figure 8:
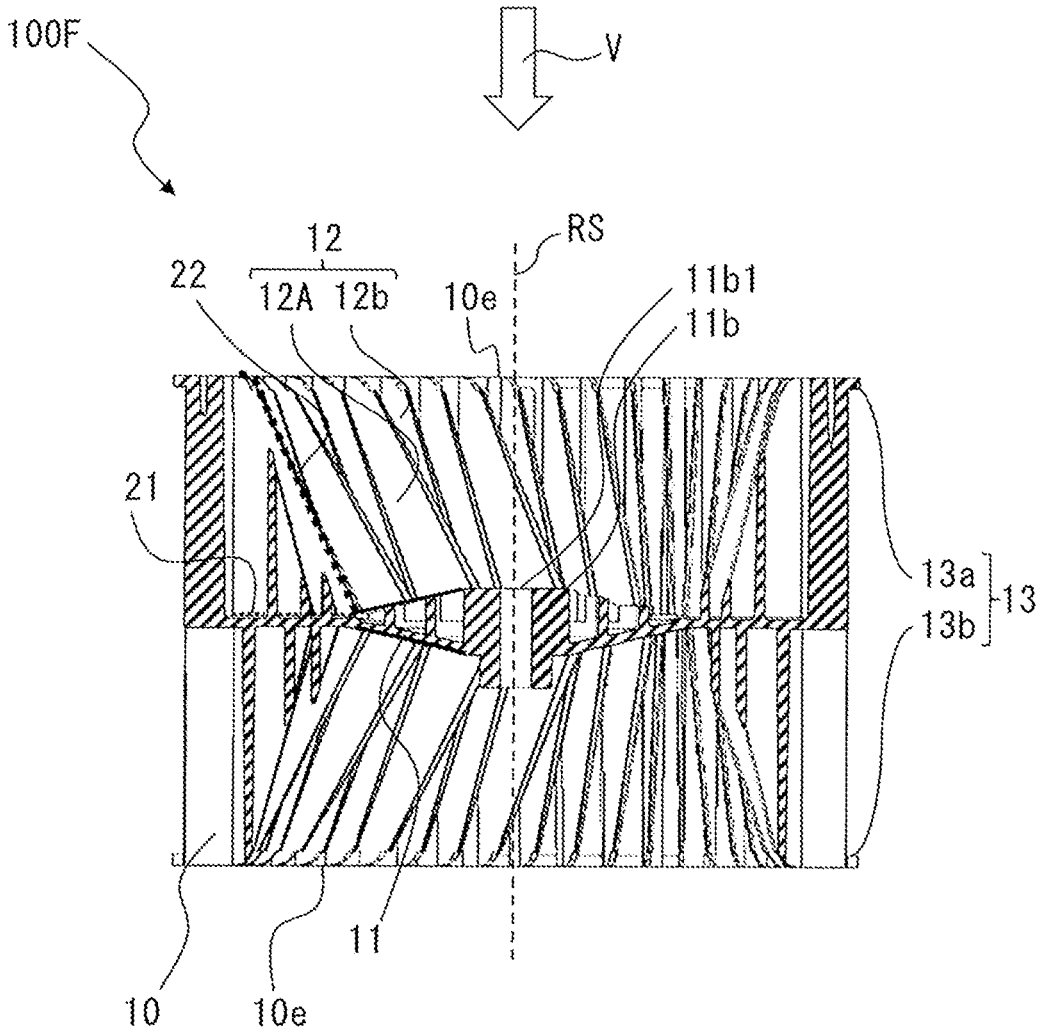
FIG. 8 is a sectional view of the impeller that is taken along line B-B in FIG. 6.

FIG. 4 is a perspective view of the impeller 10 included in the centrifugal fan 100 according to Embodiment 1. FIG. 5 is a perspective view of a side of the impeller 10 that is the opposite side of the side of the impeller 10 as illustrated in FIG. 4. FIG. 6 is a plan view of the impeller 10 at one surface of the main plate 11. FIG. 7 is a plan view of the impeller 10 at the other surface of the main plate 11. FIG. 8 is a sectional view of the impeller 10 that is taken along line B-B in FIG. 6. The impeller 10 will be described with reference to FIGS. 4 to 8.

The impeller 10 is a centrifugal fan. The impeller 10 is connected to a motor (not illustrated) having a drive shaft. The impeller 10 is driven by the motor to rotate, thereby causing air to be forcedly sent outward in the radial direction by a centrifugal force generated by rotation of the impeller 10. The impeller 10 is rotated in the rotation direction R, which is indicated by an arrow, by the motor, for example. As illustrated in FIG. 4, the impeller 10 includes the main plate 11, side plates 13, and the blades 12. The main plate 11 is formed in the shape of a disk, the side plates 13 are annularly shaped, and the blades 12 are radially arranged around the rotation axis RS in a circumferential region around the main plate 11.

(Main Plate 11)

The main plate 11 has only to be plate-like as its shape. For example, the main plate 11 may have any shape other than a disk shape, such as a polygonal shape. Regarding the thickness of the main plate 11, the main plate 11 may have a thickness that increases toward the center in the radial direction from the rotation axis RS, as illustrated in FIG. 3, or may have a constant thickness in the radial direction from the rotation axis RS. It is not indispensable that the main plate 11 is formed of a single plate-like member. The main plate 11 may include a plurality of flat portions joined together.

At the center of the main plate 11, the boss 11*b* to which the drive shaft of the motor is connected is provided. The boss 11*b* has a shaft hole 11*b*1 into which the drive shaft of the motor is inserted. The boss 11*b* is cylindrical; however, this is not limiting. Regarding the shape of the boss 11*b*, the boss 11*b* has only to be pillar-shaped. For example, the shape of the boss 11*b* may be a polygonal prism. The main plate 11 is driven to rotate by the motor via the boss 11*b*.

(Side Plate 13)

The impeller 10 includes the annular side plates 13 which are attached to ends of the blades 12 that are located opposite to the main plate 11 in the axial direction along the rotation axis RS of the boss 11*b*. The side plates 13 face the main plate 11 in the impeller 10. The side plates 13 each have the suction port 10*e* for air in the impeller 10. The side plate 13 couples the blades 12 together to maintain a positional relationship between distal ends of the blades 12 and reinforce the blades 12.

The side plates 13 include the first side plate 13*a*, which is annular and faces the main plate 11, and the second side plate 13*b*, which is annular, faces the main plate 11, and is located opposite to the first side plate 13*a* with respect to the main plate 11. The "side plate 13" is a generic term for the first side plate 13*a* and the second side plate 13*b*. The impeller 10 includes the first side plate 13*a* and the second side plate 13*b*, which are located on opposite sides with respect to the main plate 11 in the axial direction along the rotation axis RS.

(Blades 12)

As illustrated in FIG. 4, the blades 12 each have a first end connected to the main plate 11 and a second end connected to the side plate 13. The blades 12 are arranged in a circumferential direction CD around the rotation axis RS of the main plate 11. The blades 12 are located between the main plate 11 and the side plates 13. The blades 12 are arranged on both sides of the main plate 11, that is, on opposite sides of the main plate 11 in the axial direction along the rotation axis RS of the boss 11*b*. The blades 12 are spaced apart from each other at regular intervals at peripheral part of the main plate 11.

Figure 9:
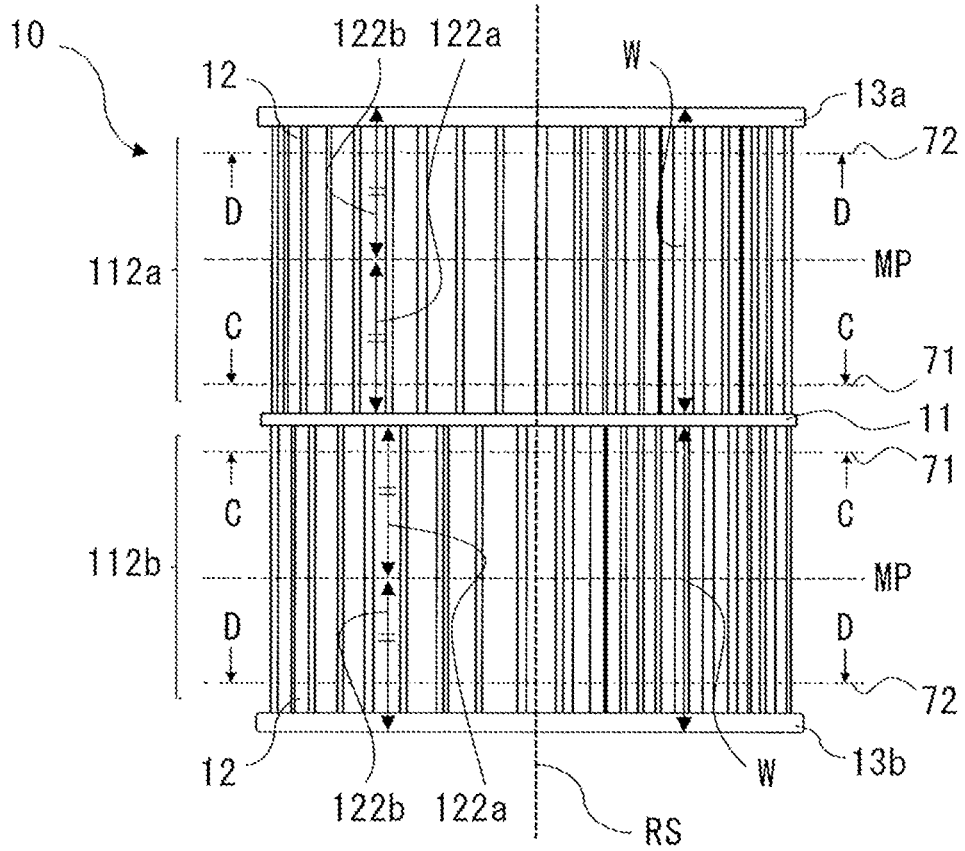
FIG. 9 is a side view of the impeller as illustrated FIG. 4.

FIG. 9 is a side view of the impeller 10 as illustrated in FIG. 4. The impeller 10 has a first blade portion 112*a* and a second blade portion 112*b*, as illustrated in FIGS. 4 and 9. The first blade portion 112*a* and the second blade portion 112*b* each include associated ones of the blades 12 and an associated one of the side plates 13. More specifically, the first blade portion 112*a* includes the first side plate 13*a* and blades 12 located between the main plate 11 and the first side plate 13*a*. The second blade portion 112*b* includes the second side plate 13*b* and blades 12 located between the main plate 11 and the second side plate 13*b*.

The first blade portion 112*a* is located at one of the surfaces of the main plate 11. The second blade portion 112*b* is located at the other surface of the main plate 11. That is, the blades 12 are provided on the opposite sides of the main plate 11 in the axial direction along the rotation axis RS. The first blade portion 112*a* and the second blade portion 112*b* are located opposite to each other with respect to the main plate 11. Referring to FIG. 3, the first blade portion 112*a* is located on the left side with respect to the main plate 11, and the second blade portion 112*b* is located on the right side with respect to the main plate 11. However, it suffices that the first blade portion 112*a* and the second blade portion 112*b* are provided opposite to each other with respect to the main plate 11. The first blade portion 112*a* may be located on the right side with respect to the main plate 11, and the second blade portion 112*b* may be located on the left side with respect to the main plate 11. In the following description, unless otherwise stated, the "blades 12" is used as a generic term for the blades 12 included in the first blade portion 112*a* and the blades 12 included in the second blade portion 112*b*.

The impeller 10 is formed into a cylindrical shape by the blades 12 provided on the main plate 11, as illustrated in FIGS. 4 and 5. The impeller 10 has the suction ports 10*e* that allow air to flow into spaces surrounded by the main plate 11 and the blades 12. In the impeller 10, on the both sides of the main plate 11, the blades 12 and the respective sides plates 13 are provided, and the respective suction ports 10*e* are provided is located.

The impeller 10 is driven to rotate around the rotation axis RS when the motor (not illustrated) is driven. When the impeller 10 is rotated, air outside the centrifugal fan 100 is sucked into the spaces surrounded by the main plate 11 and the blades 12 through the casing suction ports 45 of the scroll casing 40 as illustrated in FIG. 1 and the suction ports 10*e* of the impeller 10. Furthermore, when the impeller 10 is rotated, the air sucked into the spaces surrounded by the main plate 11 and the blades 12 passes through spaces between adjacent ones of the blades 12 and is sent outward from the impeller 10 in the radial direction.

(Detailed Configuration of Blades 12)

Figure 10:
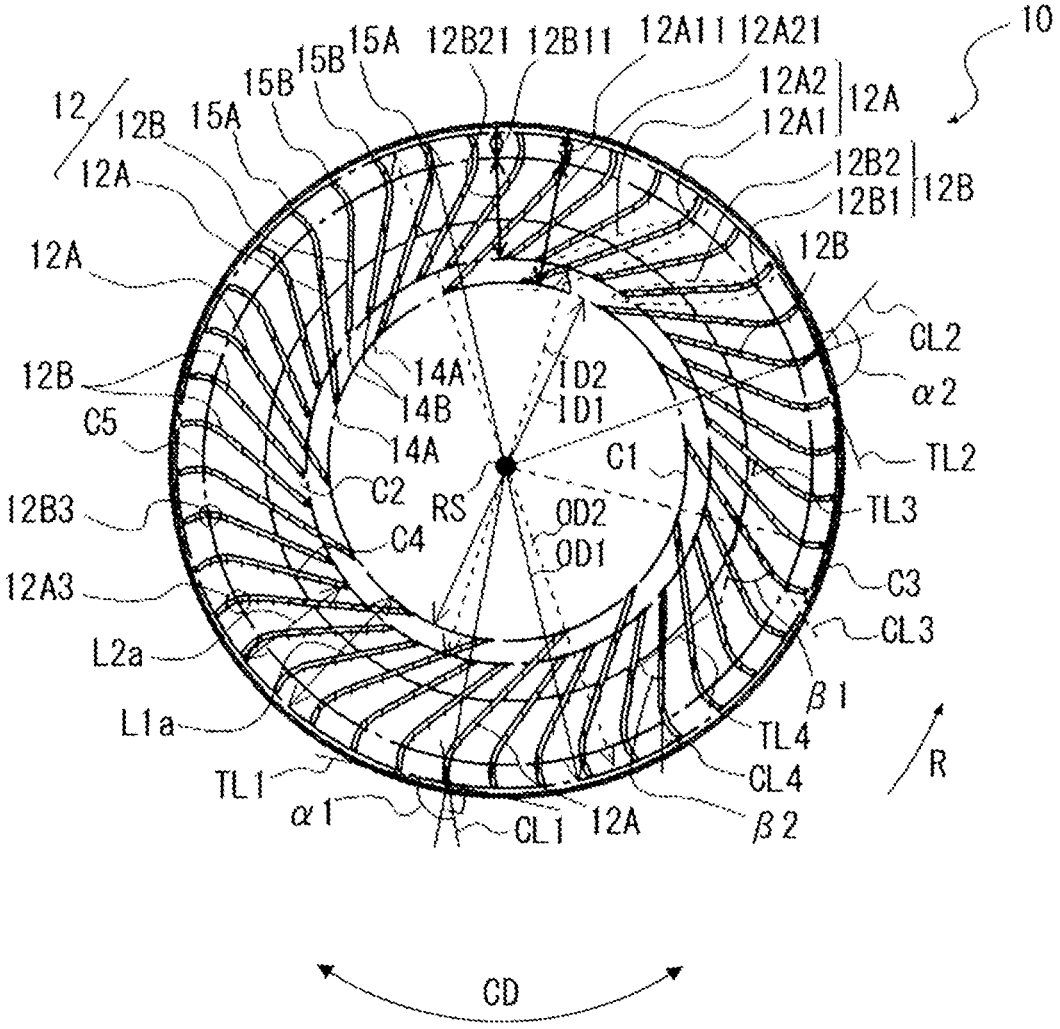
FIG. 10 is a schematic diagram illustrating blades at a section of the impeller that is taken along line C-C in FIG. 9.
Figure 11:
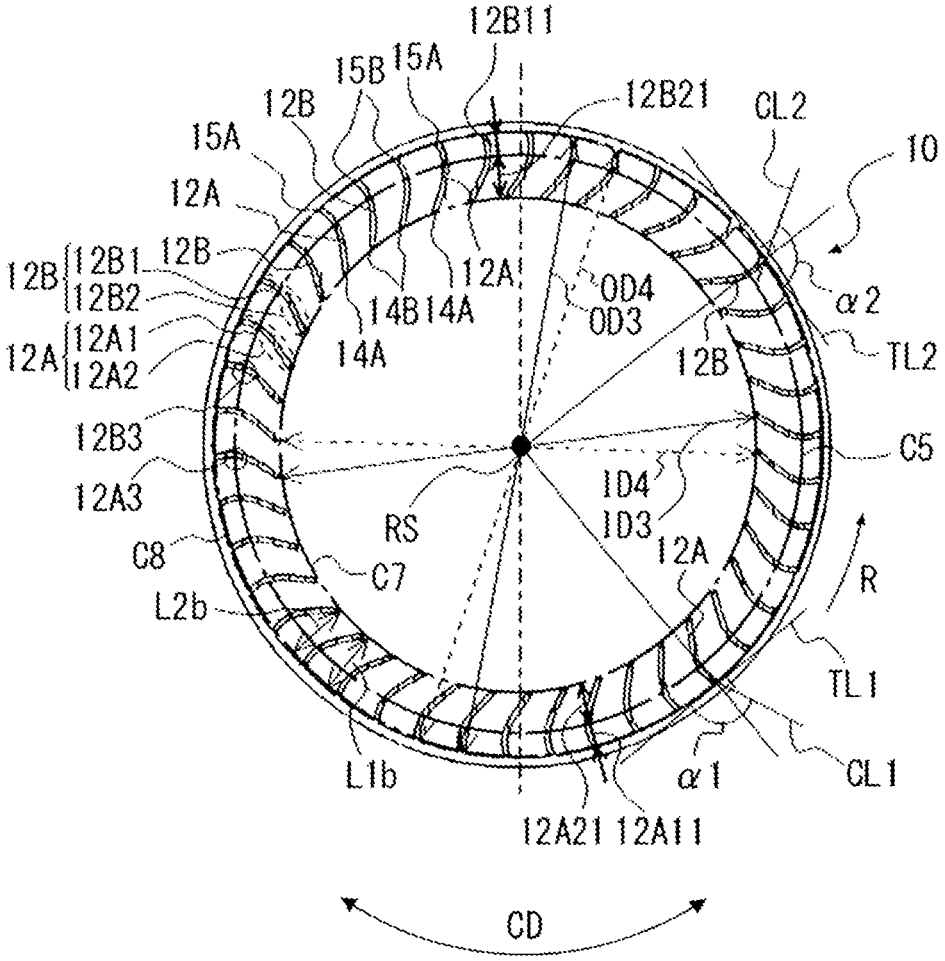
FIG. 11 is a schematic diagram illustrating the blades at a section of the impeller that is taken along each line D-D in FIG. 9.

FIG. 10 is a schematic diagram illustrating the blades 12 at a section of the impeller 10 that is taken along line C-C in FIG. 9. FIG. 11 is a schematic diagram illustrating the blades 12 at a section of the impeller 10 that is taken along line D-D in FIG. 9. One of middle lines MP in the impeller 10 as illustrated in FIG. 9 indicates the positions of intermediate positions of the blades 12 included in the first blade portion 112*a* in the axial direction along the rotation axis RS, and the other middle line MP in the impeller 10 as illustrated in FIG. 9 indicate the positions of intermediate positions of the blades 12 included in the second blade portion 112*b* in the axial direction along the rotation axis RS.

Each of the blades 12 included in the first blade portion 112*a* has a first region of the impeller 10 which is a region extending from the middle line MP to the main plate 11 in the axial direction along the rotation axis RS, and which will be referred to as a main-plate-side blade region 122*a*. Furthermore, each of the blades 12 included in the first blade portion 112*a* has a second region of the impeller 10 which is a region extending from the middle line MP to the end of the blade 12 at the side plate 13 in the axial direction along the rotation axis RS, and which will be referred to as a side-plate-side blade region 122*b*. In other words, each of the blades 12 has the first region which is located closer to the main plate 11 than the middle line MP in the axial direction along the rotation axis RS and the second region which is located closer to the side plate 13 than the first region.

As illustrated in FIG. 10, the section of the impeller 10 that is taken along line C-C in FIG. 9 includes sections of the blades 12 that are closer to the main plate 11 of the impeller 10, or that are located in the main-plate-side blade region 122*a* corresponding to the first region. The sections of the blades 12 which are closer to the main plate 11 are located at a first plane 71 perpendicular to the rotation axis RS, and which corresponds to the section of part of the impeller 10 that is located adjacent to the main plate 11. The "part of the impeller 10 that is located adjacent to the main plate 11" means, for example, part located closer to the main plate 11 than an intermediate region of the main-plate-side blade region 122*a* in the axial direction along the rotation axis RS or part at which ends of the blades 12 that are adjacent to the main plate 11 in the axial direction along the rotation axis RS are located.

As illustrated in FIG. 11, the section of the impeller 10 that is taken along line D-D in FIG. 9 includes sections of the blades 12 that are closer to the side plate 13 of the impeller 10, or that are located in the side-plate-side blade region 122*b* corresponding to the second region. The sections of the blades 12 which are closer to the side plate 13 are located at a second plane 72 perpendicular to the rotation axis RS, and are included in a second section of the impeller 10 that corresponds to the section of part of the impeller 10 that is located adjacent to the side plate 13. The "part of the impeller 10 that is located adjacent to the side plate 13" means, for example, part located closer to the side plate 13 than an intermediate region of the side-plate-side blade region 122*b* in the axial direction along the rotation axis RS or part at which the ends of the blades 12 at the side plate 13 in the axial direction along the rotation axis RS are located.

The blades 12 in the second blade portion 112*b* have the same basic configuration as that of the blades 12 in the first blade portion 112*a*. Specifically, each of the blades 12 included in the second blade portion 112*b* has the main-plate-side blade region 122*a* which corresponds to the first region of the impeller 10, and also corresponds to a region extending from the middle line MP to the main plate 11 in the axial direction along the rotation axis RS. In addition, each of the blades 12 included in the second blade portion 112*b* has the side-plate-side blade region 122*b* which corresponds to the second region of the impeller 10, and also corresponds to a region extending from the middle line MP to the end of the blade 12 at the second side plate 13*b* in the axial direction along the rotation axis RS.

Although the basic configuration of the first blade portion 112*a* is the same as that of the second blade portion 112*b* as described above, the configuration of the impeller 10 is not limited to that of the above example. The first blade portion 112*a* and the second blade portion 112*b* may have different configurations. Both or one of the first blade portion 112*a* and the second blade portion 112*b* may have the following configuration of the blades 12.

As illustrated in FIGS. 9 to 11, the blades 12 includes first blades 12A and second blades 12B. The first blades 12A and the second blades 12A of the blades 12 are alternately arranged in the circumferential direction CD of the impeller 10 such that one first blade 12A is located between any adjacent second blades 12B and one or more second blades 12B are located between any adjacent blades 12A.

As illustrated in FIGS. 9 to 11, in the impeller 10, the first blades 12A and the second blades 12B are arranged such that two second blades 12B are interposed between any adjacent two first blades 12A in the rotation direction R. The number of second blades 12B interposed between any two adjacent first blades 12A in the rotation direction R is not limited to two, and may be one, or three or more. That is, at least one of the second blades 12B is interposed between any adjacent two of the first blades 12A in the circumferential direction CD.

As illustrated in FIG. 10, the first blades 12A each have an inner peripheral end 14A and an outer peripheral end 15A in the first section of the impeller 10 that is taken along the first plane 71 perpendicular to the rotation axis RS. The inner peripheral end 14A is located closer to the rotation axis RS in the radial direction from the rotation axis RS than the outer peripheral end 15A. The outer peripheral end 15A is located closer to an outer circumferential side of the impeller in the radial direction than the inner peripheral end 14A. In each of the first blades 12A, the inner peripheral end 14A is located forward of the outer peripheral end 15A in the rotation direction R of the impeller 10.

Referring to FIG. 4, the inner peripheral end 14A is formed as a leading edge 14A1 of the first blade 12A, and the outer peripheral end 15A is formed as a trailing edge 15A1 of the first blade 12A. As illustrated in FIG. 11, 14 first blades 12A are provided in the impeller 10. However, the number of first blades 12A is not limited to 14, and may be smaller than or larger than 14.

As illustrated in FIG. 10, the second blades 12B each have an inner peripheral end 14B and an outer peripheral end 15B in the first section of the impeller 10 that is taken at the first plane 71 perpendicular to the rotation axis RS. The inner peripheral end 14B is located closer to the rotation axis RS in the radial direction from the rotation axis RS, and the outer peripheral end 15B is located closer to the outer circumferential side than the inner peripheral end 14B in the radial direction. In each of the second blades 12B, the inner peripheral end 14B is located forward of the outer peripheral end 15B in the rotation direction R of the impeller 10.

Referring to FIG. 4, the inner peripheral end 14B is formed as a leading edge 14B1 of the second blade 12B, and the outer peripheral end 15B is formed as a trailing edge 15B1 of the second blade 12B. As illustrated in FIG. 10, 28 second blades 12B are arranged in the impeller 10. However, the number of second blades 12B is not limited to 28, and may be smaller than or larger than 28.

The relationship between the first blades 12A and the second blades 12B will be described. As illustrated in FIGS. 4 and 11, each of the first blades 12A and each of the second blades 12B are formed such that in regions from the middle line MP to the first plate 13*a* and the second plate 13*b* in the direction along the rotation axis RS, the closer part of the first blade 12A and part of the second blade 12B to the first plate 13*a* and the second plate 13*b*, respectively, the smaller the difference between the blade length of the above part of the first blade 12A and the blade length of the above part of the second blade 12B, and then the blade length of the part of the first blade 12A and the blade length of the part of the second blade 12B become equal to each other.

As illustrated in FIGS. 4 and 10, the blade length of part of the first blade 12A that is closer to the main plate 11 than the middle line MP in the direction along the rotation axis RS is longer than that of part of the second blade 12B that is closer to the main plate 11 than the middle line MP in the direction along the rotation axis RS, and the closer the part of the first blade 12A to the main plate 11, the longer the blade length of the part of the first blade 12A. As described above, the blade length of at least part of the first blade 12A in the direction along the rotation axis RS in Embodiment 1 is longer than the blade length of corresponding part of the second blade 12B. The "blade length" means the length of the first blade 12A in the radial direction of the impeller 10 and that of the second blade 12B in the radial direction of the impeller 10.

In the first section which is located closer to the main plate 11 than the middle line MP indicated in FIG. 9, as illustrated in FIG. 10, an inside diameter ID1 is the diameter of a circle C1 that passes through the inner peripheral ends 14A of the first blades 12A and that is a curve everywhere equidistant from the rotation axis RS. This inside diameter will be referred to as the inside diameter of the inner peripheral ends 14A of the first blades 12A. An outside diameter OD1 is the diameter of a circle C3 that passes through the outer peripheral ends 15A of the first blades 12A and that is a curve everywhere equidistant from the rotation axis RS. This outside diameter will be referred to as the outside diameter of the outer peripheral ends 15A of the first blades 12A. A half of the difference between the outside diameter OD1 and the inside diameter ID1 is a blade length L1*a* of the first blade 12A at the first section (blade length L1*a*=[outside diameter OD1−inside diameter ID1]/2).

The ratio of the inside diameter of the first blades 12A to the outside diameter of the first blades 12A is 0.7 or less. That is, the first blades 12A are arranged such that the ratio of the inside diameter ID1 of the inner peripheral ends 14A of the first blades 12A as defined above to the outside diameter OD1 of the outer peripheral ends 15A of the first blades 12A as defined above is 0.7 or less.

It should be noted that in a common centrifugal fan, the blade length of each of blades at a section perpendicular to the rotation axis is smaller than the width of the blade in the direction along the rotation axis. In Embodiment 1, a maximum blade length of each first blade 12A, or the blade length of the end of the first blade 12A at the main plate 11, is smaller than a width W (see FIG. 9) of the first blade 12A in the direction along the rotation axis.

In the first section, an inside diameter ID2 is the diameter of a circle C2 that passes through the inner peripheral ends 14B of the second blades 12B and that is a curve everywhere equidistant from the rotation axis RS. This inside diameter will be referred to as the inside diameter of the inner peripheral ends 14B of the second blades 12B. The inside diameter ID2 is larger than the inside diameter ID1 (inside diameter ID2>inside diameter ID1). An outside diameter OD2 is the diameter of a circle C3 that passes through the outer peripheral ends 15B of the second blades 12B and that is a curve everywhere equidistant from the rotation axis RS. This outside diameter will be referred to as the outside diameter of the outer peripheral ends 15B of the second blades 12B. The outside diameter OD2 is equal to the outside diameter OD1 (outside diameter OD2=outside diameter OD1). A half of the difference between the outside diameter OD2 and the inside diameter ID2 is equal to a blade length L2*a* of the second blade 12B at the first section (blade length L2*a*=[outside diameter OD2−inside diameter ID2]/2). The blade length L2*a* of the second blade 12B at the first section is smaller than the blade length Lia of the first blade 12A at the first section (blade length L2*a*<blade length Lia).

The ratio of the inside diameter of the second blades 12B to the outside diameter of the second blades 12B is 0.7 or less. That is, the second blades 12B are arranged such that the ratio of the inside diameter ID2 of the inner peripheral ends 14B of the second blades 12B as defined above to the outside diameter OD2 of the outer peripheral ends 15B of the second blades 12B as defined above is 0.7 or less.

In the second section that is closer to the side plate 13 than the middle line MP indicated in FIG. 9, as illustrated in FIG. 11, an inside diameter ID3 is the diameter of a circle C7 that passes through the inner peripheral ends 14A of the first blades 12A and that is a curve everywhere equidistant from the rotation axis RS. This inside diameter will be referred to as the inside diameter of the inner peripheral ends 14A of the first blades 12A. The inside diameter ID3 is larger than the inside diameter ID1 at the first section (inside diameter ID3>inside diameter ID1). An outside diameter OD3 is the diameter of a circle C8 through the outer peripheral ends 15A of the first blades 12A and that is a curve everywhere equidistant from the rotation axis RS. A half of the difference between the outside diameter OD3 and the inside diameter ID1 is equal to a blade length L1*b* of each first blade 12A at the second section (blade length L1*b*=(outside diameter OD3−inside diameter ID3)/2).

In the second section, an inside diameter ID4 is the diameter of a circle C7 that passes through the inner peripheral ends 14B of the second blades 12B and that is a curve everywhere equidistant from the rotation axis RS. This inside diameter will be referred to as the inner peripheral ends 14B of the second blades 12B. The inside diameter ID4 is equal to the inside diameter ID3 at the second section (inside diameter ID4=inside diameter ID3). An outside diameter OD4 is the diameter of a circle C8 that passes through the outer peripheral ends 15B of the second blades 12B and that is a curve everywhere equidistant from the rotation axis RS. This outside diameter will be referred to as the outside diameter of the outer peripheral ends 15B of the second blades 12B. The outside diameter OD4 is equal to the outside diameter OD3 at the second section (outside diameter OD4=outside diameter OD3). A half of the difference between the outside diameter OD4 and the inside diameter ID4 is equal to a blade length L2*b* of each second blade 12B at the second section (blade length L2*b*=(outside diameter OD4−inside diameter ID4)/2). The blade length L2*b* of the second blade 12B at the second section is equal to the blade length L1*b* of the first blade 12A at the second section (blade length L2*b*=blade length L1*b*).

As viewed in a direction parallel to the rotation axis RS, the first blades 12A at the second section as illustrated in FIG. 11 are coincident with the first blades 12A at the first section as illustrated in FIG. 10 such that the first blades 12A at the second section do not project from the outlines of the first blades 12A at the first section. Therefore, the impeller 10 satisfies the following relationships: the outside diameter OD3=the outside diameter OD1; the inside diameter ID3≥the inside diameter ID1: and the blade length L1*b*≤the blade length L1*a*.

Similarly, as viewed in the direction parallel to the rotation axis RS, the second blades 12B at the second section illustrated in FIG. 11 are coincident with the second blades 12B at the first section illustrated in FIG. 10 such that the second blades 12B at the second section do not project from the outlines of the second blades 12B at the first section. Therefore, the impeller 10 satisfies the following relationships: the outside diameter OD4=the outside diameter OD2: the inside diameter ID4 the inside diameter ID2; and the blade length L2*b* s the blade length L2*a*.

As described above, the ratio of the inside diameter ID1 of the first blades 12A to the outside diameter OD1 of the first blades 12A is 0.7 or less. Since the blades 12 are formed such that the inside diameter ID3≥the inside diameter ID1, the inside diameter ID4≥the inside diameter ID2, and the inside diameter ID2>the inside diameter ID1, the inside diameter of the first blades 12A can be regarded as a blade inside diameter of the blades 12. In addition, since the blades 12 are formed such that the outside diameter OD3=the outside diameter OD1, the outside diameter OD4=the outside diameter OD2, and the outside diameter OD2=the outside diameter OD1, the outside diameter of the first blades 12A can be regarded as a blade outside diameter of the blades 12. As the blades 12 included in the impeller 10 are viewed as a whole, the ratio of the blade inside diameter of the blades 12 to the blade outside diameter of the blades 12 is 0.7 or less.

The blade inside diameter of the blades 12 is the dimeter of a circle that passes through the inner peripheral ends of the blades 12. That is, the blade inside diameter of the blades 12 is the diameter of a circle that passes through the leading edges 14A1 of the blades 12. Furthermore, the blade outside diameter of the blades 12 is the diameter of a circle that passes through the outer peripheral ends of the blades 12. That is, the blade outside diameter of the blades 12 is the diameter of a circle that passes through the trailing edges 15A1 and the trailing edges 15B1 of the blades 12.

(Configurations of First Blades 12A and Second Blades 12B)

In comparison between the first section as illustrated in FIG. 10 and the second section as illustrated in FIG. 11, the blade length L1*a* and the blade length L1*b* of each first blade 12A satisfy the relationship "L1*a*>L1*b*". That is, each of the blades 12 is formed such that the blade length in the first region is longer than that in the second region. More specifically, the first blade 12A has a blade length that decreases from the main plate 11 toward the side plate 13 in the axial direction along the rotation axis RS.

Similarly, in the comparison between the first section as illustrated in FIG. 10 and the second section as illustrated in FIG. 11, the blade length L2*a* and the blade length L2*b* of each second blade 12B satisfy the relationship "L2*a*>L2*b*". That is, the second blade 12B has a blade length that decreases from the main plate 11 toward the side plate 13 in the direction along the rotation axis RS.

As illustrated in FIG. 3, the leading edges of each of the first blades 12A and each of the second blades 12B are each inclined such that the blade inside diameter increases from the main plate 11 toward the side plate 13. That is, the blades 12 have inclined portions 141A which are formed such that the blade inside diameter increases from the main plate 11 toward the side plate 13 and in which the inner peripheral ends 14A serving as the leading edges 14A1 are inclined away from the rotation axis RS. Similarly, the blades 12 have inclined portions 141B which are formed such that the blade inside diameter increases from the main plate 11 toward the side plate 13 and in which the inner peripheral ends 14B serving as the leading edges 14B1 are inclined away from the rotation axis RS.

(Sirocco Blade Portion and Turbo Blade Portion)

As illustrated in FIGS. 10 and 11, the first blades 12A each has a first sirocco blade portion 12A1 and a first turbo blade portion 12A2. The first sirocco blade portion 12A1 has the outer peripheral end 15A and forms a forward-swept blade, and a first turbo blade portion 12A2 has the inner peripheral end 14A and forms a swept-back blade. In the radial direction of the impeller 10, the first sirocco blade portion 12A1 form an outer circumferential portion of the first blade 12A, and the first turbo blade portion 12A2 forms an inner circumferential portion of the first blade 12A. That is, in the first blade 12A, the first turbo blade portion 12A2 and the first sirocco blade portion 12A1 are arranged in this order in a direction from the rotation axis RS toward the outer circumferential side in the radial direction of the impeller 10.

In the first blade 12A, the first turbo blade portion 12A2 and the first sirocco blade portion 12A1 are integrally formed. The first turbo blade portion 12A2 forms the leading edge 14A1 of the first blade 12A, and the first sirocco blade portion 12A1 forms the trailing edge 15A1 of the first blade 12A. The first turbo blade portion 12A2 linearly extends from the inner peripheral end 14A, which forms the leading edge 14A1, toward the outer circumferential side in the radial direction of the impeller 10.

In the radial direction of the impeller 10, a region that forms the first sirocco blade portion 12A1 of the first blade 12A will be referred to as a first sirocco region 12A11, and a region that forms the first turbo blade portion 12A2 of the first blade 12A will be referred to as a first turbo region 12A21. In the first blade 12A, the first turbo region 12A21 is larger than the first sirocco region 12A11 in the radial direction of the impeller 10.

In both the main-plate-side blade region 122*a* corresponding to the first region and the side-plate-side blade region 122*b* corresponding to the second region as illustrated in FIG. 9, the first sirocco region 12A11 and the first turbo region 12A21 in the impeller 10 satisfies the relationship "12A11<12A21" in the radial direction of the impeller 10. Also, in the impeller 10 and each of the first blades 12A, in both the main-plate-side blade region 122*a* and the side-plate-side blade region 122*b*, the proportion of the first turbo blade portion 12A2 to the first blade 12A is higher than the proportion of the first sirocco blade portion 12A1 to the first blade 12A, in the radial direction of the impeller 10.

Similarly, as illustrated in FIGS. 10 and 11, the second blades 12B each have a second sirocco blade portion 12B1 and a second turbo blade portion 12B2. The second sirocco blade portion 12B1 has the outer peripheral end 15B and forms a forward-swept blade. The second turbo blade portion 12B2 has the inner peripheral end 14B and forms a swept-back blade. In the radial direction of the impeller 10, the second sirocco blade portion 12B1 forms an outer circumferential portion of the second blade 12B, and the second turbo blade portion 12B2 forms an inner circumferential portion of the second blade 12B. That is, in the second blade 12B, the second turbo blade portion 12B2 and the second sirocco blade portion 12B1 are arranged in this order in the direction from the rotation axis RS toward the outer circumferential side in the radial direction of the impeller 10.

In the second blade 12B, the second turbo blade portion 12B2 and the second sirocco blade portion 12B1 are integrally formed. The second turbo blade portion 12B2 forms the leading edge 14B1 of the second blade 12B, and the second sirocco blade portion 12B1 forms the trailing edge 15B1 of the second blade 12B. The second turbo blade portion 12B2 linearly extends from the inner peripheral end 14B, which forms the leading edge 14B1, toward the outer circumferential side in the radial direction of the impeller 10.

In the radial direction of the impeller 10, a region that forms the second sirocco blade portion 12B1 of the second blade 12B will be referred to as a second sirocco region 12B11, and a region which forms the second turbo blade portion 12B2 of the second blade 12B will be referred to as a second turbo region 12B21. In the second blade 12B, the second turbo region 12B21 is larger than the second sirocco region 12B11 in the radial direction of the impeller 10.

In both the main-plate-side blade region 122*a* corresponding to the first region and the side-plate-side blade region 122*b* corresponding to the second region as illustrated in FIG. 9, the second sirocco region 12B11 and the second turbo region 12B21 in the impeller 10 satisfy the relationship "12B11<12B21" in the radial direction of the impeller 10. Also, in both the main-plate-side blade region 122*a* and the side-plate-side blade region 122*b*, in the second blade 12B in the impeller 10, the proportion of the second turbo blade portion 12B2 to the second blade 12B in the radial direction of the impeller 10 is higher than that of the second sirocco blade portion 12B1 to the second blade 12B in the radial direction of the impeller 10.

In the above configuration, in the blades 12, in both the main-plate-side blade regions 122*a* and the side-plate-side blade regions 122*b*, the total area of the turbo blade portions is larger than that of the sirocco blade portions in the radial direction of the impeller 10. That is, in the blades 12, in both the main-plate-side blade regions 122*a* and the side-plate-side blade regions 122*b*, the proportion of the turbo blade portions to the blades 12 in the radial direction of the impeller 10 is higher than that of the sirocco blade portions to the blades 1 in the radial direction of the impeller 10, and the sirocco region<the turbo region is satisfied. In other words, in each of the blades 12, in the first region and the second region, the proportion of the turbo blade portion to the blade 12 is higher than that of the sirocco blade portion in the radial direction.

The blades 12 are not limited to blades 12 in each of which in the main-plate-side blade region 122*a* and the side-plate-side blade region 122*b*, in the radial direction of the impeller 10, the proportion of the turbo blade portion to the blade 12 is higher than that of the sirocco blade portion to the blade 12, and the sirocco region<the turbo region is satisfied. Each of the blades 12 may be formed such that in the first region and the second region, the proportion of the turbo blade portion to the blade 12 in the radial direction is less than or equal to that of the sirocco blade portion to the blade 12 in the radial direction.

(Outlet Angles)

As illustrated in FIG. 10, the first sirocco blade portion 12A1 of each first blade 12A has an outlet angle $\alpha$1 at the first section. The outlet angle $\alpha$1 is defined as an angle formed between a center line CL1 of the first sirocco blade portion 12A1 at the outer peripheral end 15A and a tangent TL to the circle C3 that is a curve everywhere equidistant from the rotation axis RS, at a point of intersection of an arc of the circle C3 and the outer peripheral end 15A. The outlet angle $\alpha$1 is greater than 90 degrees.

The second sirocco blade portion 12B1 of each second blade 12B has an outlet angle $\alpha$2 at the first section. The outlet angle $\alpha$2 is defined as an angle formed between a center line CL2 of the second sirocco blade portion 12B1 at the outer peripheral end 15B and a tangent TL2 to the circle C3 that is a curve everywhere equidistant from the rotation axis RS, at a point of intersection of an arc of the circle C3 and the outer peripheral end 15B. The outlet angle $\alpha$2 is greater than 90 degrees.

The outlet angle $\alpha$2 of the second sirocco blade portion 12B1 is equal to the outlet angle $\alpha$1 of the first sirocco blade portion 12A1 (outlet angle $\alpha$2=outlet angle $\alpha$1). As viewed in the direction parallel to the rotation axis RS, the first sirocco blade portion 12A1 and the second sirocco blade portion 12B1 are arcuate and convex in the opposite direction to the rotation direction R.

As illustrated in FIG. 11, at the second section of the impeller 10, the outlet angle $\alpha$1 of the first sirocco blade portion 12A1 is also equal to the outlet angle $\alpha$2 of the second sirocco blade portion 12B1. That is, the blades 12 each have the sirocco blade portion which extends from the main plate 11 to the side plate 13, which has an outlet angle greater than 90 degrees, and which forms a forward-swept blade.

Furthermore, as illustrated in FIG. 10, the first turbo blade portion 12A2 of each first blade 12A has an outlet angle $\beta$1 at the first section. The outlet angle $\beta$1 is defined as an angle formed between a center line CL3 of the first turbo blade portion 12A2 and a tangent TL3 to a circle C4 that is a curve everywhere equidistant from the rotation axis RS, at a point of intersection of an arc of the circle C4 and the first turbo blade portion 12A2. The outlet angle $\beta$1 is less than 90 degrees.

The second turbo blade portion 12B2 of each second blade 12B has as an outlet angle $\beta$2 at the first section. The outlet angle $\beta$2 is defined as an angle formed between a center line CL4 of the second turbo blade portion 12B2 and a tangent TL4 to the circle C4 that is a circle everywhere equidistant from the rotation axis RS, at a point of intersection of the arc of the circle C4 and the second turbo blade portion 12B2. The outlet angle β2 is less than 90 degrees.

The outlet angle β2 of the second turbo blade portion 12B2 is equal to the outlet angle β1 of the first turbo blade portion 12A2 (outlet angle β2=outlet angle β1).

Although it is not illustrated in FIG. 11, at the second section of the impeller 10, the outlet angle β1 of the first turbo blade portion 12A2 is equal to the outlet angle β2 of the second turbo blade portion 12B2. The outlet angle β1 and the outlet angle β2 are less than 90 degrees.

(Radial Blade Portion)

As illustrated in FIGS. 10 and 11, each first blade 12A has a first radial blade portion 12A3, which is a connection between the first turbo blade portion 12A2 and the first sirocco blade portion 12A1. The first radial blade portion 12A3 forms a radial blade that extends linearly in the radial direction of the impeller 10.

Similarly, each second blade 12B has a second radial blade portion 12B3, which is a connection between the second turbo blade portion 12B2 and the second sirocco blade portion 12B1. The second radial blade portion 12B3 forms a radial blade that extends linearly in the radial direction of the impeller 10.

The first radial blade portion 12A3 and the second radial blade portion 12B3 have a blade angle of 90 degrees. More specifically, an angle between a center line of the first radial blade portion 12A3 and a tangent to a circle C5 everywhere equidistant from the rotation axis RS at a point of intersection of the circle C5 and the center line of the first radial blade portion 12A3 is an angle of 90 degrees, and an angle between a center line of the second radial blade portion 12B3 and the tangent to the circle C5 at a point of intersection of the circle C5 and the center line of the second radial blade portion 12B3 is an angle of 90 degrees.

(Inter-Blade Distance)

The distance between any adjacent two of the blades 12 in the circumferential direction CD will be referred to as an inter-blade distance. As illustrated in FIGS. 10 and 11, the inter-blade distance between the blades 12 gradually increases from the leading edges 14A1 toward the trailing edges 15A1. Similarly, the inter-blade distance between the blades 12 gradually increases from the leading edges 14B1 toward the trailing edges 15B1.

Specifically, the inter-blade distance at the turbo blade portions including the first turbo blade portions 12A2 and the second turbo blade portions 12B2 increases from an inner circumferential side of the impeller toward the outer circumferential side thereof. That is, in the impeller 10, the inter-blade distance at the turbo blade portions increases from the inner circumferential side toward the outer circumferential side. Furthermore, the inter-blade distance at the sirocco blade portions including the first sirocco blade portions 12A1 and the second sirocco blade portions 12B1 is greater than the inter-blade distance at the turbo blade portions, and increases in a direction from the inner circumferential side toward the outer circumferential side.

In other words, the inter-blade distance between the first turbo blade portions 12A2 and the second turbo blade portions 12B2 or the inter-blade distance between adjacent second turbo blade portions 12B2 increases from the inner circumferential side toward the outer circumferential side. In addition, the inter-blade distance between the first sirocco blade portions 12A1 and the second sirocco blade portions 12B1 or the inter-blade distance between adjacent second sirocco blade portions 12B1 is greater than the inter-blade distance at the turbo blade portions, and increases in the direction from the inner circumferential side to the outer circumferential side.

(Blade Thickness)

Figure 12:
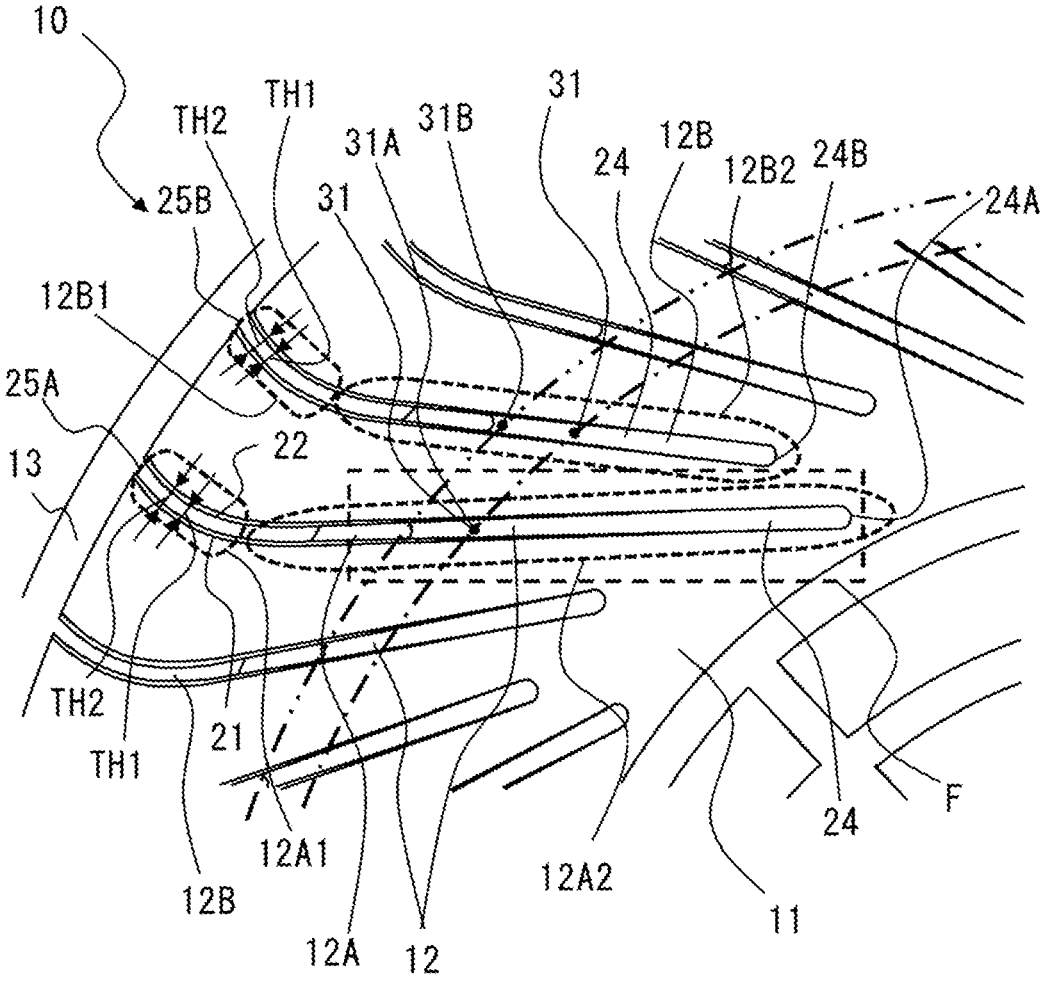
FIG. 12 is an enlarged view of part of the impeller that is located in an area E in the impeller as illustrated in FIG. 6.
Figure 13:
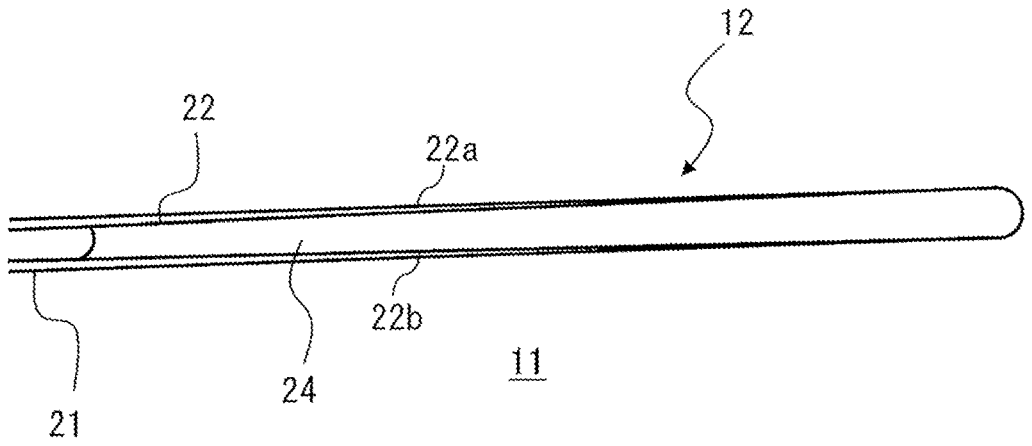
FIG. 13 is an enlarged view of part of the blade that is located in an area F in the impeller of FIG. 12.
Figure 14:
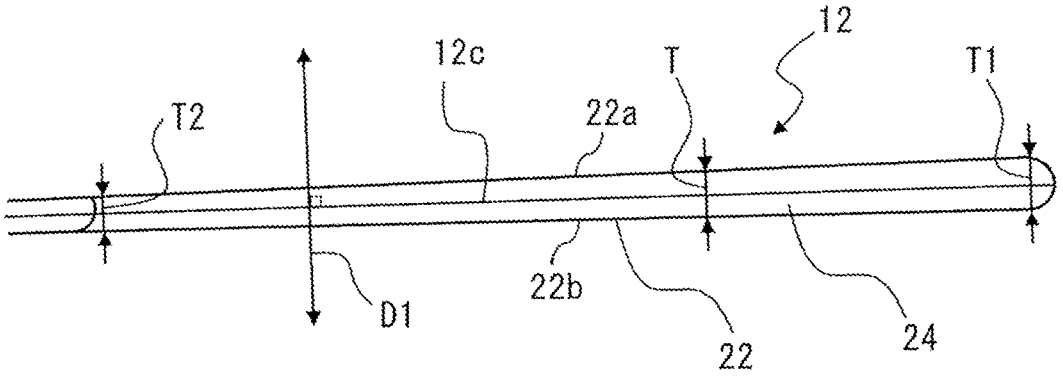
FIG. 14 is an enlarged view of a blade shape in the blade as illustrated in FIG. 13.

FIG. 12 is an enlarged view of part of the impeller 10 that is located in an area E in the impeller 10 as illustrated in FIG. 6. FIG. 13 is an enlarged view of part of the blade 12 that is located in an area F in the impeller 10 as indicated in FIG. 12. FIG. 14 is an enlarged view of a blade shape 24 in the blade 12 as illustrated in FIG. 13. A blade thickness T of the blade 12 will be described with reference to FIGS. 4, 8, and 12 to 14.

As illustrated in FIGS. 8 and 12, each blade 12 includes a base portion 21, which is one end in the axial direction along the rotation axis RS, and an end portion 22, which is the other end. The base portion 21 is a portion of the blade 12 that is connected to the main plate 11. The end portion 22 is an end that faces the suction port 10*e* in the axial direction along the rotation axis RS. As illustrated in FIGS. 4 and 8, the end portion 22 forms an edge of the blade 12 that faces the suction port 10*e*.

FIG. 12 is an enlarged plan view of the impeller 10 as viewed in a direction from a point of view V indicated by an outlined arrow in FIG. 8. FIG. 13 is an enlarged plan view of the blade 12 as viewed in the direction from the point of view V indicated in FIG. 8. The direction from the point of view V is the axial direction along the rotation axis RS. As viewed in the axial direction along the rotation axis RS, the end portion 22 of the blade 12 is formed to have the blade shape 24. That is, the blade shape 24 is the shape of the end portion 22 as viewed in plan view in the axial direction along the rotation axis RS.

FIG. 14 is a plan view of only the blade shape 24 that is extracted from the plan view of the blade 12 as illustrated in FIG. 13. As illustrated in FIG. 14, in the blade 12, at the end portion having the blade shape 24, which is the shape of the end portion 22 facing the suction port 10*e*, a first blade thickness T1 of the inner circumferential side is greater than a second blade thickness T2 of the outer circumferential side (first blade thickness T1>second blade thickness T2). It should be noted that when the blade thickness T is great, it means that the blade 12 is thick, and when the blade thickness T is small, it means that the blade 12 is thin.

In the blade 12 as illustrated in FIG. 14, the blade thickness T including the first blade thickness T1 and the second blade thickness T2 is a dimension of the blade 12 in a direction D1 perpendicular to a center line 12*c* of the blade 12 as the blade 12 is viewed in the axial direction along the rotation axis RS. As illustrated in FIG. 14, a side surface 22*a* is one side surface of the blade 12 in the direction D1, and a side surface 22*b* is the other side surface of the blade 12 in the direction D1. The blade thickness T including the first blade thickness T1 and the second blade thickness T2 corresponds to a distance between the side surface 22*a* and the side surface 22*b* in the direction D1 in the blade shape 24 of the end portion 22.

Figure 15:
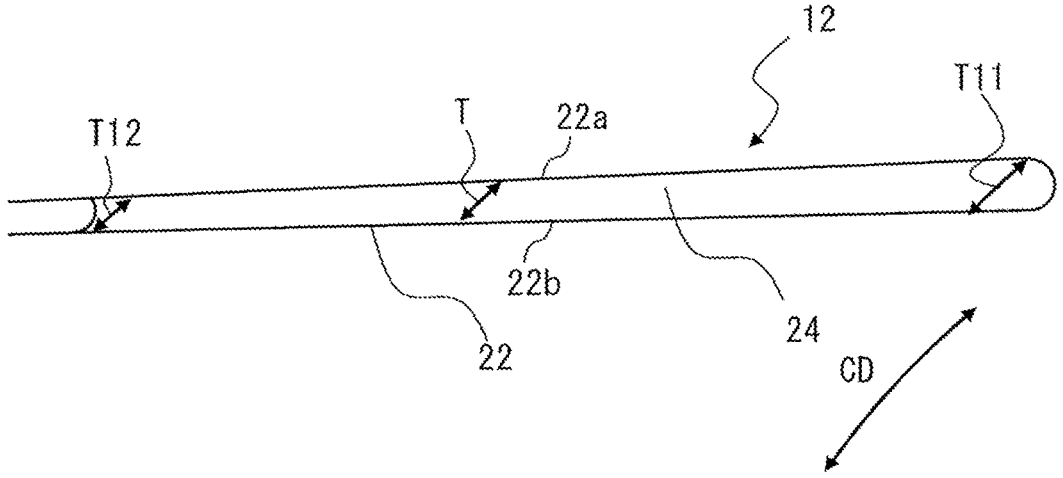
FIG. 15 is another enlarged view of the blade shape in the blade as illustrated in FIG. 13.

FIG. 15 is another enlarged view of the blade shape 24 in the blade 12 as illustrated in FIG. 13. As illustrated in FIG. 15, the blade thickness T including the first blade thickness T1 and the second blade thickness T2 may be a dimension of the blade 12 in the circumferential direction CD as the blade 12 is viewed in the axial direction along the rotation axis RS. In other words, the blade thickness T including the first blade thickness T1 and the second blade thickness T2 may be a distance between the side surface 22*a* and the side surface 22*b* in the circumferential direction CD in the blade shape 24 of the end portion 22.

Although FIGS. 12 and 13 illustrate the blade thickness T of the first blade 12A, the blade thickness T as described above is not limited to the blade thickness of the first blade 12A only. A configuration in which in the blade shape 24 corresponding to the shape of the end portion 22 facing the suction port 10*e*, the first blade thickness T1 of the inner circumferential side is greater than the second blade thickness T2 of the outer circumferential side can also apply to the second blade 12B.

In the above case, each of the blades 12 is configured such that in the blade shape 24 that is the shape of the end portion 22 facing the suction port 10*e*, the first blade thickness T1 of the inner circumferential side is greater than the second blade thickness T2 of the outer circumferential side. Alternatively, at least the first blade 12A or the second blade 12B may be configured such that in the blade shape 24 that is the shape of the end portion 22 facing the suction port 10*e*, the first blade thickness T1 of the inner circumferential side is greater than the second blade thickness T2 of the outer circumferential side. One of the first blade portion 112*a* and the second blade portion 112*b* as illustrated in FIG. 4 may have an end portion having the blade shape 24, or the first blade portion 112*a* and the second blade portion 112*b* may each have an end portion having the blade shape 24.

As illustrated in FIG. 14, the blades 12 are formed such that at the end portion having the blade shape 24 that is the end portion 22 facing the suction port 10*e*, the blade thickness T gradually decreases from the inner circumferential side of the impeller 10 toward the outer circumferential side thereof.

As illustrated in FIG. 12, at the end portion having the blade shape 24 at the first blade 12A, a midpoint between a first blade end 24A that is an end on the inner circumferential side and a second blade end 25A that is an end on the outer circumferential side will be referred to as a blade midpoint 31A. In this case, the first blade thickness T1 as indicated in FIGS. 14 and 15 is the thickness of a portion of the first blade 12A that has a maximum blade thickness T in a region between the first blade end 24A and the blade midpoint 31A. Furthermore, the second blade thickness T2 as indicated in FIGS. 14 and 15 is the thickness of a portion of the first blade 12A that has having a maximum blade thickness T in a region between the second blade end 25A and the blade midpoint 31A.

Similarly, as illustrated in FIG. 12, at the end portion having the blade shape 24 at the second blade 12B, a midpoint between a first blade end 24B that is an end on the inner circumferential side and a second blade end 25B that is an end on the outer circumferential side will be referred to as a blade midpoint 31B. In this case, the first blade thickness T1 as indicated in FIGS. 14 and 15 is the thickness of a portion of the second blade 12B that has a maximum blade thickness T in a region between the first blade end 24B and the blade midpoint 31A. Furthermore, the second blade thickness T2 as indicated in FIGS. 14 and 15 is the thickness of a portion of the second blade 12B that has a maximum blade thickness T in a region between the second blade end 25B and the blade midpoint 31A.

Although the above relationship regarding the maximum blade thickness T is determined in units of one individual blade 12, the relationship may be applied to the blades 12 as a whole. In this case, as illustrated in FIGS. 9 to 11, in the blades 12, the inside diameter ID3≥the inside diameter ID1, the inside diameter ID4≥the inside diameter ID2, and the inside diameter ID2>the inside diameter ID1. Thus, the above inside diameter of the first blades 12A can be regarded as a blade inside diameter of the blades 12. In addition, in the blades 12, the outside diameter OD3=the outside diameter OD1, the outside diameter OD4=the outside diameter OD2, and the outside diameter OD2=the outside diameter OD1. Thus, the above outside diameter of the first blades 12A can be regarded as a blade outside diameter of the blades 12. Therefore, the blade midpoint 31A may be used as a blade midpoint 31 of the entire blades 12 as the blades 12 included in the impeller 10 are viewed as a whole.

That is, as a midpoint of the entire blades 1, at the end portion having the blade shape at the first blade 12A, the midpoint between the first blade end 24A that is the end on the inner circumferential side and the second blade end 25A that is the end on the outer circumferential side is the blade midpoint 31. In this case, in the first blade 12A, the first blade thickness T1 as indicated in FIGS. 14 and 15 is the thickness of a portion having a maximum blade thickness T in the region between the first blade end 24A and the blade midpoint 31. Also, in the first blade 12A, the second blade thickness T2 as indicated in FIGS. 14 and 15 is the thickness of a portion having a maximum blade thickness T in the region between the second blade end 25A and the blade midpoint 31. Furthermore, in the second blade 12B, the first blade thickness T1 as indicated in FIGS. 14 and 15 is the thickness of a portion having a maximum blade thickness T in the region between the first blade end 24B and the blade midpoint 31. Also, in the second blade 12B, the second blade thickness T2 as indicated in FIGS. 14 and 15 is the thickness of a portion having a maximum blade thickness T in the region between the second blade end 25B and the blade midpoint 31.

As illustrated in FIG. 12, the blades 12 are each formed such that in the sirocco blade portion which is each of the first sirocco blade portion 12A1 and the second sirocco blade portion 12B1, a blade thickness TH1 is smaller than a blade thickness TH2. The blade thickness TH1 is the blade thickness T of the end portion facing the suction port 10*e*, in the sirocco blade portion which is each of the first sirocco blade portion 12A1 and the second sirocco blade portion 12B1. In the sirocco blade portion which is each of the first sirocco blade portion 12A1 and the second sirocco blade portion 12B1, the blade thickness TH2 is the blade thickness T of the base portion 21 connected to the main plate 11.

(Modification 1)

Figure 16:
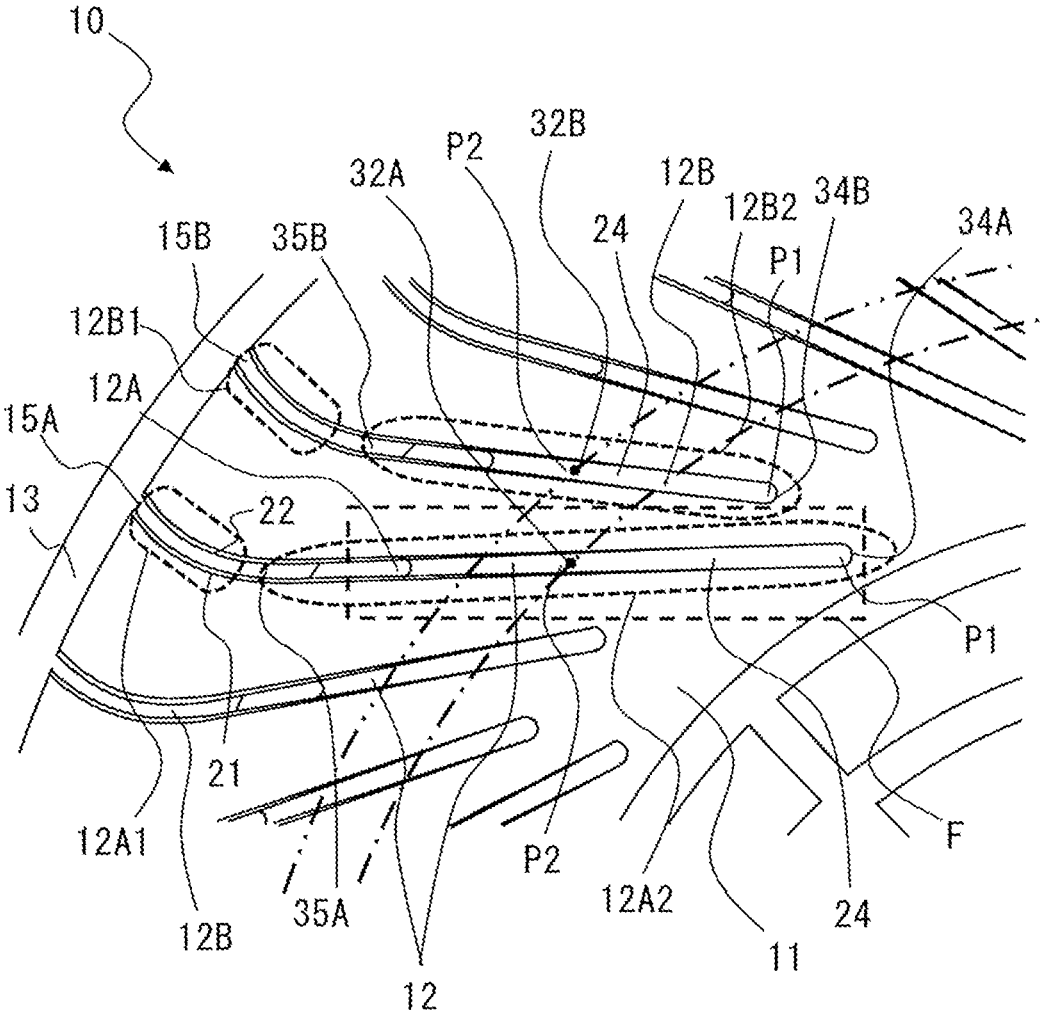
FIG. 16 is an enlarged view of part of an impeller according to a modification that corresponds to the area E of the impeller as illustrated in FIG. 6.

FIG. 16 is an enlarged view of part of an impeller 10 according to a modification, which corresponds to the area E of the impeller 10 as illustrated in FIG. 6. In the impeller 10 according to the modification, a first blade thickness portion P1 having the first blade thickness T1 and a second blade thickness portion P2 having the second blade thickness T2 are located in a turbo blade portion. Thus, at the end portion having the blade shape 24 at the turbo blade portion of the impeller 10 according to the modification, the first blade thickness T1 is greater than the second blade thickness T2, as illustrated in FIG. 14 or FIG. 15.

More specifically, the first blades 12A are each formed such that as illustrated in FIGS. 14 and 15, in the and portion having the blade shape 24 at the first turbo blade portion 12A2, the first blade thickness T1 of the inner circumferential side is greater than the second blade thickness T2 of the outer circumferential side (first blade thickness T1>second blade thickness T2). Furthermore, the first blade 12A is formed such that in the end portion having the blade shape 24 at the first turbo blade portion 12A2, the blade thickness T gradually decreases from the inner circumferential side toward the outer circumferential side of the impeller 10.

As illustrated in FIG. 16, in the end portion having the blade shape 24 at the first turbo blade portion 12A2, a midpoint between a first turbo end 34A that is an end on the inner circumferential side and a second turbo end 35A that is an end on the outer circumferential side will be referred to as a turbo midpoint 32A. In this case, the first blade thickness T1 as indicated in FIGS. 14 and 15 is the thickness of a portion having a maximum blade thickness T in a region between the first turbo end 34A and the turbo midpoint 32A. The second blade thickness T2 as indicated in FIGS. 14 and 15 is the thickness of a portion having a maximum blade thickness T in a region between the second turbo end 35A and the turbo midpoint 32A.

Similarly, the second blades 12B are each formed such that in the end portion having the blade shape 24 at the second turbo blade portion 12B2, the first blade thickness T1 of the inner circumferential side is greater than the second blade thickness T2 of the outer circumferential side (first blade thickness T1>second blade thickness T2). The second blade 12B is formed such that the blade thickness T gradually decreases from the inner circumferential side of the impeller 10 toward the outer circumferential side thereof in the end portion having the blade shape 24 at the second turbo blade portion 12B2.

As illustrated in FIG. 16, in the end portion having the blade shape 24 at the second turbo blade portion 12B2, a midpoint between a first turbo end 34B that is an end on the inner circumferential side and a second turbo end 35B that is an end on the outer circumferential side will be referred to as a turbo midpoint 32B. In this case, the first blade thickness T1 as indicated in FIGS. 14 and 15 is the thickness of a portion having a maximum blade thickness T in a region between the first turbo end 34B and the turbo midpoint 32B. The second blade thickness T2 as indicated in FIGS. 14 and 15 is the thickness of a portion having a maximum blade thickness T in a region between the second turbo end 35B and the turbo midpoint 32B.

Figure 17:
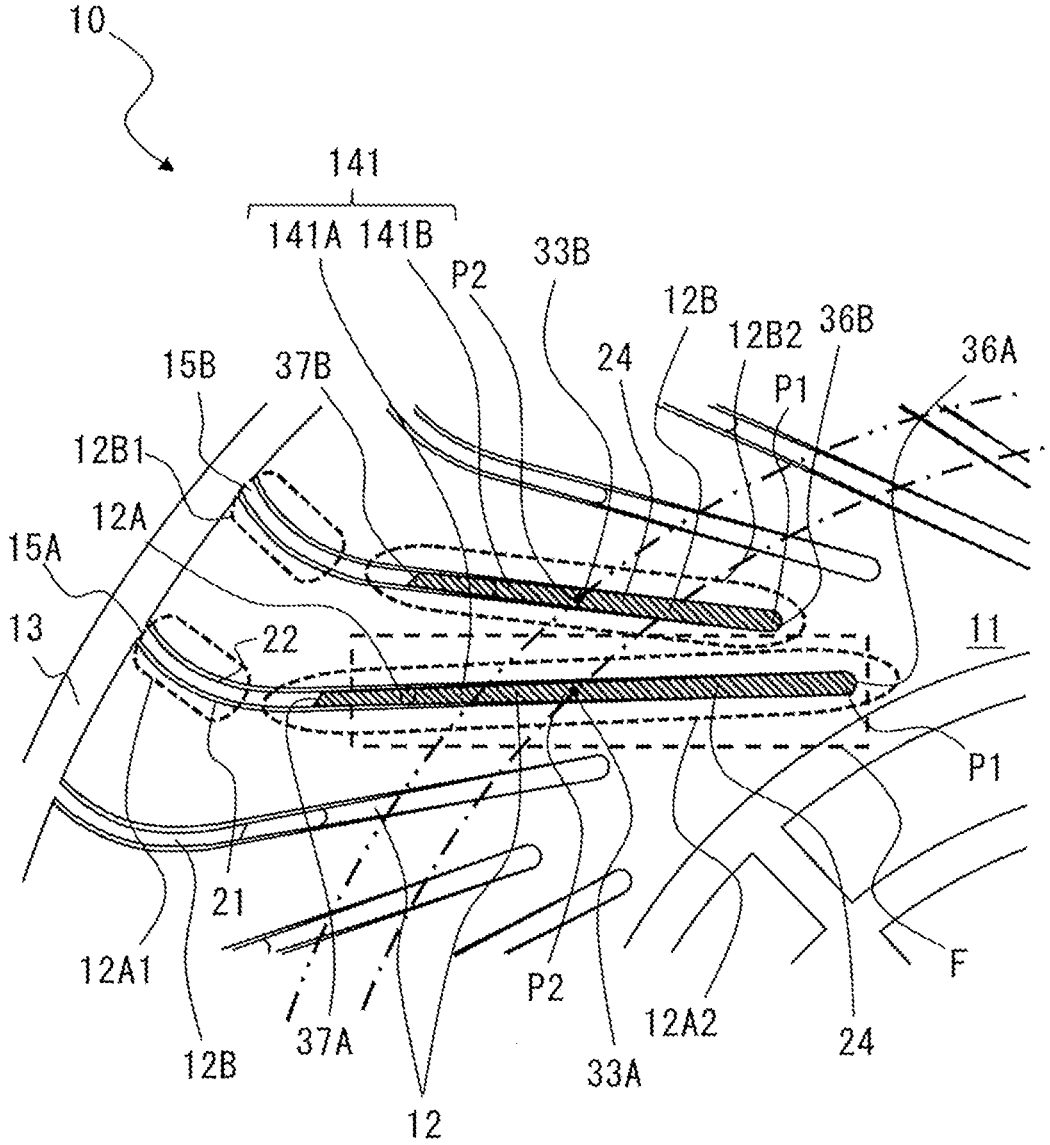
FIG. 17 is an enlarged view of part of an impeller according to a second modification that corresponds to the area E of the impeller as illustrated in FIG. 6.

FIG. 17 is an enlarged view of part of an impeller 10 according to a second modification, which corresponds to the area E of the impeller 10 as illustrated in FIG. 6. In FIG. 17, the inclined portion 141A and the inclined portion 141B are indicated by hatching. The "inclined portion 141", which will be described below, is a generic term for the inclined portion 141A and the inclined portion 141B. The positions of the inclined portions 141 as indicated in FIG. 17 are each an example. The positions of the inclined portions 141 are not limited to those in FIG. 17.

In the impeller 10 according to the second modification, the first blade thickness portion P1 having the first blade thickness T1 and the second blade thickness portion P2 having the second blade thickness T2 are located in the inclined portions 141. Therefore, in the impeller 10 according to the second modification, in at the end portion having the blade shape 24 at the inclined portion 141, the first blade thickness T1 is greater than the second blade thickness T as illustrated in FIG. 14 or FIG. 15.

More specifically, each of the first blades 12A is formed such that in the end portion having the blade shape 24 at the inclined portion 141A as illustrated in FIG. 3, as illustrated in FIGS. 14 and 15, the first blade thickness T1 of the inner circumferential side is greater than the second blade thickness T2 on the outer circumferential side (first blade thickness T1>second blade thickness T2). The first blade 12A is formed such that in the end portion having the blade shape 24 at the inclined portion 141A, the blade thickness T gradually decreases from the inner circumferential side of the impeller 10 toward the outer circumferential side thereof.

As illustrated in FIG. 17, in the end portion having the blade shape 24 at the inclined portion 141A, a midpoint between a first inclined-portion end 36A that is an end on the inner circumferential side and a second inclined-portion end 37A which is an end on the outer circumferential side will be referred to as an inclined-portion midpoint 33A. In this case, the first blade thickness T1 as indicated in FIGS. 14 and 15 is the thickness of a portion having a maximum blade thickness T in a region between the first inclined-portion end 36A and the inclined-portion midpoint 33A. The second blade thickness T2 as indicated in FIGS. 14 and 15 is the thickness of a portion having a maximum blade thickness T in a region between the second inclined-portion end 37A and the inclined-portion midpoint 33A.

Preferably, an inclination angle of the inclined portion 141A should be greater than 0 degrees and less than or equal to 60 degrees, and more preferably greater than 0 degrees and less than or equal to 45 degrees. That is, preferably, an inclination angle θ1 formed between the inclined portion 141A and the rotation axis RS should satisfy 0 degrees<θ1≤60 degrees, and more preferably 0 degrees<θ1≤45 degrees.

Similarly, each of the second blades 12B is formed such that in the end portion having the blade shape 24 at the inclined portion 141B as illustrated in FIG. 3, as illustrated in FIGS. 14 and 15, the first blade thickness T1 of the inner circumferential side is greater than the second blade thickness T2 of the outer circumferential side (first blade thickness T1>second blade thickness T2). The second blade 12B is formed such that in the end portion having the blade shape 24 at the inclined portion 141B, the blade thickness T gradually decreases from the inner circumferential side of the impeller 10 toward the outer circumferential side thereof.

As illustrated in FIG. 17, in the end portion having the blade shape 24 at the inclined portion 141B, a midpoint between a first inclined-portion end 36B that is an end on the inner circumferential side and a second inclined-portion end 37B that is an end on the outer circumferential side will be referred to as an inclined-portion midpoint 33B. In this case, the first blade thickness T1 as indicated in FIGS. 14 and 15 is the thickness of a portion having a maximum blade thickness T in a region between the first inclined-portion end 36B and the inclined-portion midpoint 33B. The second blade thickness T2 as indicated in FIGS. 14 and 15 is the thickness of a portion having a maximum blade thickness T in a region between the second inclined-portion end 37B and the inclined-portion midpoint 33B.

Preferably, the inclination angle of the inclined portion 141B should be greater than 0 degrees and less than or equal to 60 degrees, and more preferably greater than 0 degrees and less than or equal to 45 degrees. That is, preferably, an inclination angle θ2 formed between the inclined portion 141B and the rotation axis RS should satisfy 0 degrees<θ2≤60 degrees, and more preferably 0 degrees<θ2≤45 degrees. The inclination angle θ1 and the inclination angle θ2 may be the same as each other or may be different from each other.

As illustrated in FIG. 17, the inclined portion 141A is located at the first turbo blade portion 12A2. Therefore, the first blades 12A are arranged such that a diameter of a circle passing through parts of regions including the first turbo blade portions 12A2 that are closer to the main plate 11 is smaller than a diameter of a circle passing through parts of the regions including the first turbo blade portions 12A2 that are located closer to the side plate 13. In addition, the inclined portion 141B is located at the second turbo blade portion 12B2. Therefore, the second blades 12B are arranged such that a diameter of a circle passing through parts of regions including the second turbo blade portions 12B2 that is closer to the main plate 11 is smaller than a diameter of a circle passing through parts of the regions including the second turbo blade portions 12B2 that are closer to the side plate 13. With the above configuration of the first blades 12A and the second blades 12B, the blades 12 are arranged such that the above diameter of the parts of the regions including the turbo blade portions that are closer to the main plate 11 is smaller than the above diameter of the parts of the regions including the turbo blade portions that are closer to the side plate 13.

(Relationship Between Impeller 10 and Scroll Casing 40)

Figure 18:
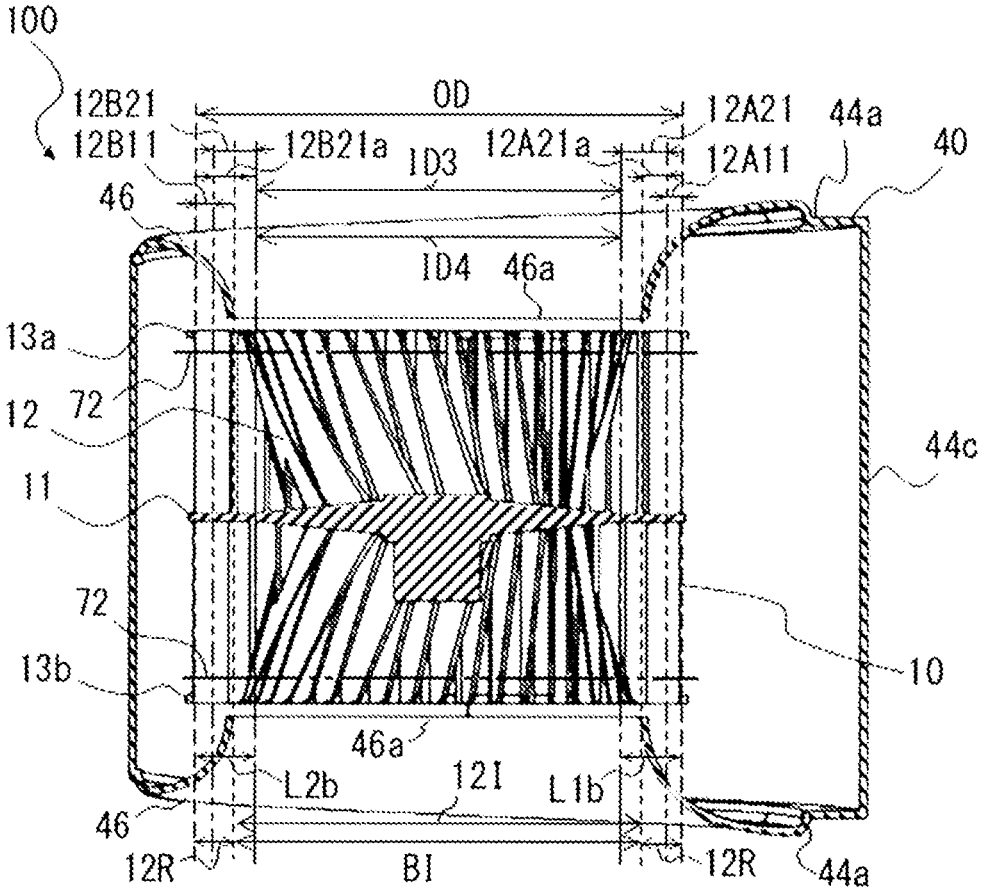
FIG. 18 is a schematic diagram illustrating a relationship between the impeller and a bell mouth at a section of the centrifugal fan that is taken along line A-A in FIG. 2.
Figure 19:
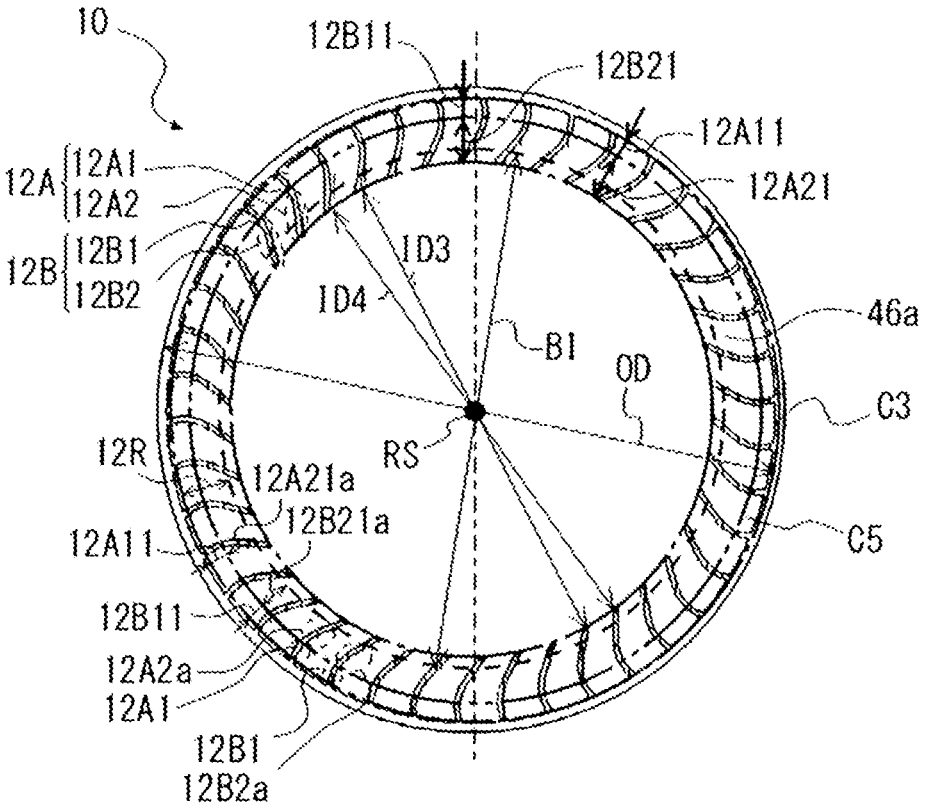
FIG. 19 is a schematic diagram illustrating a relationship between the blades and the bell mouth at a second section of the impeller in FIG. 18 as viewed in a direction parallel to a rotation axis RS.

FIG. 18 is a schematic diagram illustrating a relationship between the impeller 10 and the bell mouth 46 at a section of the centrifugal fan 100 that is taken along line A-A in FIG. 2. FIG. 19 is a schematic diagram illustrating a relationship between the blades 12 and the bell mouth 46 at the second section of the impeller 10 as illustrated in FIG. 18 as viewed in the direction parallel to the rotation axis RS.

As illustrated in FIGS. 18 and 19, a blade outside diameter OD of a circle that passes through the outer peripheral ends of the blades 12, that is, the blade outside diameter OD of the blades 12, is larger than an inside diameter BI of the bell mouth 46 included in the scroll casing 40. The blade outside diameter OD of the blades 12 is equal to the outside diameter OD1 and the outside diameter OD2 of the first blades 12A and the outside diameter OD3 and the outside diameter OD4 of the second blades 12B (blade outside diameter OD=outside diameter OD1=outside diameter OD2=outside diameter OD3=outside diameter OD4).

In the impeller 10, the first turbo region 12A21 is larger than the first sirocco region 12A11 in the radial direction from the rotation axis RS. In other words, the impeller 10 and each first blade 12A are formed such that the proportion of the first turbo blade portion 12A2 to the first blade 12A in the radial direction from the rotation axis RS is higher than that of the first sirocco blade portion 12A1 to the first blade 12A in the radial direction from the rotation axis RS, or such that the first sirocco blade portion 12A1 is smaller than the first turbo blade portion 12A2. The relationship between the above proposition of the first sirocco blade portion 12A1 and that of the first turbo blade portion 12A2 in the radial direction from the rotation axis RS is true of both the main-plate-side blade region 122*a*, which is the first region, and the side-plate-side blade region 122*b*, which is the second region.

In the above example, the configuration of each of the impeller 10 and the first blade 12A is not limited to a configuration in which the proportion of the first turbo blade portion 12A2 to the first blade 12A in the radial direction from the rotation axis RS is higher than that of the first sirocco blade portion 12A1, and the first sirocco blade portion 12A1 is smaller than the first turbo blade portion 12A2. The impeller 10 and the first blade 12A may have any other form. The impeller 10 and the first blade 12A may be formed such that the proportion of the first turbo blade portion 12A2 to the first blade 12A in the radial direction from the rotation axis RS is smaller than or equal to that of the first sirocco blade portion 12A1.

Furthermore, a region corresponding to part of the blades 12 that is located closer to the outer circumferential side than a location corresponding to the inside diameter BI of the bell mouth 46 in the radial direction from the rotation axis RS as viewed in the direction parallel to the rotation axis RS will be referred to as an outer-circumferential-side region 12R. In the impeller 10, it is preferable that in the outer-circumferential-side region 12R also, the proportion of the first turbo blade portion 12A2 be higher than that of the first sirocco blade portion 12A1. That is, as viewed in the direction parallel to the rotation axis RS, in the impeller 10, a first turbo region 12A21*a* is larger than the first sirocco region 12A11 in the radial direction from the rotation axis RS in the outer-circumferential-side region 12R, which is located closer to the outer circumferential side than the location corresponding to the inside diameter BI of the bell mouth 46.

The first turbo region 12A21*a* is part of the first turbo region 12A21 that is located closer to the outer circumferential side than the location corresponding to the inside diameter BI of the bell mouth 46 as viewed in the direction parallel to the rotation axis RS. It should be noted that a portion of the first turbo blade portion 12A2 that is included in the first turbo region 12A21*a* will be referred to as a first turbo blade portion 12A2*a*. In the outer-circumferential-side region 12R of the impeller 10, preferably, the proportion of the first turbo blade portion 12A2*a* to the first blade should be higher than that of the first sirocco blade portion 12A1. The relationship between the proportion of the first sirocco blade portion 12A1 and that of the first turbo blade portion 12A2*a* in the outer-circumferential-side region 12R is also true of both the main-plate-side blade region 122*a*, which is the first region, and the side-plate-side blade region 122*b*, which is the second region.

Similarly, in the impeller 10, the second turbo region 12B21 is larger than the second sirocco region 12B11 in the radial direction from the rotation axis RS. To be more specific, in the impeller 10 and each second blade 12B, the proportion of the second turbo blade portion 12B2 to the second blade 12B in the radial direction from the rotation axis RS is higher than that of the second sirocco blade portion 12B1, and the second sirocco blade portion 12B1 is smaller than the second turbo blade portion 12B2. The relationship between the proportion of the second sirocco blade portion 12B1 and that of the second turbo blade portion 12B2 in the radial direction from the rotation axis RS is also true of both the main-plate-side blade region 122*a*, which is the first region, and the side-plate-side blade region 122*b*, which is the second region.

It should be noted that it is described above that in the impeller 10 and the second blade 12B, the proportion of the second turbo blade portion 12B2 to the second blade 12B in the radial direction from the rotation axis RS is higher than that of the second sirocco blade portion 12B1, and the second sirocco blade portion 12B1 is smaller than the second turbo blade portion 12B2. However, this description is not limiting. In the impeller 10 and the second blade 12B, the proportion of the second turbo blade portion 12B2 to the second blade 12B in the radial direction from the rotation axis RS may be lower than or equal to that of the second sirocco blade portion 12B1.

Furthermore, in the impeller 10, it is preferable that also, in the outer-circumferential-side region 12R, the proportion of the second turbo blade portion 12B2 to the second blade be higher than that of the second sirocco blade portion 12B1.

That is, as viewed in the direction parallel to the rotation axis RS, in the outer-circumferential-side region 12R of the impeller 10, which is located closer to the outer circumferential side than the location corresponding to the inside diameter BI of the bell mouth 46, a second turbo region 12B21*a* is larger than the second sirocco region 12B11 in the radial direction from the rotation axis RS.

The second turbo region 12B21*a* is a region of the second turbo region 12B21 that is located closer to the outer circumferential side than the location corresponding to the inside diameter BI of the bell mouth 46 as viewed in the direction parallel to the rotation axis RS. It should be noted that a portion of the second turbo blade portion 12B2 that is included in the second turbo region 12B21*a* will be referred to as a second turbo blade portion 12B2*a*. In the outer-circumferential-side region 12R of the impeller 10, preferably, the proportion of the second turbo blade portion 12B2*a* to the second blade should be higher than that of the second sirocco blade portion 12B1. The relationship between the proportion of the second sirocco blade portion 12B1 and that of the second turbo blade portion 12B2*a* in the outer-circumferential-side region 12R is true of both the main-plate-side blade region 122*a*, which is the first region, and the side-plate-side blade region 122*b*, which is the second region.

Figure 20:
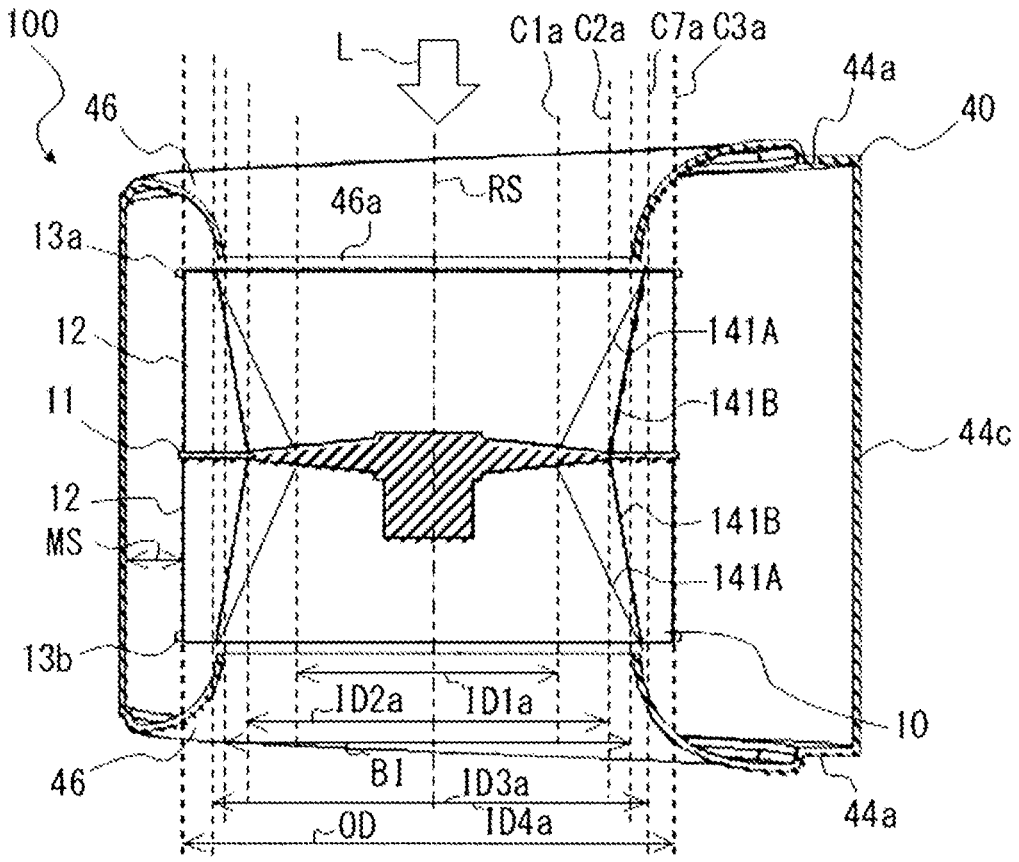
FIG. 20 is a schematic diagram illustrating a relationship between the impeller and the bell mouth at a section of the centrifugal fan that is taken along line A-A in FIG. 2.
Figure 21:
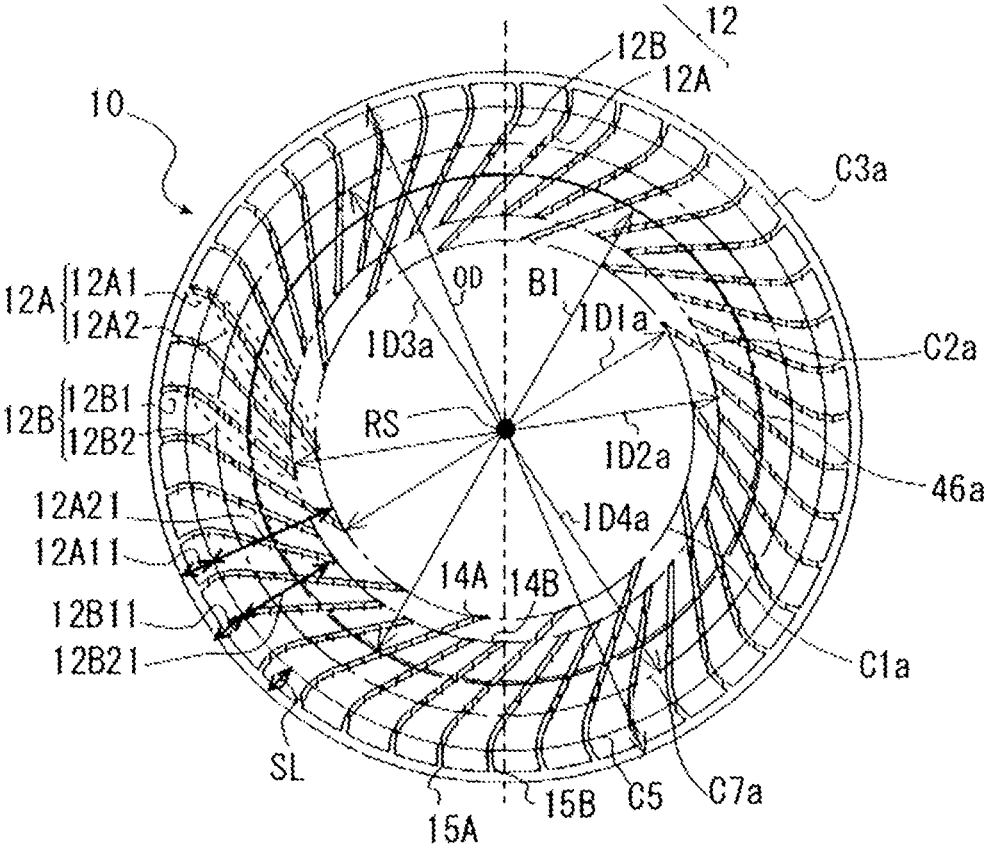
FIG. 21 is a schematic diagram illustrating a relationship between the blades and the bell mouth in the impeller as illustrated in FIG. 20 as viewed in the direction parallel to the rotation axis.

FIG. 20 is a schematic diagram illustrating a relationship between the impeller 10 and the bell mouth 46 at a section of the centrifugal fan 100 that is taken along line A-A in FIG. 2. FIG. 21 is a schematic diagram illustrating a relationship between the blades 12 and the bell mouth 46 in the impeller 10 as illustrated in FIG. 20, as viewed in the direction parallel to the rotation axis RS. In FIG. 20, an outlined arrow L indicates the direction parallel to the rotation axis RS that corresponds to "the direction" in "as viewed in the direction parallel to the rotation axis RS".

As illustrated in FIGS. 20 and 21, as viewed in the direction parallel to the rotation axis RS, at connection positions of the first blades 12A to the main plate 11, a circle that passes through the inner peripheral ends 14A of the first blades 12A and that is a curve everywhere equidistant from the rotation axis RS will be referred to as a circle Cia. Furthermore, the diameter of the circle Cia, that is, the inside diameter of the first blades 12A at the connection positions of the first blades 12A to the main plate 11, will be referred to as an inside diameter ID1*a*.

Furthermore, as viewed in the direction parallel to the rotation axis RS, at connection positions of the second blades 12B to the main plate 11, a circle that passes through the inner peripheral ends 14B of the second blades 12B and that is a curve everywhere equidistant from the rotation axis RS will be referred to as a circle C2*a*. Furthermore, the diameter of the circle C2*a*, that is, an inside diameter of the second blades 12B at the connection positions of the first blades 12A to the main plate 11, will be referred to as an inside diameter ID2*a*. The inside diameter ID2*a* is larger than the inside diameter ID1*a* (inside diameter ID2*a*>inside diameter ID1*a*).

As viewed in the direction parallel to the rotation axis RS, the outside diameter of the blades 12, that is, the diameter of a circle C3*a* that passes through the outer peripheral ends 15A of the first blades 12A and the outer peripheral ends 15B of the second blades 12B and that is a curve everywhere equidistant from the rotation axis RS, is the blade outside diameter OD.

Furthermore, as viewed in the direction parallel to the rotation axis RS, at connection positions of the first blades 12A to the side plate 13, a circle that passes through the inner peripheral ends 14A of the multiple first blades 12A and that is a curve everywhere equidistant from the rotation axis RS will be referred to as a circle C7*a*. In addition, the diameter of the circle C7*a*, that is, an inside diameter of the first blades 12A at the connection positions of the first blades 12A to the side plate 13, will be referred to as an inside diameter ID3*a*.

As viewed in the direction parallel to the rotation axis RS, a circle that passes through the inner peripheral ends 14B of the multiple second blades 12B and that is a curve everywhere equidistant from the rotation axis RS at connection positions of the second blades 12B to the side plate 13 is the C7*a*. Furthermore, the diameter of the circle C7*a*, that is, an inside diameter of the second blades 12B at the connection positions of the second blades 12B to the side plate 13, will be referred to as an inside diameter ID4*a*.

As illustrated in FIGS. 20 and 21, as viewed in the direction parallel to the rotation axis RS, the location corresponding to the inside diameter BI of the bell mouth 46 is situated in a region including the first turbo blade portions 12A2 and the second turbo blade portions 12B2 between a location corresponding to the inside diameter ID1*a* of the first blades 12A at the main plate 11 and a location corresponding to the inside diameter ID3*a* of the first blades 12A at the side plate 13. More specifically, the inside diameter BI of the bell mouth 46 is larger than the inside diameter ID1*a* of the first blades 12A at a region closer to the main plate 11 and is smaller than the inside diameter ID3*a* of the first blades 12A at a region closer to the side plate 13.

The inside diameter BI of the bell mouth 46 is larger than the blade inside diameter of the blades 12 at the main plate 11 and is smaller than the blade inside diameter of the blades 12 at the side plate 13. In other words, as viewed in the direction parallel to the rotation axis RS, the diameter of an inner circumferential edge 46*a* of the bell mouth 46 that corresponds to the inside diameter BI of the bell mouth 46 is located in the region including the first turbo blade portions 12A2 and the second turbo blade portions 12B2 between the circle Cia and the circle C7*a*.

As illustrated in FIGS. 20 and 21, as viewed in the direction parallel to the rotation axis RS, the location corresponding to the inside diameter BI of the bell mouth 46 is situated in the region including the first turbo blade portions 12A2 and the second turbo blade portions 12B2 between the location corresponding to the inside diameter ID2*a* of the second blades 12B at the main plate 11 and that corresponding to the inside diameter ID4*a* of the second blades 12B at the side plate 13. More specifically, the inside diameter BI of the bell mouth 46 is larger than the inside diameter ID2*a* of the second blades 12B at the main plate 11 and is smaller than the inside diameter ID4*a* of the second blades 12B at the side plate 13.

Specifically, the inside diameter BI of the bell mouth 46 is larger than the blade inside diameter of the blades 12 at the main plate 11 and is smaller than the blade inside diameter thereof at the side plate 13. More specifically, the inside diameter BI of the bell mouth 46 is larger than the blade inside diameter of the inner peripheral ends of the blades 12 in the first region and is smaller than the blade inside diameter of the inner peripheral ends of the blades 12 in the second region. In other words, as viewed in the direction parallel to the rotation axis RS, the inner circumferential edge 46*a* of the bell mouth 46 that corresponds to the inside diameter BI of the bell mouth 46 is located in the region including the first turbo blade portions 12A2 and the second turbo blade portions 12B2 between the circle C2*a* and the circle C7*a*.

Referring to FIGS. 20 and 21, the length of each of the first sirocco blade portion 12A1 and the second sirocco blade portion 12B1 in the radial direction of the impeller 10 will be referred to a distance SL, and the shortest distance between the blades 12 of the impeller 10 and the circumferential wall 44*c* of the scroll casing 40 in the centrifugal fan 100 will be referred to as a distance MS. In this case, in the centrifugal fan 100, the distance MS is greater than twice the distance SL (distance MS>distance ML×2). Although the distance MS is indicated in the section of the centrifugal fan 100 as illustrated in FIG. 20 that is taken along line A-A, the distance MS is the shortest distance to the circumferential wall 44*c* of the scroll casing 40, and cannot be necessarily indicated in the section taken along line A-A.

(Relationship between Blade Thickness of Blade 12 and Scroll Casing 40)

Figure 22:
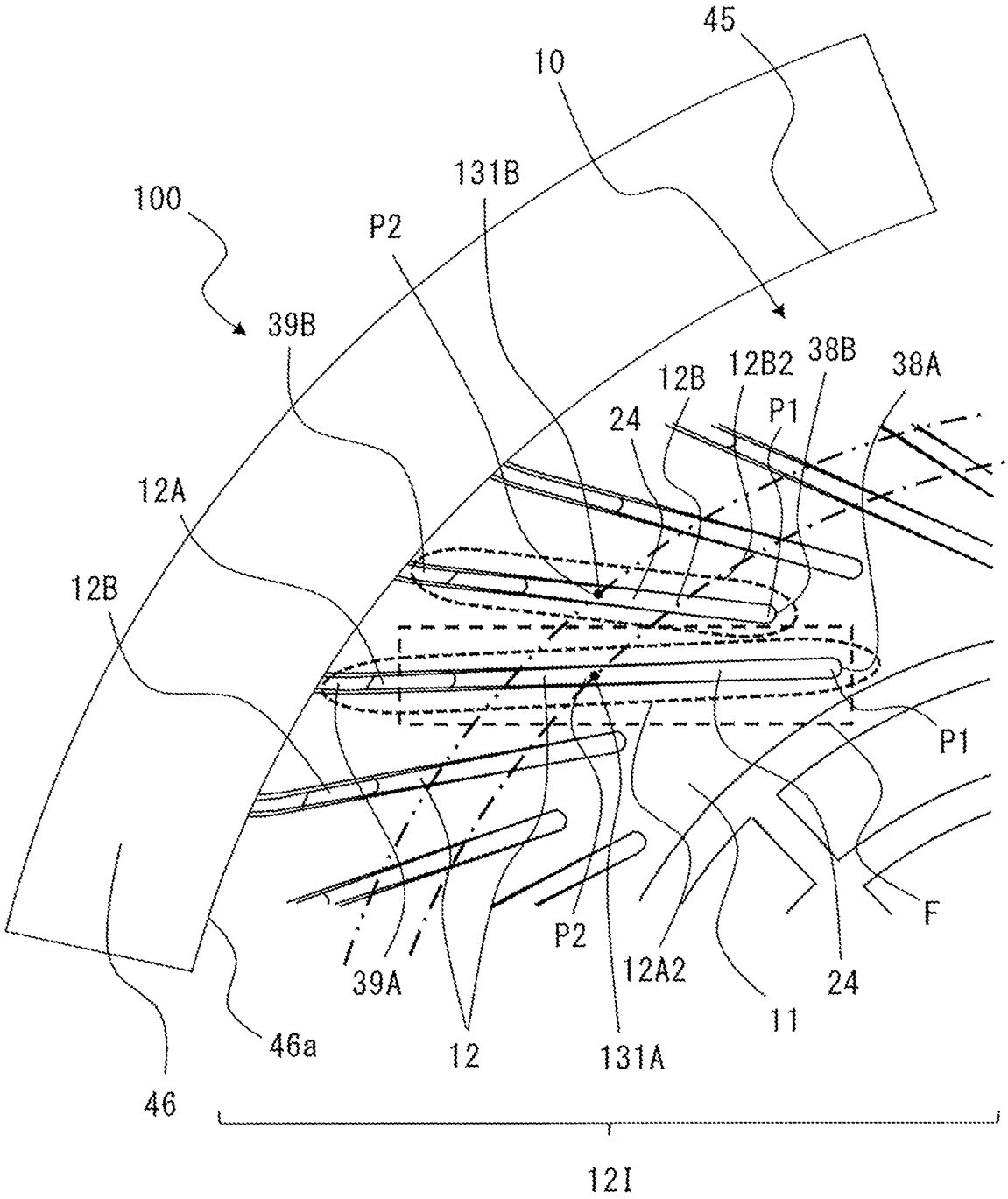
FIG. 22 is an enlarged view of part of the centrifugal fan that includes the area E of the impeller as illustrated in FIG. 6.

FIG. 22 is an enlarged view of part of the centrifugal fan 100 that includes the area E of the impeller 10 as indicated in FIG. 6. The first blade thickness portion P1 having the first blade thickness T1 and the second blade thickness portion P2 having the second blade thickness T2 as indicated in FIG. 14 or FIG. 15 are included in part of each of the blades 12 that is located inward of the inner circumferential edge 46*a* of the bell mouth 46 in the direction along the rotation axis RS. Therefore, in each of the blades 12, at the end portion having the blade shape 24 which is located inward of the inner circumferential edge 46*a* of the bell mouth 46, the first blade thickness T1 is greater than the second blade thickness T2 as indicated in FIG. 14 or FIG. 15.

As viewed in the direction parallel to the rotation axis RS, a region including portions of the blades 12 that are located closer to the inner circumferential side than the location corresponding to the inside diameter BI of the bell mouth 46 in the radial direction from the rotation axis RS will be referred to an inner-circumferential-side region 121 (see FIG. 18). In the end portion having the blade shape 24 in the inner-circumferential-side region 121 at each of the blades 12 as illustrated in FIG. 22, the first blade thickness T1 is greater than the second blade thickness T2 as illustrated in FIG. 14 or FIG. 15.

More specifically, in each first blade 12A, as illustrated in FIG. 22, in the end portion that has the blade shape 24 at each first blade 12A and that is located inward of the inner circumferential edge 46*a* of the bell mouth 46, the first blade thickness T1 of the inner circumferential side is greater than the second blade thickness T2 of the outer circumferential side as illustrated in FIGS. 14 and 15 (first blade thickness T1>second blade thickness T2). The first blade 12A is formed such that in the portion located inward of the inner circumferential edge 46*a* of the bell mouth 46, the blade thickness T gradually decreases from the inner circumferential side toward the outer circumferential side of the impeller 10 in the blade shape 24.

As illustrated in FIG. 22, in the portion having the blade shape 24 and located inward of the inner circumferential edge 46*a* of the bell mouth 46, a midpoint between a first inner end 38A that is an end on the inner circumferential side and a second outer end 39A that is an end on the outer circumferential side will be referred to as a blade midpoint 131A. In this case, the first blade thickness T1 as indicated in FIGS. 14 and 15 is the thickness of a blade portion having a maximum blade thickness T in a region between the first inner end 38A and the blade midpoint 131A. The second blade thickness T2 as indicated in FIGS. 14 and 15 is the thickness of a portion having a maximum blade thickness T in a region between the second outer end 39A and the blade midpoint 131A.

Similarly, in each second blade 12B, in the end portion having the blade shape 24 and located inward of the inner circumferential edge 46*a* of the bell mouth 46, the first blade thickness T1 of the inner circumferential side is greater than the second blade thickness T2 of the outer circumferential side as illustrated in FIG. 14 or 15 (first blade thickness T1>second blade thickness T2). In the second blade 12B, in the end portion that has the blade shape 24 and is located inward the inner circumferential edge 46*a* of the bell mouth 46, the blade thickness T gradually decreases from the inner circumferential side toward the outer circumferential side of the impeller 10.

As illustrated in FIG. 22, in the end portion having the blade shape 24 and located inward of the inner circumferential edge 46*a* of the bell mouth 46, a midpoint between a first inner end 38B that is an end on the inner circumferential side and a second outer end 39B that is an end on the outer circumferential side will be referred to as a blade midpoint 131B. In this case, the first blade thickness T1 as indicated in FIGS. 14 and 15 is the thickness of a blade portion having a maximum blade thickness T in a region between the first inner end 38B and the blade midpoint 131B. The second blade thickness T2 as indicated in FIGS. 14 and 15 is the thickness of a portion having a maximum blade thickness T in a region between the second outer end 39B and the blade midpoint 131B.

[Advantages of Impeller 10 and Centrifugal Fan 100]

In the impeller 10, in the end portion 22 facing the suction port 10*e* and having the blade shape 24, the first blade thickness T1 of the inner circumferential side is greater than the second blade thickness T2 of the outer circumferential side.

Therefore, in the impeller 10 having such a configuration, the inter-blade distance between the blades 12, which is defined above, increases from the inner circumferential side to the outer circumferential side, whereby the blades 12 can achieve a sufficient pressure recovery. Accordingly, the impeller 10 can improve the pressure recovery, as compared with an impeller and a centrifugal fan that do not have the above configuration. In addition, by virtue of the above configuration, the impeller 10 can further efficiently send air, that is, improve an air-sending efficiency, in addition to the pressure recovery.

In the impeller 10, in the end portion 22 facing the suction port 10*e* and having the blade shape 24, the first blade thickness T1 of the inner circumferential side is greater than the second blade thickness T2 of the outer circumferential side. In the impeller 10 having such a configuration, it is possible to adjust an increase in the inter-blade distance between the blades 12, from the inner circumferential side toward the outer circumferential side without changing the angle of each of the blades 12. Thus, the impeller 10 can be designed with a certain degree of flexibility in angle of the blade 12.

In each of the blades 12, in the end portion having the blade shape 24, the blade thickness T gradually decreases from the inner circumferential side toward the outer circumferential side. Thus, in the impeller 10, it is possible to cause air to flow along the blade shape 24, and smoothly achieve a pressure recovery.

In the impeller 10, the inter-blade distance between the turbo blade portions increases from the inner circumferential side toward the outer circumferential side. In the impeller 10 having such a configuration, the inter-blade distance between the blades 12 increases from the inner circumferential side toward the outer circumferential side, whereby the blades 12 can achieve a sufficient pressure recovery. Thus, the impeller 10 can improve the pressure recovery, as compared with an impeller and a centrifugal fan that do not have the above configuration. In addition, by virtue of the configuration, the impeller 10 can improve the pressure recover and more efficiently send air, that is, improve the air-sending efficiency. Furthermore, by virtue of the configuration, the impeller 10 can reduce a pressure loss that is caused during suction of air, thus improving the air-sending efficiency.

In the impeller 10, the first blade thickness T1 is the thickness of a blade portion having a maximum blade thickness T in a region between the first end and the blade midpoint, and the second blade thickness T2 is the thickness of a portion having a maximum blade thickness T in a region between the second end and the blade midpoint. In the impeller 10 having such a configuration, the inter-blade distance between the blades 12 increases from the inner circumferential side to the outer circumferential side, whereby the blades 12 can achieve a sufficient pressure recovery. Thus, the impeller 10 can improve a pressure recovery, as compared with an impeller and a centrifugal fan that do not have the above configuration.

In the turbo blade portion, in the end portion having the blade shape 24, the first blade thickness T1 is greater than the second blade thickness T2. In the impeller 10 having such a configuration, the inter-blade distance between the blades 12 increases from the inner circumferential side toward the outer circumferential side, whereby the blades 12 can achieve a sufficient pressure recovery. Thus, the impeller 10 can increase pressure recovery, as compared with an impeller and a centrifugal fan that do not have the above configuration. In addition, by virtue of the above configuration, the impeller 10 can achieve a pressure recovery and improve the air-sending efficiency. Furthermore, by virtue of the above configuration, the impeller 10 can reduce a pressure loss that is caused during suction of air, thus improving the air-sending efficiency.

In the impeller 10, the first blade thickness T1 is the thickness of a blade portion having a maximum blade thickness T in a region between the first end and the turbo midpoint, and the second blade thickness T2 is the thickness of a blade portion having a maximum blade thickness T in a region between the second end and the turbo midpoint. In the impeller 10 having such a configuration, the inter-blade distance between the blades 12 increases from the inner circumferential side toward the outer circumferential side, whereby the blades 12 can achieve a sufficient pressure recovery. Thus, the impeller 10 can increase a pressure recovery, as compared with an impeller and a centrifugal fan that do not have the above configuration. Furthermore, the impeller 10 having the configuration can reduce a pressure loss that is caused during suction of air, thus improving the air-sending efficiency.

In the inclined portion 141A or the inclined portion 141B, in the end portion having in the blade shape 24, the first blade thickness T1 is greater than the second blade thickness T2. In the impeller 10 having such a configuration, the inter-blade distance between the blades 12 increases from the inner circumferential side toward the outer circumferential side, whereby the blades 12 can achieve a sufficient pressure recovery. Thus, the impeller 10 can improve a pressure recovery, as compared with an impeller and a centrifugal fan that do not have the above configuration. In addition, by virtue of the configuration, the impeller 10 can achieve a pressure recovery, thus improving the air-sending efficiency.

In the impeller 10, the first blade thickness T1 is the thickness of a blade portion having a maximum blade thickness T in a region between the first end and the inclined-portion midpoint, and the second blade thickness T2 is the thickness of a blade portion having a maximum blade thickness T in a region between the second end and the inclined-portion midpoint. In the impeller 10 having such a configuration, the inter-blade distance between the blades 12 increases from the inner circumferential side toward the outer circumferential side, whereby the blades 12 can achieve a sufficient pressure recovery. Thus, the impeller 10 can improve a pressure recovery, as compared with an impeller and a centrifugal fan that do not have the above configuration. In addition, by virtue of the above configuration, the impeller 10 can achieve a pressure recovery, thus improving the air-sending efficiency.

The impeller 10 is configured such that the inclined portion 141A or the inclined portion 141B is located in each turbo blade portion. In the impeller 10, by virtue of the above configuration, it is possible to induce an air current to a region close to a location corresponding to the blade inside diameter. Thus, it is possible to further increase a suction volume and improve the air-sending efficiency.

The blades 12 are arranged such that the diameter of a circle that passes through inner ends of regions including the turbo blade portions and adjacent to the main plate 11, that is, the inside diameter of the above regions, is smaller than the diameter of a circle that passes through inner ends of regions including the turbo blade portions and adjacent to the side plate 13, that is, the inside diameter of the above regions. By virtue of the above configuration, in the impeller 10, it is possible to induce an air current to a region close to a region corresponding to the blade inside diameter, thereby increasing the suction volume, and improve the air-sending efficiency.

In the first region and the second region of each blade in the impeller 10, the proportion of the turbo blade portion to the blade in the radial direction of the impeller 10 is higher than that of the sirocco blade portion to the blade. In the impeller 10, in any region between the main plate 11 and the side plate 13, since the proportion of the turbo blade portion to the blade is high, the blades 12 can achieve a sufficient pressure recovery. Therefore, the impeller 10 can improve a pressure recovery, as compared with an impeller that does not have the above configuration. Thus, the impeller 10 can improve the efficiency of the centrifugal fan 100. Furthermore, by virtue of the above configuration, the impeller 10 can reduce separation of an air current from the leading edges in the region adjacent to the side plate 13.

In each of the blades 12 in the centrifugal fan 100, in the end portion that has the blade shape 24 and is located inward of the inner circumferential edge 46*a* of the bell mouth 46, the first blade thickness T1 of each of the blades 12 is greater than the second blade thickness T2 thereof. Thus, in the centrifugal fan 100 having such a configuration, the inter-blade distance between the blades 12 increases from the inner circumferential side toward the outer circumferential side, whereby the blades 12 can achieve a sufficient pressure recovery. The centrifugal fan 100 can improve a pressure recovery, as compared with a centrifugal fan that does not have the above configuration. By virtue of the above configuration, the centrifugal fan 100 can achieve a pressure recovery and improve the air-sending efficiency.

In the centrifugal fan 100, the first blade thickness T1 is the thickness of a blade portion having a maximum blade thickness T in a region between the first inner end and the blade midpoint, and the second blade thickness T2 is the thickness of a blade portion having a maximum blade thickness T in a region between the second outer end and the blade midpoint. Thus, in the centrifugal fan 100 having the above configuration, the inter-blade distance between the blades 12 increases from the inner circumferential side toward the outer circumferential side, whereby the blades 12 can achieve a sufficient pressure recovery. By the above configuration, the centrifugal fan 100 can increase a pressure recovery, as compared with a centrifugal fan that does not have the above configuration. By virtue of the above configuration, the centrifugal fan 100 can achieve a pressure recovery and improve the air-sending efficiency.

The centrifugal fan 100 includes the impeller 10 having the above configuration. The centrifugal fan 100 is provided with the scroll casing 40, which includes the scroll circumferential wall 44*c* and the side wall 44*a* including the bell mouth 46. The bell mouth 46 defines the casing suction port 45 which communicates with a space defined by the main plate 11 and the blades 12. The scroll casing 40 accommodates the impeller 10. By virtue of the above configuration, the centrifugal fan 100 can obtain the same advantages as the impeller 10.

Embodiment 2

[Centrifugal Fan 100]

Figure 23:
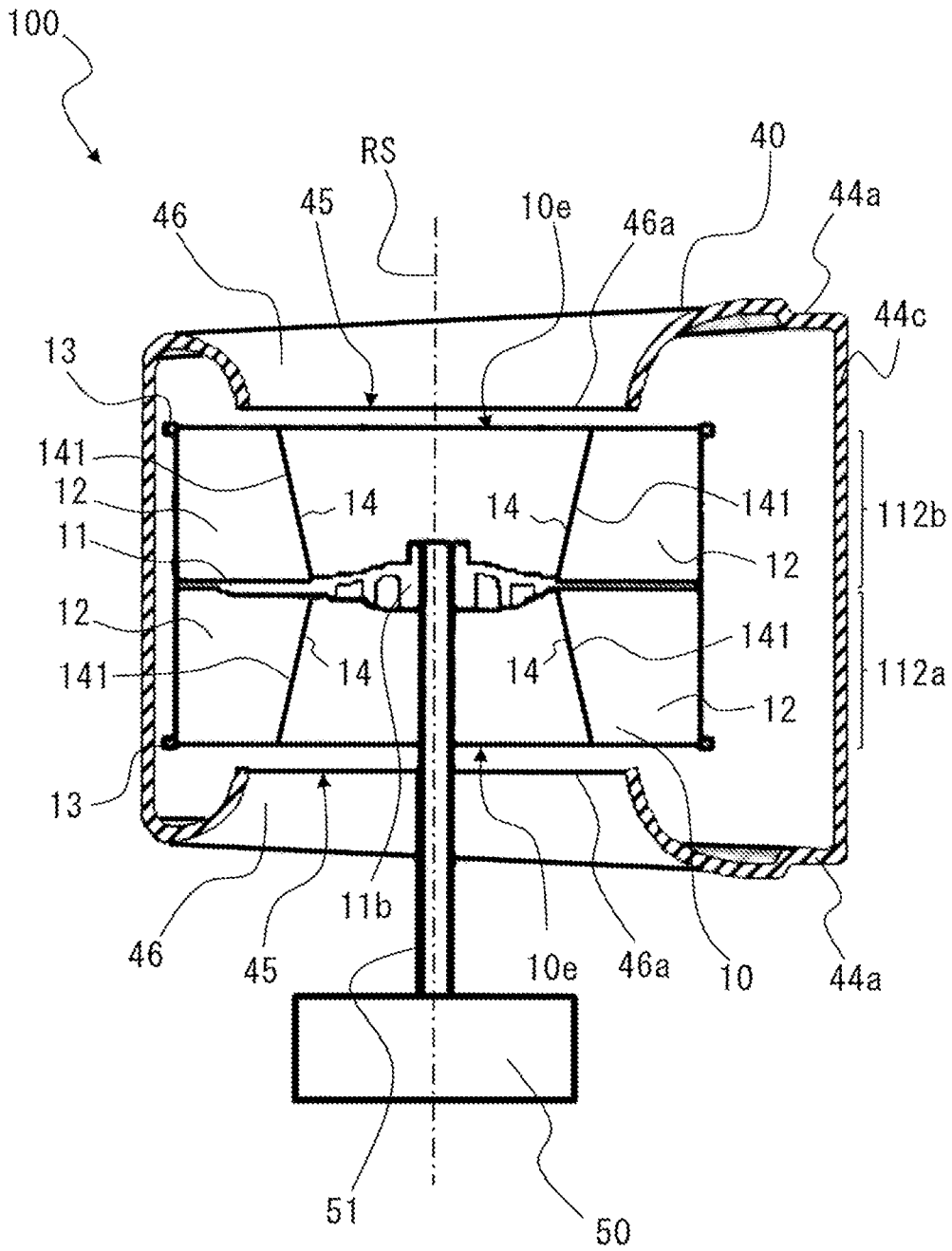
FIG. 23 is a conceptual diagram illustrating an internal configuration of a centrifugal fan according to Embodiment 2.

FIG. 23 is a conceptual diagram illustrating an internal configuration of a centrifugal fan 100 according to Embodiment 2. Regarding Embodiment 2, components that are the same as in those of the impeller 10 and the centrifugal fan 100 as illustrated in FIGS. 1 to 22 will be denoted by the same reference signs, and their descriptions will thus be omitted. The centrifugal fan 100 according to Embodiment 2 has specific features regarding each inner peripheral end 14 of the impeller 10.

The blades 12 of the impeller 10 each have the inclined portion 141, in which the inner peripheral end 14 is inclined in a direction away from the rotation axis RS such that the blade inside diameter increases from the main plate 11 toward the side plate 13. The "inclined portion 141" is a generic term for an inclined portion 143, a first inclined portion 144, a second inclined portion 145, an inclined portion 146, a first inclined portion 147, and a second inclined portion 148, which will be described later.

In the case where the blades 12 include the first blades 12A only, the inner peripheral ends 14 are the inner peripheral ends 14A as illustrated in FIG. 10, and the inclined portions 141 are the inclined portions 141A of the inner peripheral ends 14A of the first blades 12A as illustrated in FIG. 3. The inclined portions 141A each form the leading edge 14A1 as illustrated in FIG. 4. The leading edges 14A1 are thus inclined in the direction away from the rotation axis RS such that the blade inside diameter increases from the main plate 11 toward the side plate 13. As illustrated in FIG. 23, the inclined portions 141 are provided, and the blades 12 thus have an inclination on the inner circumferential side.

The inclined portions 141 may be formed at the second blades 12B which are provided as illustrated in FIG. 3. In this case, the inner peripheral ends 14 are the inner peripheral ends 14B as illustrated in FIG. 10, and the inclined portions 141 are the inclined portions 141B of the second blades 12B as illustrated in FIG. 3. The inclined portions 141B each form the leading edge 14B1 as illustrated in FIG. 4. The leading edge 14B1 is inclined in the direction away from the rotation axis RS such that the blade inside diameter gradually increases from the main plate 11 toward the side plate 13.

Figure 24:
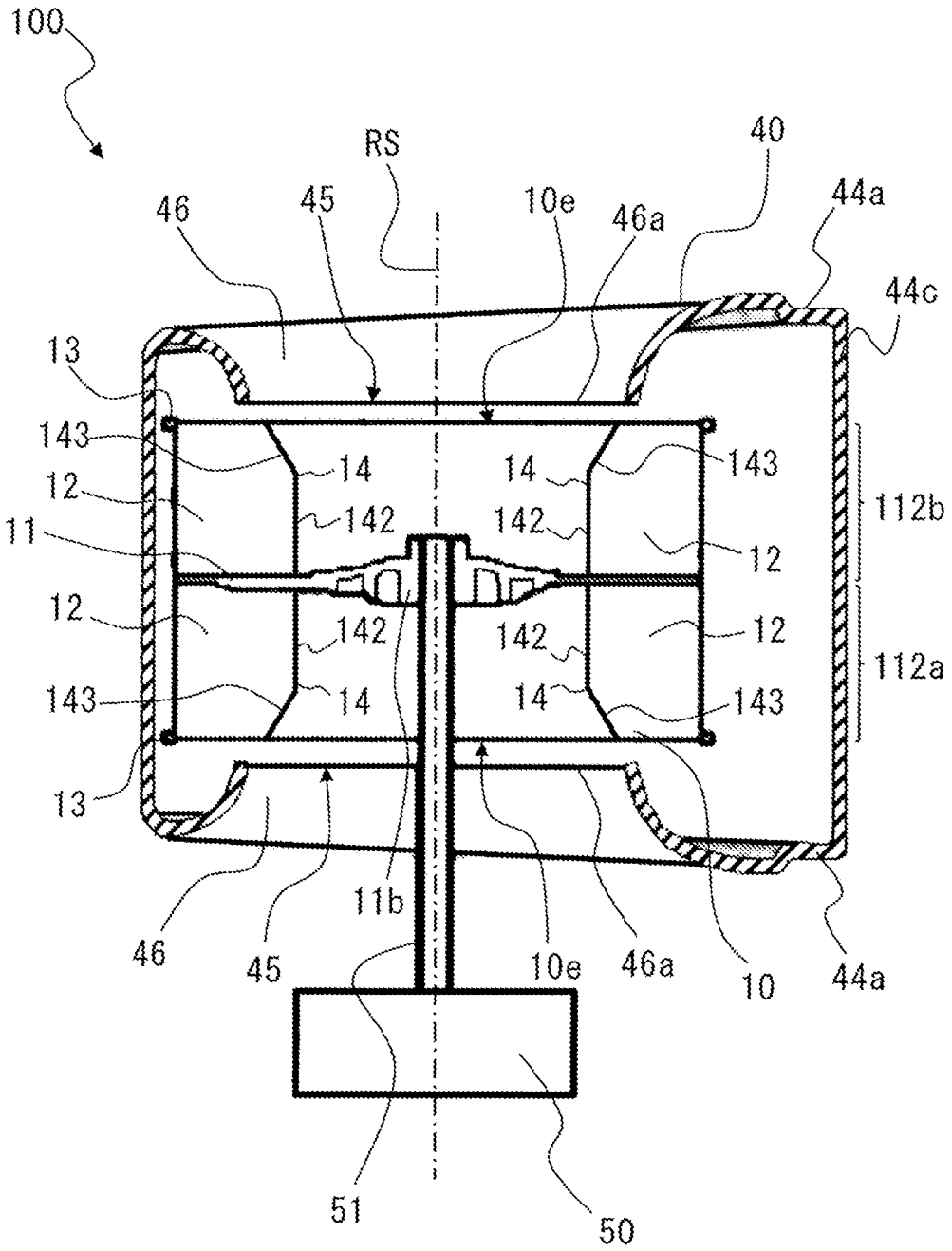
FIG. 24 is a conceptual diagram illustrating an internal configuration of a first modification of the centrifugal fan according to Embodiment 2.

FIG. 24 is a conceptual diagram illustrating an internal configuration of a first modification of the centrifugal fan 100 according to Embodiment 2. In the first modification, the blades 12 of the impeller 10 each have the inclined portion 143 in which the inner peripheral end 14 is inclined in the direction away from the rotation axis RS such that the blade inside diameter gradually increases in the direction from the main plate 11 toward the side plate 13.

In the first modification, the blades 12 of the impeller 10 each have a straight portion 142 in which the blade inside diameter is unchanged in the direction from the main plate 11 toward the side plate 13. In the straight portion 142, the inner peripheral end 14 of the blade 12 extends along the rotation axis RS. Therefore, in the first modification, the impeller 10 includes the straight portions 142 and the inclined portions 143, and the inner peripheral end 14 of each blade 12 has the straight portion 142 and the inclined portion 143.

The impeller 10 includes the straight portions 142 located adjacent to the main plate 11 and the inclined portions 143 located adjacent to the side plates 13 in the axial direction along the rotation axis RS. Therefore, the blade inside diameter of part of the impeller 10 that is adjacent to each side plate 13 is larger than that of part of the impeller 10 that is adjacent to the main plate 11 as the impeller 10 is viewed as a whole. The inner peripheral end 14 having the straight portion 142 and the inclined portion 143 may be the inner peripheral end 14A of the first blade 12A or the inner peripheral end 14B of the second blade 12B, which are provided as illustrated in FIG. 10.

Figure 25:
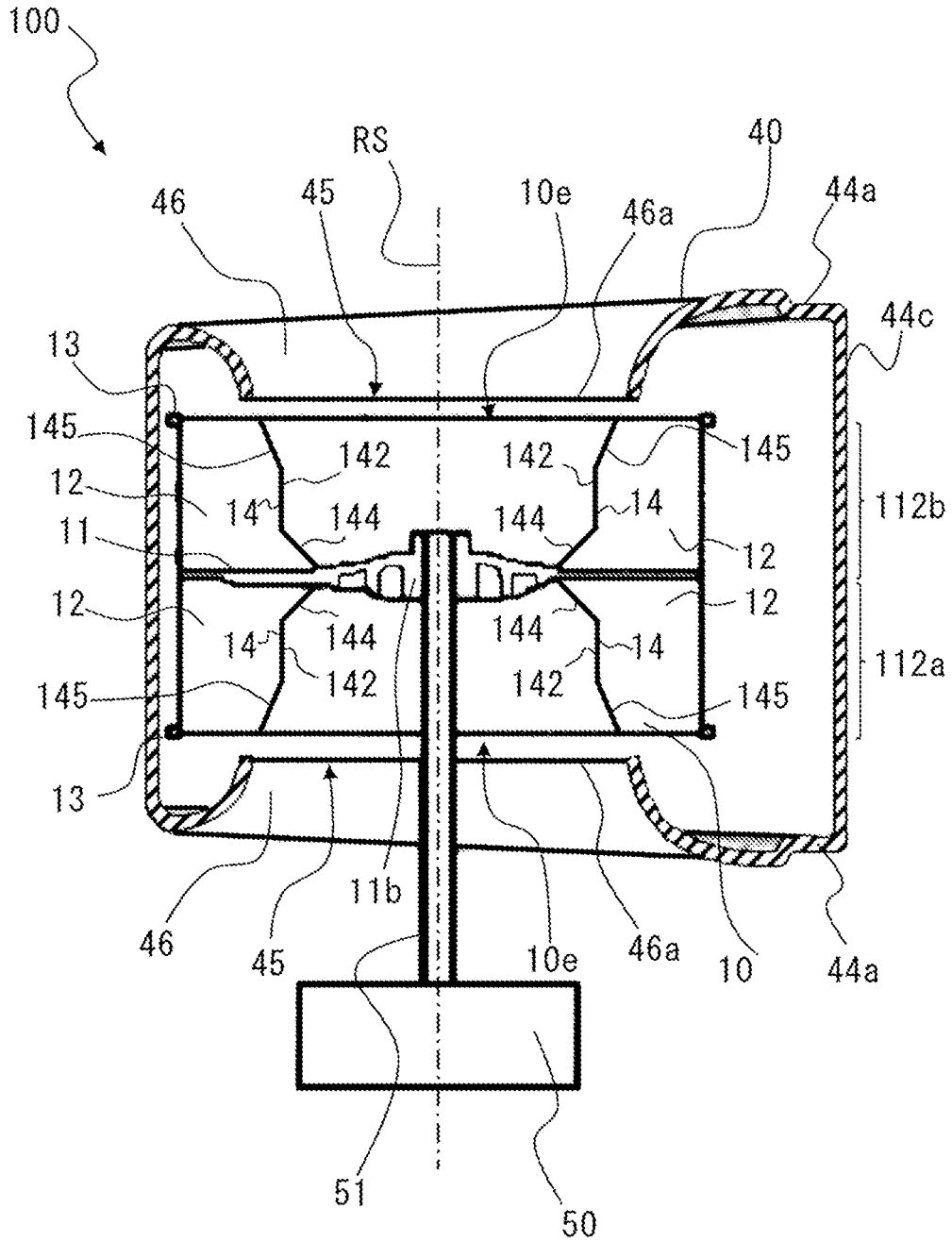
FIG. 25 is a conceptual diagram illustrating an internal configuration of a second modification of the centrifugal fan according to Embodiment 2.

FIG. 25 is a conceptual diagram illustrating an internal configuration of a second modification of the centrifugal fan 100 according to Embodiment 2. In the second modification, the blades 12 of the impeller 10 each have the first inclined portion 144 in which the inner peripheral end 14 is inclined in the direction away from the rotation axis RS such that the blade inside diameter gradually increases from the main plate 11 toward the side plate 13.

In the second modification, the blades 12 of the impeller 10 each have the straight portion 142 in which the blade inside diameter is unchanged in the direction from the main plate 11 toward the side plate 13. In the straight portion 142, the inner peripheral end 14 of the blade 12 extends along the rotation axis RS.

Furthermore, in the second modification, the blades 12 of the impeller 10 each have the second inclined portion 145 in which the inner peripheral end 14 is inclined in the direction away from the rotation axis RS such that the blade inside diameter gradually increases in the direction from the main plate 11 toward the side plate 13.

In the second modification, the impeller 10 includes the first inclined portions 144, the straight portions 142, and the second inclined portions 145. The inner peripheral end 14 of each blade 12 has the first inclined portion 144, the straight portion 142, and the second inclined portion 145. The angle of inclination of the first inclined portion 144 relative to the axial direction along the rotation axis RS may be equal to or different from that of the second inclined portion 145 relative to the axial direction along the rotation axis RS.

In the impeller 10, in the axial direction along the rotation axis RS, the first inclined portion 144, the straight portion 142, and the second inclined portion 145 are arranged in this order in the direction from the main plate 11 toward the side plate 13. That is, each blade 12 has the first inclined portion 144 located adjacent to the main plate 11 and the second inclined portion 145 located adjacent to the side plate 13 such that the straight portion 142 is located between the first inclined portion 144 and the second inclined portion 145. Therefore, the blade inside diameter of part of the impeller 10 that is adjacent to the side plate 13 is larger than that of part of the impeller 10 that is adjacent to the main plate 11 as the impeller 10 is viewed as a whole. The inner peripheral end 14 having the first inclined portion 144, the straight portion 142, and the second inclined portion 145 may be the inner peripheral end 14A of the first blade 12A or the inner peripheral end 14B of the second blade 12B as illustrated in FIG. 10.

Figure 26:
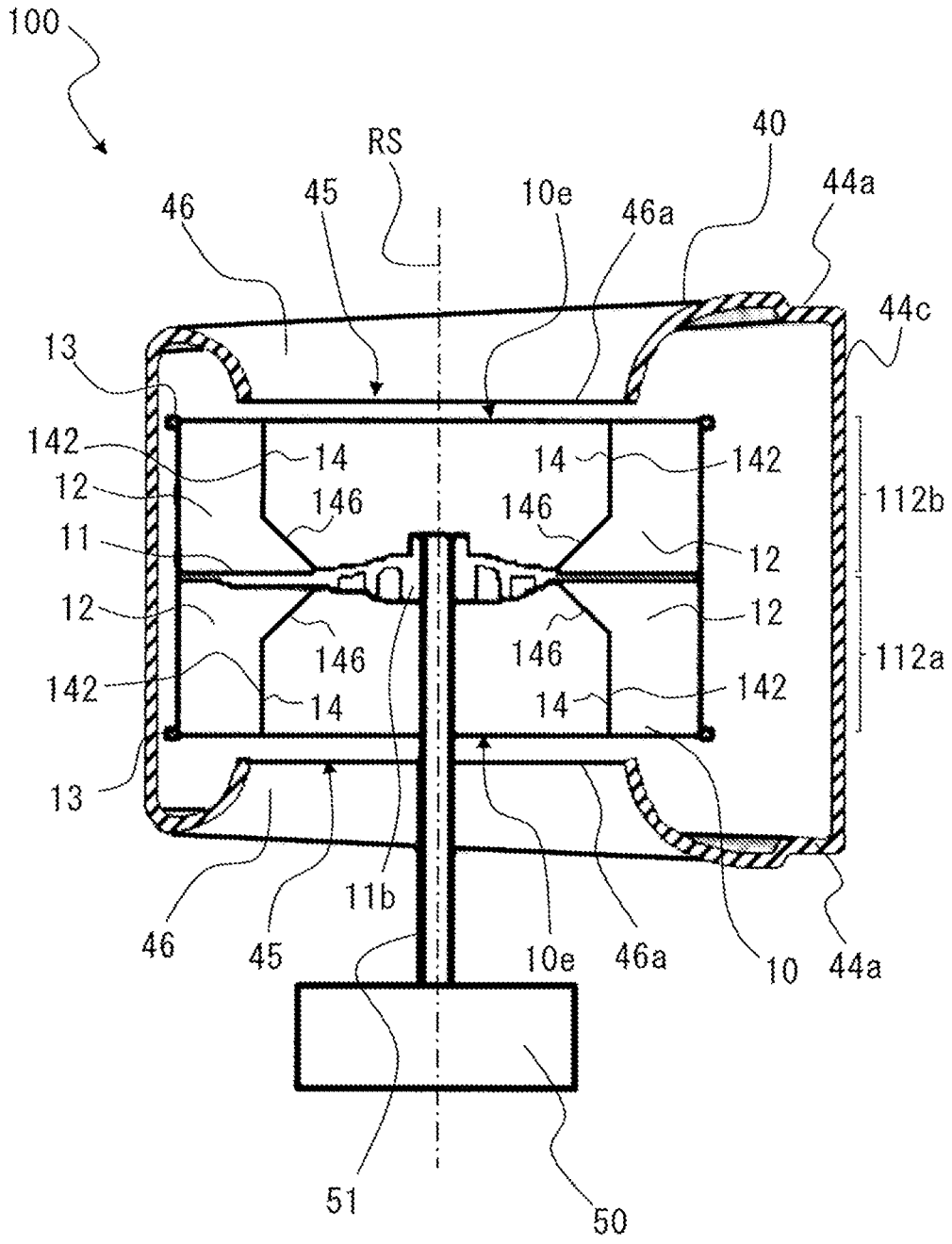
FIG. 26 is a conceptual diagram illustrating an internal configuration of a third modification of the centrifugal fan according to Embodiment 2.

FIG. 26 is a conceptual diagram illustrating an internal configuration of a third modification of the centrifugal fan 100 according to Embodiment 2. In the third modification, the blades 12 of the impeller 10 each have the inclined portion 146 in which the inner peripheral end 14 is inclined in the direction away from the rotation axis RS such that the blade inside diameter gradually increases from the main plate 11 toward the side plate 13.

In the third modification, the blades 12 of the impeller 10 each have the straight portion 142 in which the blade inside diameter is unchanged in the direction from the main plate 11 toward the side plate 13. In the straight portion 142, the inner peripheral end 14 of the blade 12 extends along the rotation axis RS. Therefore, in the third modification, the impeller 10 has the straight portions 142 and the inclined portions 146, and the inner peripheral end 14 of each blade 12 has the straight portion 142 and the inclined portion 146.

The impeller 10 includes the inclined portions 146 located adjacent to the main plate 11 and the straight portions 142 located adjacent to the side plates 13 in the axial direction along the rotation axis RS. Therefore, the blade inside diameter of part of the impeller 10 that is adjacent to each side plate 13 is larger than that of part of the impeller 10 that is adjacent to the main plate 11 as the impeller 10 is viewed as a whole. It should be noted that the inner peripheral end 14 having the inclined portion 146 and the straight portion 142 may be the inner peripheral end 14A of the first blade 12A or the inner peripheral end 14B of the second blade 12B as illustrated in FIG. 10.

As illustrated in FIGS. 24 to 26 relating to the first to third modifications, the blades 12 included in the impeller 10 each have one or more inclined portions 141 in each of which the inner peripheral end 14 is inclined in the direction away from the rotation axis RS, and the straight portion 142 in which the inner peripheral end 14 extends along the rotation axis.

Figure 27:
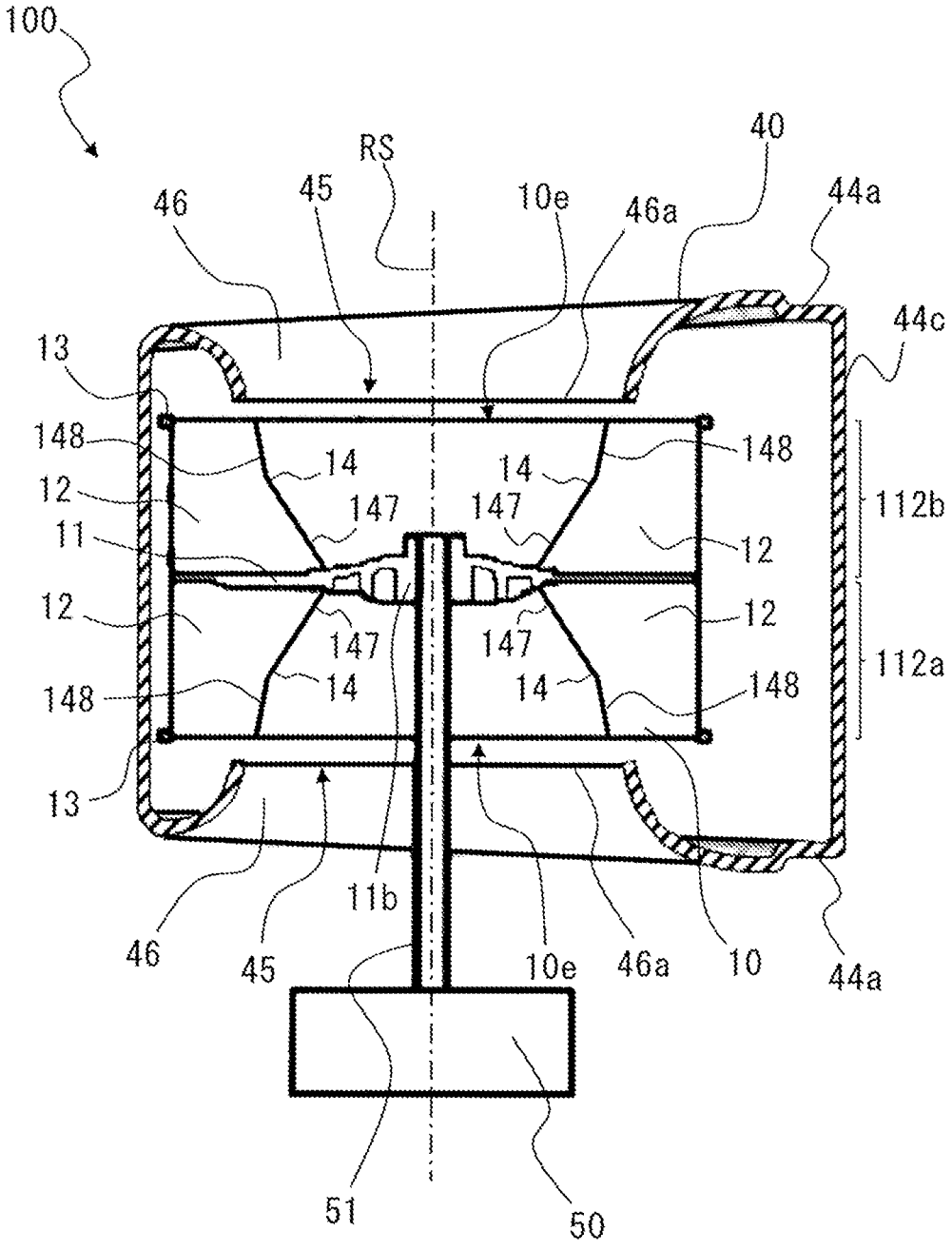
FIG. 27 is a conceptual diagram illustrating an internal configuration of a fourth modification of the centrifugal fan according to Embodiment 2.

FIG. 27 is a conceptual diagram illustrating an internal configuration of a fourth modification of the centrifugal fan 100 according to Embodiment 2. In the fourth modification, the blades 12 of the impeller 10 each have the first inclined portion 147 in which the inner peripheral end 14 is inclined in the direction away from the rotation axis RS such that the blade inside diameter gradually increases from the main plate 11 toward the side plate 13.

In the fourth modification, the blades 12 of the impeller 10 each have the second inclined portion 148 in which the inner peripheral end 14 is inclined in the direction away from the rotation axis RS such that the blade inside diameter gradually increases in the direction from the main plate 11 to the side plate 13.

In the fourth modification, the impeller 10 has the first inclined portions 147 and the second inclined portions 148, and the inner peripheral end 14 of each blade 12 has the first inclined portion 147 and the second inclined portion 148. The angle of inclination of the first inclined portion 147 relative to the axial direction along the rotation axis RS is different from that of the second inclined portion 148 relative to the axial direction along the rotation axis RS. Therefore, the blades 12 each have two or more different types of inclined portions 141 having different inclination angles.

The impeller 10 has the first inclined portions 147 located adjacent to the main plate 11 and the second inclined portions 148 located adjacent to the side plates 13 in the axial direction along the rotation axis RS. Therefore, as the impeller 10 is viewed as a whole, the blade inside diameter of part of the impeller 10 that is adjacent to each side plate 13 is larger than that of part of the impeller 10 that is adjacent to the main plate 11. It should be noted that the inner peripheral end 14 having the first inclined portion 147 and the second inclined portion 148 may be the inner peripheral end 14A of the first blade 12A or the inner peripheral end 14B of the second blade 12B as illustrated in FIG. 10.

The centrifugal fan 100 according to Embodiment 2 includes, as illustrated in FIGS. 23 to 27, the impeller 10 as described regarding Embodiments 1 and 2, the scroll casing 40 which accommodates the impeller 10, and a motor 50 that is provided outside the scroll casing 40 and connected to the main plate 11.

The motor 50 is provided adjacent to the side wall 44*a* of the scroll casing 40. A motor shaft 51 is connected to the main plate 11 and serves as a rotation shaft of the main plate 11. The axis of the motor shaft 51 of the motor 50 is coincident with the rotation axis RS of the impeller 10, and the motor shaft 51 extends through a side surface of the scroll casing 40, and is inserted in the scroll casing 40.

The main plate 11 extends along the side wall 44*a* of the scroll casing 40, which is located adjacent to the motor 50, and is provided to extend perpendicular to the rotation axis RS. The main plate 11 includes, at its central portion, the boss 11*b* connected to the motor shaft 51. The motor shaft 51 inserted in the scroll casing 40 is fixed to the boss 11*b* of the main plate 11. The motor shaft 51 of the motor 50 is connected to and fixed to the main plate 11 of the impeller 10.

When the motor 50 is driven, the blades 12 are rotated around the rotation axis RS, with the motor shaft 51 and the main plate 11 interposed between the motor 50 and the blades 12. As a result, outside air is sucked into the impeller 10 through the casing suction ports 45. The air is pressurized by the impeller 10 and is then blown into the scroll casing 40. The air blown in the scroll casing 40 decreases in velocity in an enlarged air passage defined by the circumferential wall 44*c* of the scroll casing 40, thus recovering its static pressure. The air is then blown out of the scroll casing 40 through the discharge port 42*a* as illustrated in FIG. 1.

As illustrated in FIGS. 23 to 27, the blades 12 include the first blade portion 112*a* located at one surface of the main plate 11 and the second blade portion 112*b* located at the other surface of the main plate 11 (see FIG. 9). It should be noted that as described above, the inter-blade distance is the distance between any adjacent two of the blades 12 that are adjacent to each other in the circumferential direction CD. In the impeller 10, the inter-blade distance in the first blade portion 112*a* which is located adjacent to the motor 50 is greater than that in the second blade portion 112*b* which is located on a side of the main plate 11 that is located opposite to the motor 50.

[Advantages of Impeller 10 and Centrifugal Fan 100]

The blades 12 each have the one or more inclined portions 141 and the straight portion 142 in which the inner peripheral end 14 extends along the rotation axis RS. The impeller 10 having such a configuration can cause an air current to be induced to a region close to the part having the blade inside diameter, whereby the suction volume can be further increased, and the air-sending efficiency can be improved.

The blades 12 each have the two or more different types of inclined portions 141 having different inclination angles. The impeller 10 having such a configuration can cause an air current to be induced to the region close to the part having the blade inside diameter, whereby the suction volume can be further increased, and the air-sending efficiency can be improved.

In the centrifugal fan 100, the inter-blade distance at the first blade portion 112*a* located adjacent to the motor 50 is greater than that at the second blade portion 112*b* located on a side of the main plate 11 that is located opposite to the motor 50. In general, in a centrifugal fan, a suction port of the fan is reduced by a motor provided adjacent to the suction port, thus reducing the volume of air current to be sucked. In particular, in a double suction type centrifugal fan in which blades protrude toward an inner circumferential side of a bell mouth, and a motor is provided outside a fan casing of the centrifugal fan, the area of suction on a side of the fan that is located adjacent to the motor is reduced, thus increasing a loss. By contrast, in the centrifugal fan 100, since the inter-blade distance between blades 12 located adjacent to the motor 50 is increased, the volume of air to be sucked can be increased, and the air-sending efficiency can be thus improved.

The centrifugal fan 100 includes the impeller 10 having the above configuration. The centrifugal fan 100 includes the scroll casing 40, which accommodates the impeller 10 and which includes the scroll circumferential wall 44*c* and the side wall 44*a* having the bell mouth 46 defining the casing suction port 45 that communicates with a space defined by the main plate 11 and the blades 12. Therefore, the centrifugal fan 100 can obtain the same advantages as the above impeller 10.

Embodiment 3

[Centrifugal Fan 100]

Figure 28:
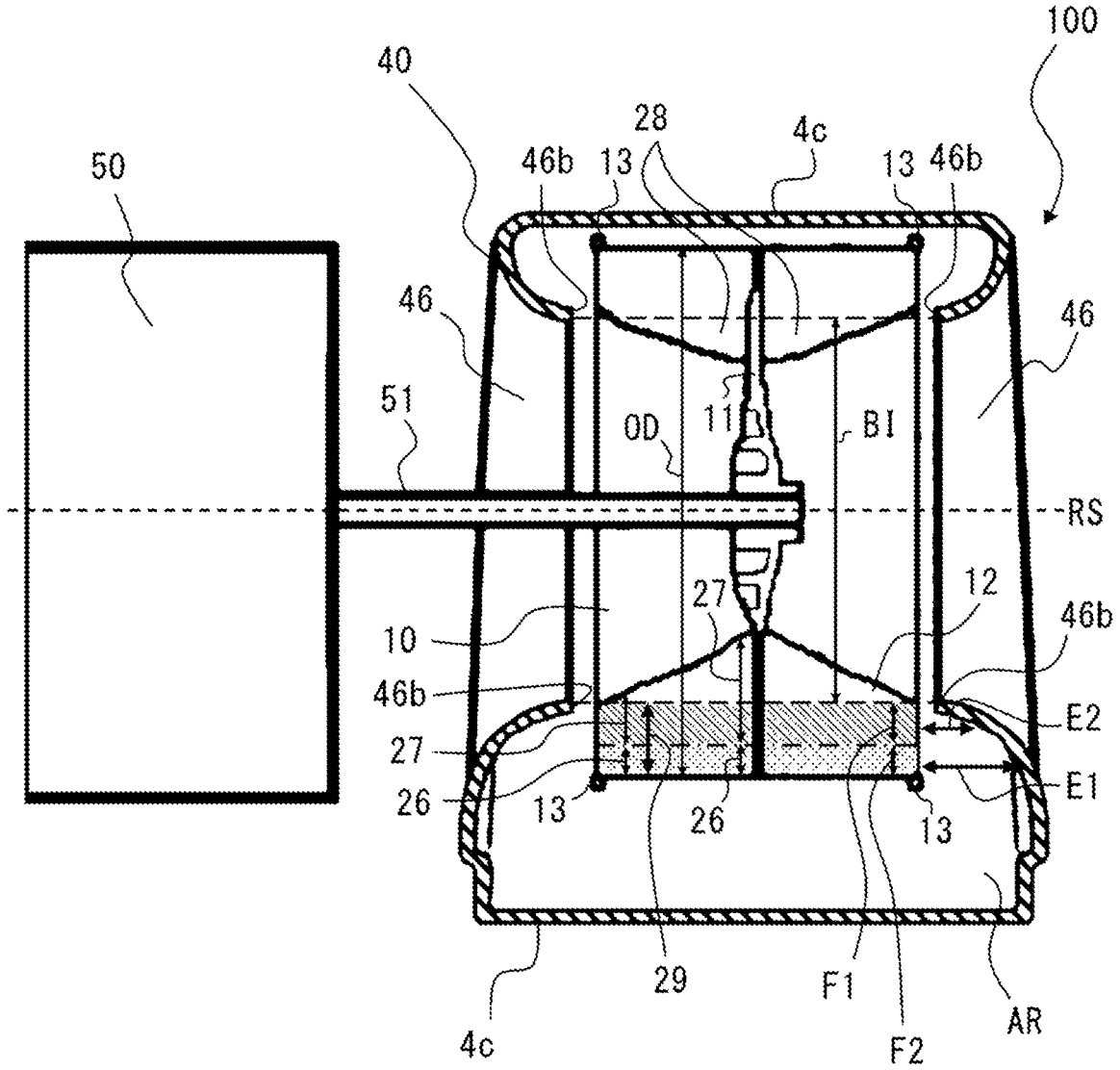
FIG. 28 is a schematic sectional view of a centrifugal fan according to Embodiment 3.

FIG. 28 is a schematic sectional view of a centrifugal fan 100 according to Embodiment 3. Regarding Embodiment 3, components that are the same as those of the impellers 10 and the centrifugal fans 100 as illustrated in FIGS. 1 to 27 will be denoted by the same reference signs, and their descriptions will thus be omitted. Regarding the centrifugal fan 100 according to Embodiment 3, an example of a relationship between the blades 12 of the impeller 10 and the bell mouth 46 will be described. The "sirocco blade portion 26", whose illustration is provided in FIG. 28, is a generic term for the first sirocco blade portion 12A1 and the second sirocco blade portion 12B1, and the "turbo blade portion 27" is a generic term for the first turbo blade portion 12A2 and the second turbo blade portion 12B2.

The blades 12 are arranged such that the blade outside diameter OD of a circle that passes through the outer peripheral ends of the blades is larger than the inside diameter BI of the bell mouth 46. An inner-circumferential-side end 46*b*, which is an end of the bell mouth 46 that is located adjacent to the inner circumferential side, faces the blades 12 of the impeller 10 in the axial direction along the rotation axis RS. The inner-circumferential-side end 46*b* forms an edge of the bell mouth 46 that is located adjacent to the inner circumferential side. It should be noted that a portion of each of the blades 12 that is located closer to the outer circumferential side than a location corresponding to the inside diameter BI of the inner-circumferential-side end 46*b* of the bell mouth 46 in the radial direction from the rotation axis RS will be referred to as an outer blade portion 29. The outer blade portion 29 has the sirocco blade portion 26 located on the outer circumferential side of the impeller 10 and the turbo blade portion 27 located on the inner circumferential side of the impeller 10.

As illustrated in FIG. 28, the blades 12 each have an inner blade portion 28 that protrudes inward of the inner-circumferential-side end 46*b* of the bell mouth 46 in the radial direction from the rotation axis RS. The inner blade portion 28 is located in an internal space in the bell mouth 46 that is defined by an inner part thereof that has the inside diameter B1 in the radial direction from the rotation axis RS.

As indicated in FIG. 28, the distance between the sirocco blade portion 26 and the bell mouth 46 in the axial direction along the rotation axis RS in the scroll casing 40 will be referred to as a first distance E1. Furthermore, the distance between the turbo blade portion 27 and the bell mouth 46 in the axial direction along the rotation axis RS in the scroll casing 40 will be referred to as a second distance E2. The outer blade portion 29 and the bell mouth 46 in the centrifugal fan 100 are formed such that the first distance E1 is greater than the second distance E2 (first distance E1>second distance E2).

As illustrated in FIG. 28, the outer blade portion 29 is formed such that a first length F1, which is the length of the turbo blade portion 27 in the radial direction, is greater than a second length F2, which is the length of the sirocco blade portion 26 in the radial direction.

[Advantages of Centrifugal Fan 100]

Figure 29:
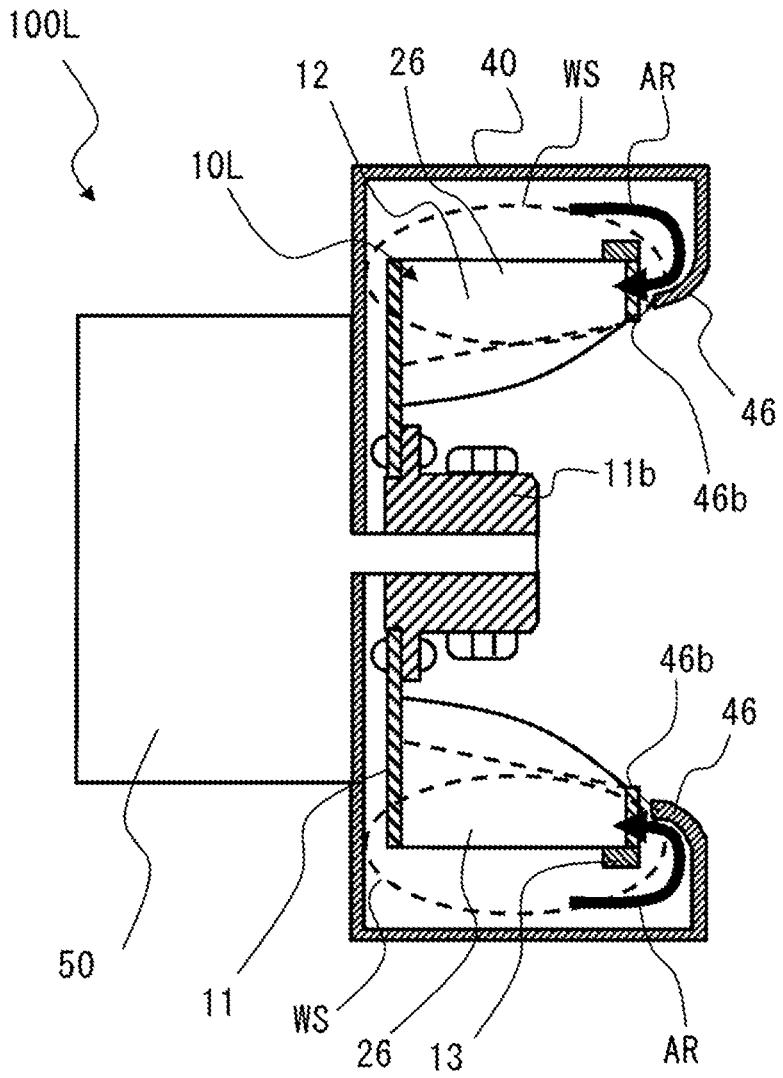
FIG. 29 is a sectional view of a centrifugal fan of a comparative example.

FIG. 29 is a sectional view of a centrifugal fan 100L of a comparative example. In an existing centrifugal fan, in the case where an impeller 10 is a resin molded product, a side plate 13 is annularly formed and provided on outer circumferential side of an impeller 10L, as illustrated in FIG. 29, in order to ensure that the side plate 13 can be reliably removed from a mold. In the centrifugal fan 100L including the impeller 10L having such a configuration, an air current AR blown out from the impeller 10L in the radial direction flows around the side plate 13 to the outside, flows along an inner side surface of the bell mouth 46, and re-flows into the impeller 10L.

In the centrifugal fan 100L of the comparative example, a portion of each blade 12 that is located in an area WS and that is located closer to the outer circumferential side than the inner-circumferential-side end 46*b* of the bell mouth 46 corresponds to a portion that forms the sirocco blade portion 26. In the centrifugal fan 100L having such a configuration, when an air current AR that is blown out of the impeller 10L and flows along the inner surface of the bell mouth 46 re-flows into the impeller 10L, the air current AR collides with the sirocco blade portions 26, each of which has a large outlet angle and causes an increase in the inflow velocity of the air current. Thus, in the impeller 10L, the collision of the air current AR that re-flows into the impeller 10L with the sirocco blade portions 26 causes noise from the centrifugal fan 100L and also causes input deterioration. The input deterioration causes a resistance that is applied to the air current when the air current rotates the impeller in the case where the air current re-flows to the sirocco blade portions 26. As a result, the loss increases, and power consumption increases.

In contrast, the centrifugal fan 100 according to Embodiment 3 is configured such that each outer blade portion 29 includes the sirocco blade portion 26 located on the outer circumferential side of the impeller 10 and the turbo blade portion 27 located on the inner circumferential side of the impeller 10. Furthermore, in the centrifugal fan 100 according to Embodiment 3, the outer blade portion 29 and the bell mouth 46 are formed such that the first distance E1 is greater than the second distance E2. In the centrifugal fan 100 having such a configuration, an air current AR that flows along the inner surface of the bell mouth 46 and re-flows into the impeller 10 collides with the turbo blade portions 27, each of which has a small outlet angle and causes a decreases in inflow velocity of the air current. As a result, the centrifugal fan 100 reduces noise that is made by the blades 12 and the air current AR when the air current that flows along the inner surface of the bell mouth 46 re-flows into the impeller 10, and also reduces input deterioration.

Each of the outer blade portions 29 of the centrifugal fan 100 according to Embodiment 3 is formed such that the first length F1, which is the length of the turbo blade portion 27 in the radial direction, is greater than the second length F2, which is the length of the sirocco blade portion 26 in the radial direction. The centrifugal fan 100 according to Embodiment 3 has the above advantages and in addition have the above configuration, and can thus reduce a loss that is caused by the flow of air to the sirocco blade portion 26.

Embodiment 4

Figure 30:
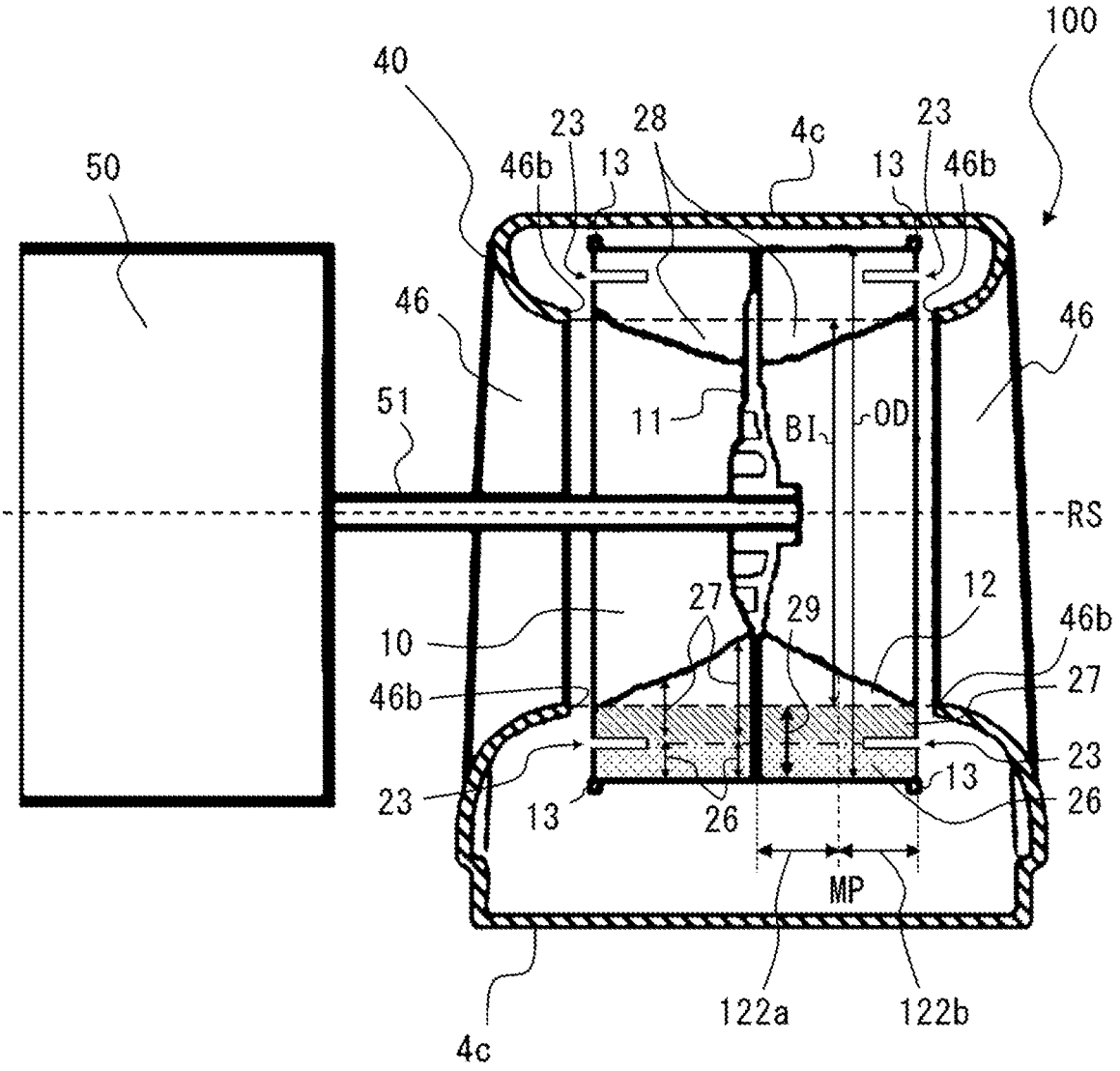
FIG. 30 is a schematic sectional view of a centrifugal fan according to Embodiment 4.
Figure 31:
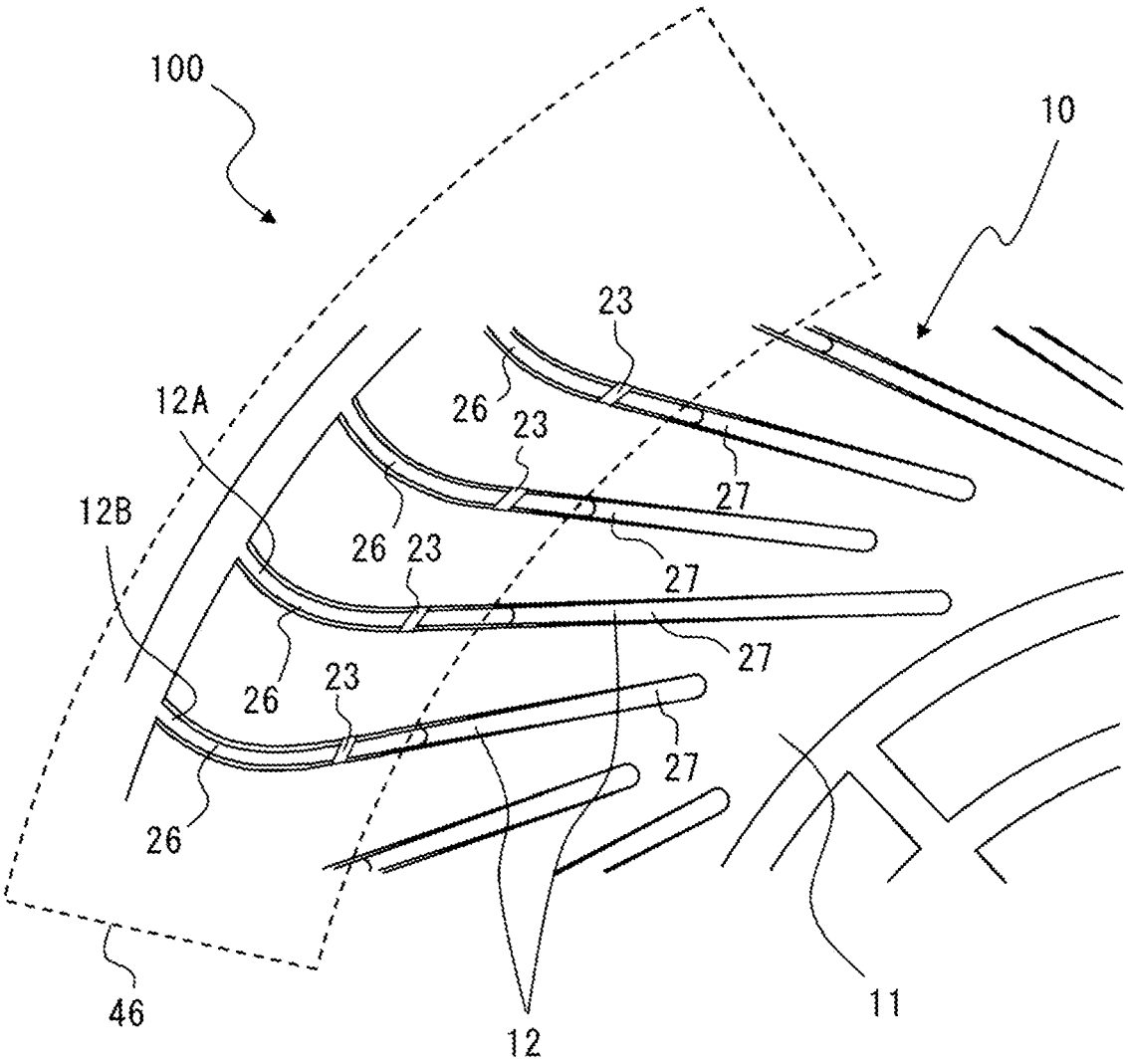
FIG. 31 is an enlarged view of part of an impeller of the centrifugal fan according to Embodiment 4 that corresponds to the area E of the impeller as illustrated in FIG. 6.

FIG. 30 is a schematic sectional view of a centrifugal fan 100 according to Embodiment 4. FIG. 31 is an enlarged view of a portion of an impeller 10 of the centrifugal fan 100 according to Embodiment 4, which corresponds to the area E of the impeller 10 as illustrated in FIG. 6. Regarding Embodiment 4, components that are the same components as those of the centrifugal fans 100 as illustrated in FIGS. 1 to 29 will be denoted by the same reference signs, and their descriptions will thus be omitted. The centrifugal fan 100 according to Embodiment 4 has further specific features regarding the configurations of the impellers 10 of the centrifugal fans 100 according to Embodiments 1 to 3.

As illustrated in FIGS. 30 and 31, in the side-plate-side blade region 122*b*, which is the second region, at each blade 12, the turbo blade portion 27 is separate from the sirocco blade portion 26. The blade 12 has a separation 23 located between the turbo blade portion 27 and the sirocco blade portion 26 in the radial direction from the rotation axis RS.

The separation 23 is a through-hole that extends through the blade 12 in the radial direction from the rotation axis RS, and is a recess that is recessed toward the main plate 11 from an end of the blade 12 that is located adjacent to the side plate 13, in the axial direction along the rotation axis RS. The separation 23 is provided only in the side-plate-side blade region 122*b*, which is the second region.

[Advantages of Centrifugal Fan 100]

In the centrifugal fan 100 according to Embodiment 4, since the turbo blade portion 27 and the sirocco blade portion 26 are separated from each other, it is possible to reduce a loss that is caused by the flow of air to the sirocco blade portion 26. In the centrifugal fan 100 according to Embodiment 4, an air current leaking from the turbo blade portion 27 separated from the sirocco blade portion 26 can be recovered at the sirocco blade portion 26. In such a manner, separation of the turbo blade portion 27 and the sirocco blade portion 26 can also reduce the loss. The centrifugal fan 100 according to Embodiment 4 has a configuration similar to those of the centrifugal fans 100 according to Embodiments 1 to 3, and thus obtains advantages similar to those of the centrifugal fans 100 according to Embodiments 1 to 3.

Embodiment 5

Figure 32:
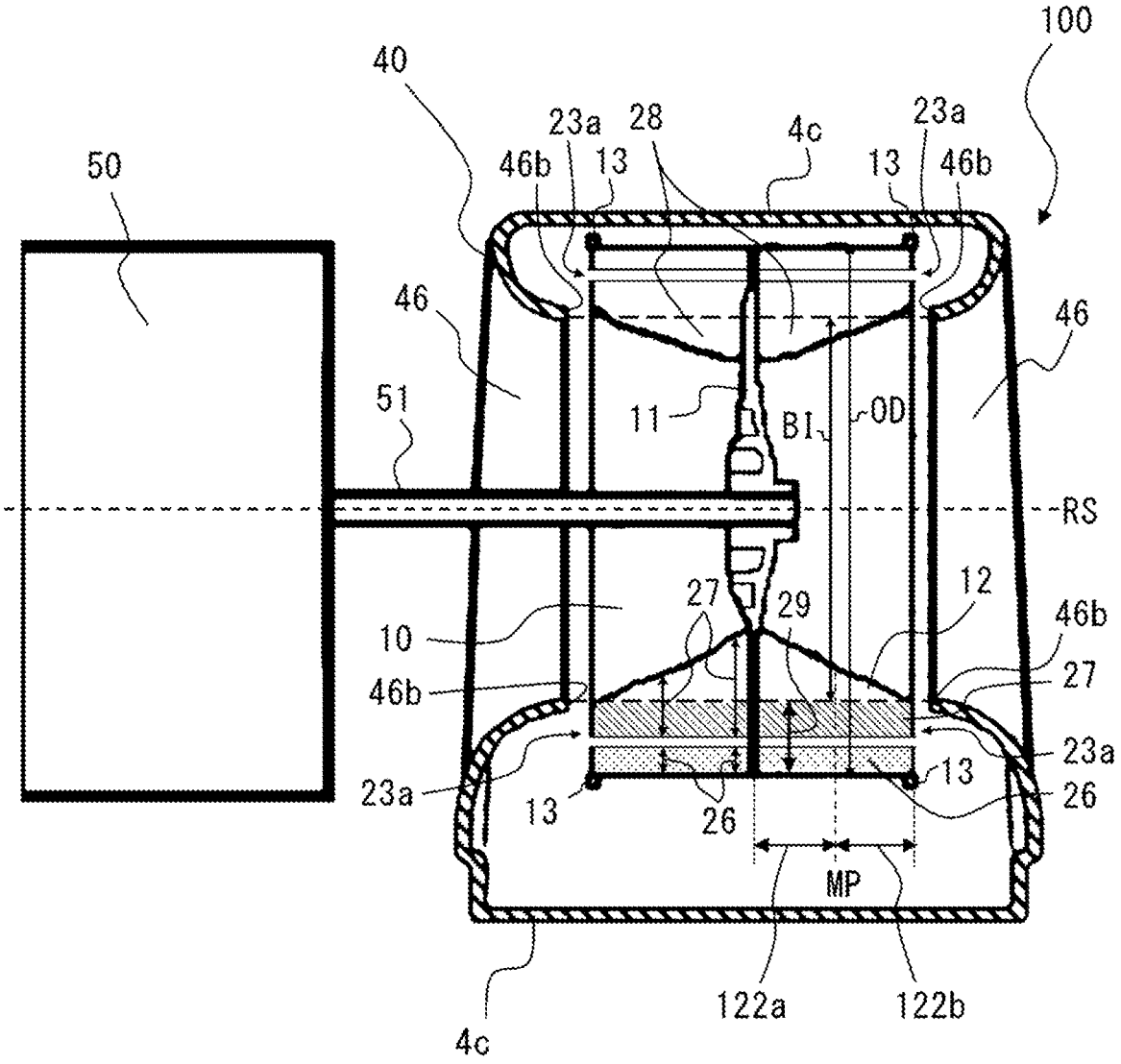
FIG. 32 is a schematic sectional view of a centrifugal fan according to Embodiment 5.
Figure 33:
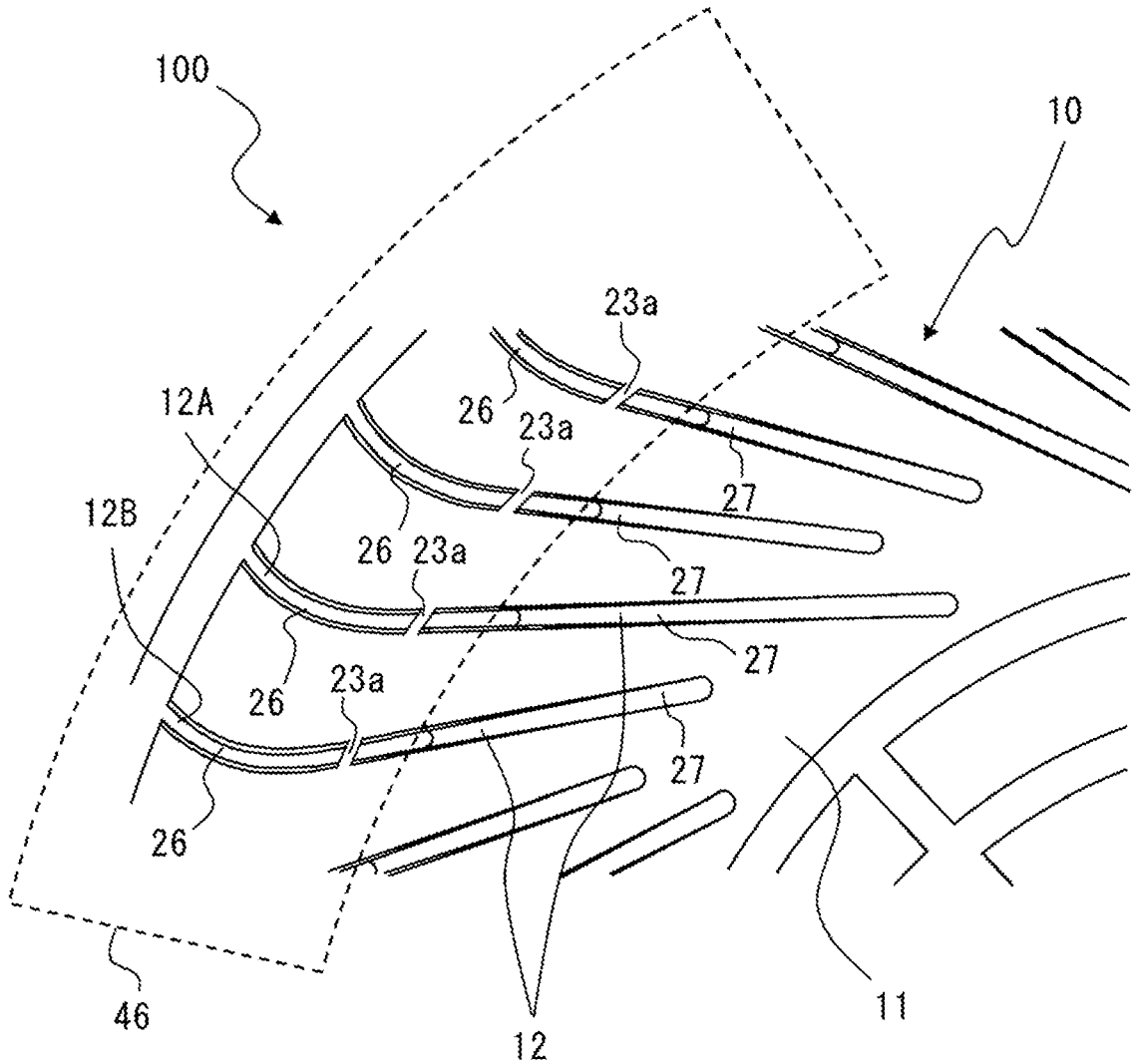
FIG. 33 is an enlarged view of part of an impeller of the centrifugal fan according to Embodiment 5 that corresponds to the area E of the impeller as illustrated in FIG. 6.

FIG. 32 is a schematic sectional view of a centrifugal fan 100 according to Embodiment 5. FIG. 33 is an enlarged view of a portion of an impeller 10 of the centrifugal fan 100 according to Embodiment 5, which corresponds to the area E of the impeller 10 of FIG. 6. Regarding Embodiment 5, components that are the same as those in the centrifugal fans 100 as illustrated in FIGS. 1 to 31 will be denoted by the same reference signs, and their descriptions will thus be omitted. The centrifugal fan 100 according to Embodiment 5 has further specific features regarding the configurations of the impellers 10 of the centrifugal fans 100 according to Embodiments 1 to 3.

As illustrated in FIGS. 32 and 33, in the main-plate-side blade region 122*a* which is the first region and the side-plate-side blade region 122*b* which is the second region, of each blade 12, the turbo blade portion 27 is separate from the sirocco blade portion 26. The blade 12 has a separation 23*a* that is located between the turbo blade portion 27 and the sirocco blade portion 26 in the radial direction from the rotation axis RS.

The separation 23*a* is a through-hole that extends through the blade 12 in the radial direction from the rotation axis RS, and is also a recess that is recessed toward the main plate 11 from an end of the blade 12 that is located adjacent to the side plate 13 in the axial direction along the rotation axis RS. The separation 23*a* is located in the main-plate-side blade region 122*a* corresponding to the first region and the side-plate-side blade region 122*b* corresponding to the second region. The bottom of the separation 23*a* in the axial direction along the rotation axis RS may be the main plate 11.

[Advantages of Centrifugal Fan 100]

In the centrifugal fan 100 according to Embodiment 5, since the turbo blade portion 27 and the sirocco blade portion 26 are separate from each other, it is possible to reduce a loss that is caused by the flow of air to the sirocco blade portion 26. Furthermore, the centrifugal fan 100 according to Embodiment 5 has a configuration similar to those of the centrifugal fans 100 according to Embodiments 1 to 3, and can thus obtain advantages similar to those of the centrifugal fans 100 according to Embodiments 1 to 3.

Embodiment 6

[Air-Conditioning Apparatus 200]

Figure 34:
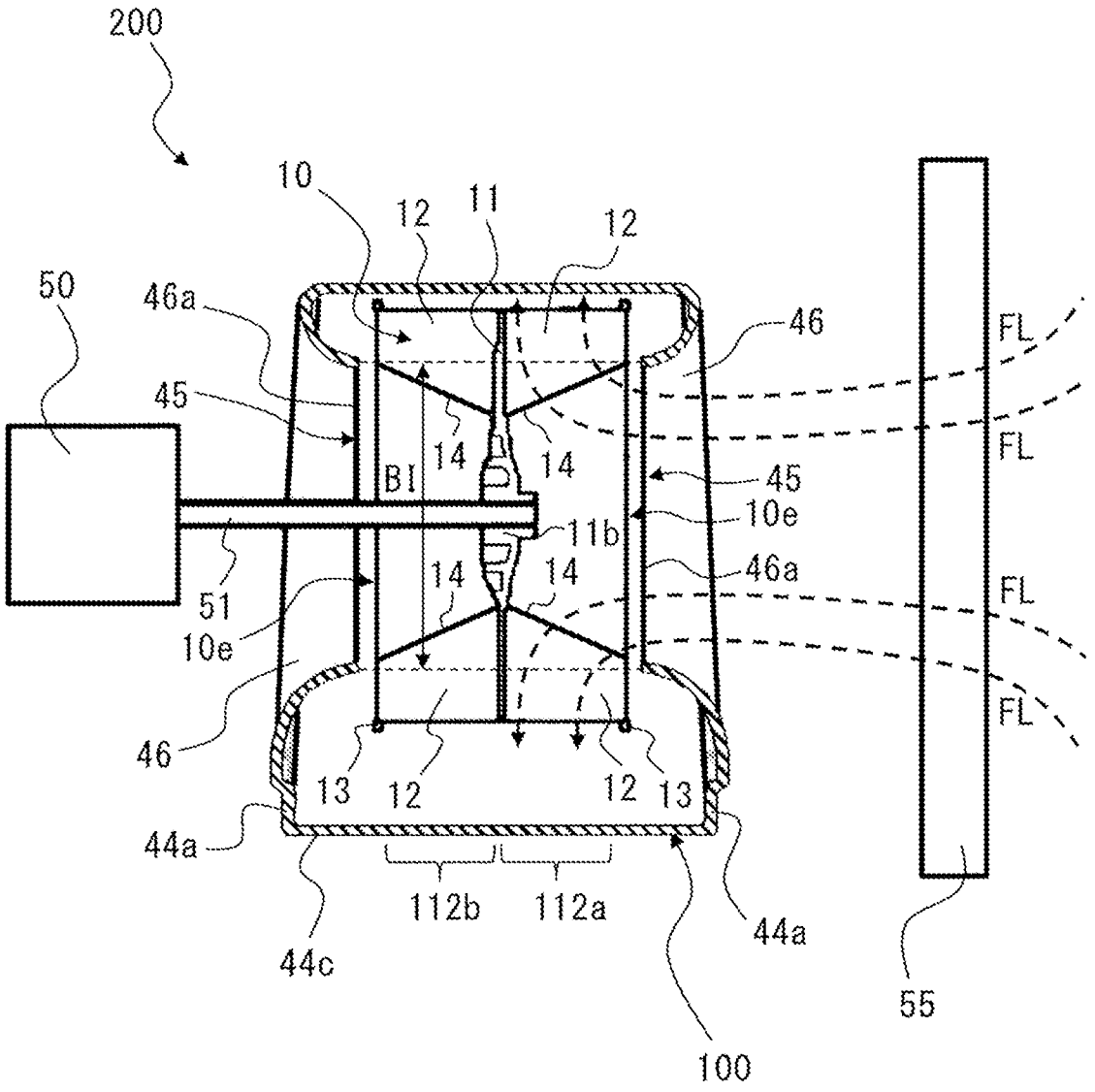
FIG. 34 is a conceptual diagram illustrating an internal configuration of an air-conditioning apparatus according to Embodiment 6.
Figure 35:
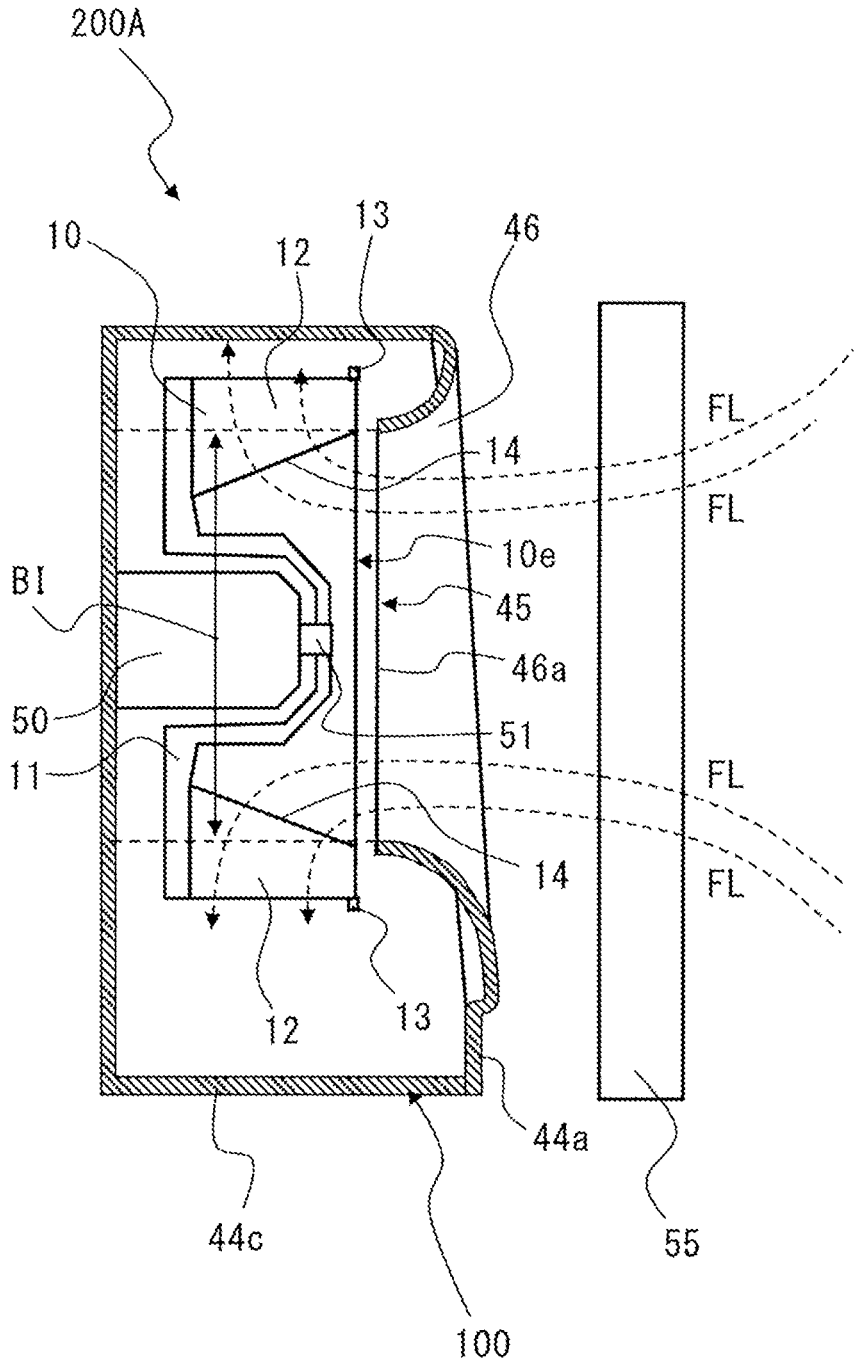
FIG. 35 is a conceptual diagram illustrating an internal configuration of another air-conditioning apparatus according to Embodiment 6.

FIG. 34 is a conceptual diagram illustrating an internal configuration of an air-conditioning apparatus 200 according to Embodiment 6. FIG. 35 is a conceptual diagram illustrating an internal configuration of an air-conditioning apparatus 200A according to Embodiment 6. Regarding Embodiment 6, components that are the same as those of the impellers 10 and the centrifugal fans 100 as illustrated in FIGS. 1 to 33 will be denoted by the same reference signs, and their descriptions will thus be omitted. In FIGS. 34 and 35, dashed arrows FL indicate the flows of air currents that are sucked into the centrifugal fan 100.

The air-conditioning apparatus 200 includes a double suction type centrifugal fan 100. The air-conditioning apparatus 200A includes a single suction type centrifugal fan 100. The centrifugal fans 100 of the air-conditioning apparatuses 200 and 200A each include blades 12 that protrude inward of part of the bell mouth 46 that has the inside diameter BI. The inner peripheral ends 14 of the blades 12 protrude inward of the part of the bell mouth 46 that has the inside diameter BI.

The air-conditioning apparatus 200 and the air-conditioning apparatus 200A each include a pressure-loss causing body 55, which is located in a flow path of air and reduces the rate of air that flows into the suction port 10*e*. The pressure-loss causing body 55 is located to face the suction port 10*e*. The pressure-loss causing body 55 allows air to pass therethrough, but hinders the flow of air. As the pressure-loss causing body 55, for example, a heat exchanger, a grille, or a filter is provided.

In the double suction type air-conditioning apparatus 200, the blades 12 each have the first blade portion 112*a* located on one surface of the main plate 11 and the second blade portion 112*b* located on the other surface of the main plate 11. It is assumed that the flow rate of air that flows into the air-conditioning apparatus 200 from a side where the pressure-loss causing body 55 is located is lower than that of air that flows into the air-conditioning apparatus 200 from a side where the motor 50 is located. In this case, the impeller 10 of the centrifugal fan 100 may be formed such that the inter-blade distance in the first blade portion 112*a* located closer to the pressure-loss causing body 55 is greater than the inter-blade distance in the second blade portion 112*b* located closer to the motor 50.

When the impeller 10 of the centrifugal fan 100 is rotated, air in an air-conditioning target space passes through the pressure-loss causing body 55. In the case where the pressure-loss causing body 55 is a heat exchanger, the air that passes through the pressure-loss causing body 55 exchanges heat with refrigerant that flows in the heat exchanger, thereby the air is adjusted in temperature and humidity. After passing through the pressure-loss causing body 55, the air is guided to the bell mouth 46 and sucked into the impeller 10. The air sucked in the impeller 10 is blown out from the impeller 10 in the radial direction. The air blown out from the impeller 10 passes through the scroll casing 40 and is then blown through the discharge port 42*a* of the scroll casing 40. After blowing out from the scroll casing 40, the air is brown into the air-conditioning target space.

[Advantages of Air-Conditioning Apparatuses 200 and 200A]

The air-conditioning apparatuses 200 and 200A according to Embodiment 6 each include the centrifugal fan 100 having the above configuration and the pressure-loss causing body 55, which is located in the flow passage for air and reduces the flow rate of air that flows into the suction port 10*e*. The pressure-loss causing body 55 is provided to face the suction port 10*e*. In each of the air-conditioning apparatuses 200 and 200A, although the pressure-loss causing body 55 is provided to face the suction port 10*e*, it is possible to reduce a loss that is caused during suction of air, and improve the efficiency, since the inter-blade distance between the blades of the impeller 10, to which air flows immediately after passing through the pressure-loss causing body 55, increases.

The air-conditioning apparatuses 200 and 200A according to Embodiment 6 each include the impeller 10 and the centrifugal fan 100 according to any of Embodiments 1 to 5. Therefore, the air-conditioning apparatuses 200 and 200A can obtain similar advantages to those of Embodiments 1 to 5.

Embodiments 1 to 6 described above may be combined with each other and then put to practical use. The configurations as described above regarding the above embodiments are examples, and can be combined with a well-known technique. Also, part of the configurations can be omitted or modified without departing from the gist and scope of the present disclosure.

REFERENCE SIGNS LIST

10: impeller, 10L: impeller, 10*e*: suction port, 11: main plate, 11*b*: boss, 11*b*1: shaft hole, 12: blade, 12A: first blade, 12A1: first sirocco blade portion, 12A11: first sirocco region, 12A2: first turbo blade portion, 12A21: first turbo region, 12A21*a*: first turbo region, 12A2*a*: first turbo blade portion, 12A3: first radial blade portion, 12B: second blade, 12B1: second sirocco blade portion, 12B11: second sirocco region, 12B2: second turbo blade portion, 12B21: second turbo region, 12B21*a*: second turbo region, 12B2*a*: second turbo blade portion, 12B3: second radial blade portion, 12*l*: inner-circumferential-side region, 12R: outer-circumferential-side region, 12*c*: center line, 13: side plate, 13*a*: first side plate, 13*b*: second side plate, 14: inner peripheral end, 14A: inner peripheral end, 14A1: leading edge, 14B: inner peripheral end, 14B1: leading edge, 15A: outer peripheral end, 15A1: trailing edge, 15B: outer peripheral end, 1581: trailing edge, 21: base portion, 22: end portion, 22*a*: side surface, 22*b*: side surface, 23: separation, 23*a*: separation, 24: blade shape, 24A: first blade end, 24B: first blade end, 25A: second blade end, 25B: second blade end, 26: sirocco blade portion, 27: turbo blade portion, 28: inner blade portion, 29: outer blade portion, 31: blade midpoint, 31A: blade midpoint, 31B: blade midpoint, 32A: turbo midpoint, 32B: turbo midpoint, 33A: inclined-portion midpoint, 33B: inclined-portion midpoint, 34A: first turbo end, 34B: first turbo end, 35A: second turbo end, 35B: second turbo end, 36A: first inclined-portion end, 36B: first inclined-portion end, 37A: second inclined-portion end, 37B: second inclined-portion end, 38A: first inner end, 38B: first inner end, 39A: second outer end, 39B: second outer end, 40: scroll casing, 41: scroll portion, 41*a*: scroll start portion, 41*b*: scroll end portion, 42: discharge portion, 42*a*: discharge port, 42*b*: extension plate, 42*c*: diffuser plate, 42*d*: first side plate, 42*e*: second side plate, 43: tongue portion, 44*a*: side wall, 44*a*1: first side wall, 44*a*2: second side wall, 44*c*: circumferential wall, 45: casing suction port, 45*a*: first suction port, 45*b*: second suction port, 46: bell mouth, 46*a*: inner circumferential edge, 50: motor, 51: motor shaft, 55: pressure-loss causing body, 71: first plane, 72: second plane, 100: centrifugal fan, 112*a*: first blade portion, 112*b*: second blade portion, 122*a*: main-plate-side blade region, 122*b*: side-plate-side blade region, 131A: blade midpoint, 131B: blade midpoint, 140: air-conditioning apparatus, 141: inclined portion, 141A: inclined portion, 141B: inclined portion, 142: straight portion, 143: inclined portion, 144: first inclined portion, 145: second inclined portion, 146: inclined portion, 147: first inclined portion, 148: second inclined portion, 200: air-conditioning apparatus, 200A: air-conditioning apparatus, BI: inside diameter, C1 circle, C1*a*: circle, C2: circle, C2*a*: circle, C3: circle, C3*a*: circle, C4: circle, C5: circle, C7: circle, C7*a*: circle, C8: circle, CD: circumferential direction, CL1: center line, CL2: center line, CL3: center line, CL4: center line, D1: direction, E: area, F: area, FL: dashed line arrow, ID1: inside diameter, ID1*a*: inside diameter, ID2: inside diameter, ID2*a*: inside diameter, ID3: inside diameter, ID3*a*: inside diameter, ID4: inside diameter, ID4*a*: inside diameter, L: open arrow, L1*a*: blade length, L1*b*: blade length, L2*a*: blade length, L2*b*: blade length, MP: middle position, MS: distance, OD: blade outside diameter, OD1: outside diameter, OD2: outside diameter, OD3: outside diameter, OD4: outside diameter, P1: first blade thickness portion, P2: second blade thickness portion, R: rotation direction, RS: rotation axis, SL: distance, T: blade thickness, T1: first blade thickness, T2: second blade thickness, TL1: tangent, TL2: tangent, TL3: tangent, TL4: tangent, V: point of view, W: width, α1: outlet angle, α2: outlet angle, β1: outlet angle, β2: outlet angle, θ1: inclination angle, θ2: inclination angle

The invention claimed is:

1. An impeller comprising:

a main plate configured to be driven to rotate;

an annular side plate provided opposite to the main plate and having a suction port for air; and a plurality of blades connected to the main plate and the side plate and arranged in a circumferential direction around a rotation axis of the main plate, wherein each of the plurality of blades has an inner peripheral end located adjacent to the rotation axis in a radial direction from the rotation axis, an outer peripheral end located closer to an outer circumferential side of the impeller than the inner peripheral end in the radial direction, a sirocco blade portion that includes the outer peripheral end, has an outlet angle of greater than 90 degrees, and forms a forward-swept blade, and a turbo blade portion that includes the inner peripheral end and forms a swept-back blade, wherein each of the plurality of blades has an end portion that faces the suction port and a base portion that is connected to the main plate, and the end portion has a smaller thickness than a thickness of the base portion in the sirocco blade portion, and wherein the end portion of each of the plurality of blades has a blade shape, and in the end portion having the blade shape, a first blade thickness of an inner circumferential side of the impeller is greater than a second blade thickness of the outer circumferential side.

2. The impeller of claim 1, wherein in the end portion having the blade shape, each of the plurality of blades has a blade thickness that gradually decreases from the inner circumferential side toward the outer circumferential side.

3. The impeller of claim 1, wherein where an inter-blade distance is a distance between any adjacent two of the plurality of blades that are adjacent to each other in the circumferential direction, the inter-blade distance between the turbo blade portions increases from the inner circumferential side toward the outer circumferential side.

4. The impeller of claim 1, wherein where in each of the plurality of blades, in the end portion having the blade shape, a blade midpoint is a midpoint between a first end of the blade on the inner circumferential side and a second end of the blade on the outer circumferential side, the first blade thickness is a thickness of a portion of the blade that has a maximum blade thickness in a region between the first end and the blade midpoint, and the second blade thickness is a thickness of a portion of the blade that has a maximum blade thickness in a region between the second end and the blade midpoint.

5. The impeller of claim 1, wherein a portion of the blade that has the first blade thickness and a portion of the blade that has the second blade thickness are located in the turbo blade portion, and in the turbo blade portion, in the end portion having the blade shape, the first blade thickness is greater than the second blade thickness.

6. The impeller of claim 5, wherein where in the turbo blade portion, in the end portion having the blade shape, a turbo midpoint is a midpoint between a first end of the turbo blade portion on the inner circumferential side and a second end of the turbo blade portion on the outer circumferential side, the first blade thickness is a thickness of a portion of the turbo blade portion that has a maximum blade thickness in a region between the first end and the turbo midpoint, and the second blade thickness is a thickness of a portion of the turbo blade portion that has a maximum blade thickness in a region between the second end and the turbo midpoint.

7. The impeller of claim 1, wherein each of the plurality of blades has at least one inclined portion in which the inner peripheral end is inclined such that a distance between the inner peripheral end and the rotation axis gradually increases in a direction from the main plate to the side plate, a portion of the blade that has the first blade thickness and a portion of the blade that has the second blade thickness are located in the at least one inclined portion, and in the at least one inclined portion, in the end portion having the blade shape, the first blade thickness is greater than the second blade thickness.

8. The impeller of claim 7, wherein where in the at least one inclined portion, in the end portion having the blade shape, an inclined-portion midpoint is a midpoint between a first end of the at least one inclined portion on the inner circumferential side and a second end of the at least one inclined portion on the outer circumferential side, the first blade thickness is a thickness of a portion of the at least one inclined portion that has a maximum blade thickness in a region between the first end and the inclined-portion midpoint, and the second blade thickness is a thickness of a portion of the at least one inclined portion that has a maximum blade thickness between the second end and the inclined-portion midpoint.

9. The impeller of claim 7, wherein the at least one inclined portion is located in the turbo blade portion.

10. The impeller of claim 7, wherein each of the plurality of blades has a straight portion in which the inner peripheral end extends along the rotation axis, in addition to the at least one inclined portion.

11. The impeller of claim 7, wherein the at least one inclined portion of each of the plurality of blades are two or more different types of inclined portions.

12. The impeller of claim 1, wherein an inside diameter of portions of the turbo blade portions that are adjacent to the main plate is smaller than an inside diameter of portions of the turbo blade portions that are adjacent to the side plate.

13. The impeller of claim 1, wherein each of the plurality of blades has a first region located closer to the main plate than a middle position of the blade in an axial direction along the rotation axis, and a second region located closer to the side plate than the first region, and wherein where a blade length is a length of each of the plurality of blades in the radial direction, a blade length in the first region is longer than a blade length in the second region, and in the first region and the second region, a proportion of the turbo blade portion to the sirocco blade portion is higher than a proportion of the sirocco blade portion to the turbo blade portion.

14. A centrifugal fan comprising:

the impeller of claim 1; and a scroll casing accommodating the impeller, the scroll casing including a scroll circumferential wall and a side wall provided with a bell mouth that defines a casing suction port that communicates with a space defined by the main plate and the plurality of blades.

15. The centrifugal fan of claim 14, wherein each of the plurality of blades has a portion having the first blade thickness and a portion having the second blade thickness, and the portion having the first blade thickness and the portion having the second blade thickness are located inward of an inner circumferential edge of the bell mouth as viewed in a direction along the rotation axis, and in the blade, in the end portion having the blade shape that is located inward of the inner circumferential edge of the bell mouth, the first blade thickness is larger than the second blade thickness in the blade shape.

16. The centrifugal fan of claim 14, wherein as viewed in a direction along the rotation axis, where a blade midpoint is a midpoint between a first inner end on the inner circumferential side and a second outer end on the outer circumferential side, in the end portion having the blade shape at each of the plurality of blades and located inward of the inner circumferential edge of the bell mouth, the first blade thickness is a thickness of a portion of the blade that has a maximum blade thickness in a region between the first inner end and the blade midpoint, and the second blade thickness is a thickness of a portion of the blade that has a maximum blade thickness in a region between the second outer end and the blade midpoint.

17. The centrifugal fan of claim 14, further comprising:

a motor provided the scroll casing and connected to the main plate, wherein the plurality of blades include a first blade portion located at one surface of the main plate, and a second blade portion located at an other surface of the main plate, and wherein in the impeller, where an inter-blade distance is a distance between any adjacent two of the plurality of blades that are adjacent to each other in the circumferential direction, the inter-blade distance in the first blade portion facing the motor is greater than that in the second blade portion located on a side of the main plate that is located opposite to the motor.

18. The centrifugal fan of claim 14, wherein a blade outside diameter of the outer peripheral ends of the plurality of blades is larger than an inside diameter of the bell mouth, wherein the bell mouth has an inner-circumferential-side end that is located on the inner circumferential side and that faces the impeller in an axial direction along the rotation axis, wherein where an outer blade portion is a portion of each of the blades that is located closer to the outer circumferential side in the radial direction from the rotation axis than a region corresponding to an inside diameter of the inner-circumferential-side end, the outer blade portion includes the sirocco blade portion and the turbo blade portion, and wherein in the scroll casing, the sirocco blade portion is located apart from the bell mouth by a first distance in the axial direction along the rotation axis, the turbo blade portion is located apart from the bell mouth by a second distance in the axial direction along the rotation axis, and the outer blade portion and the bell mouth are arranged such that the first distance is greater than the second distance.

19. The centrifugal fan of claim 18, wherein the outer blade portion has a shape in which a first length that is a length of the turbo blade portion in the radial direction is greater than a second length that is a length of the sirocco blade portion in the radial direction.

20. The centrifugal fan of claim 18, wherein each of the plurality of blades has a first region located closer to the main plate than a middle position of the blade in the axial direction along the rotation axis, and a second region located closer to the side plate than the first region, and in the second region of the blade, the turbo blade portion is separate from the sirocco blade portion.

21. The centrifugal fan of claim 18, wherein each of the plurality of blades has a first region located closer to the main plate than a middle position of the blade in the axial direction along the rotation axis, and a second region located closer to the side plate than the first region, and in the first region and the second region of the blade, the turbo blade portion is separate from the sirocco blade portion.

22. An air-conditioning apparatus comprising:

the centrifugal fan of claim 14; and a pressure-loss causing body provided in a flow path of an air current and configured to reduce a flow rate of an air current that flows into the casing suction port, wherein the pressure-loss causing body faces the casing suction port.

* * * * *